US008206191B2

(12) United States Patent
Ota et al.

(10) Patent No.: US 8,206,191 B2
(45) Date of Patent: Jun. 26, 2012

(54) WATER JET PROPULSION WATERCRAFT

(75) Inventors: Nobuharu Ota, Shizuoka (JP); Hideyoshi Sato, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 253 days.

(21) Appl. No.: 12/648,316

(22) Filed: Dec. 29, 2009

(65) Prior Publication Data

US 2011/0159752 A1 Jun. 30, 2011

(51) Int. Cl.
*B63H 11/11* (2006.01)

(52) U.S. Cl. ..... 440/41

(58) Field of Classification Search ..... 440/38, 440/41, 40, 42, 43

See application file for complete search history.

(56) References Cited

U.S. PATENT DOCUMENTS 3,089,454 A * 5/1963 Chronic ..... 440/41
5,752,864 A * 5/1998 Jones et al. ..... 440/41
6,224,436 B1 * 5/2001 Westhoff et al. ..... 440/41
6,428,370 B1 * 8/2002 Jones ..... 440/38
6,875,064 B2 * 4/2005 Westhoff et al. ..... 440/41
6,913,496 B2 * 7/2005 Fuse et al. ..... 440/41
7,029,344 B2 * 4/2006 Tsumiyama et al. ..... 440/41
7,347,752 B2 * 3/2008 Morvillo ..... 440/41
7,500,890 B2 * 3/2009 Morvillo ..... 440/41

* cited by examiner

*Primary Examiner* — Lars A Olson
*Assistant Examiner* — Andrew Polay
(74) *Attorney, Agent, or Firm* — Keating & Bennett, LLP

(57) ABSTRACT

A water jet propulsion watercraft includes a pair of jet propulsion devices arranged right and left of a hull centerline. Each jet propulsion device includes a jetting unit arranged to jet water, a deflector supported on the hull and arranged to rotate to right and left, the deflector including a forward drive jet port and a reverse drive jet port. Each jet propulsion device includes a bucket arranged to change between a forward drive position and a reverse drive position. The bucket includes a reflecting surface arranged to reflect the water jetted from the forward drive jet port when the bucket is at the reverse drive position, and an auxiliary nozzle including an entrance opened to the reflecting surface and arranged to jet water introduced into the entrance along a hull right/left direction. The entrance of the auxiliary nozzle is spaced away from the forward drive jet port in the hull right/left direction and does not oppose the forward drive jet port in a state where the bucket is arranged at the reverse drive position and the deflector is arranged at the straight drive position.

20 Claims, 29 Drawing Sheets

WATER JET PROPULSION WATERCRAFT

BACKGROUND OF THE INVENTION

1. Field of the Invention

The present invention relates to a water jet propulsion watercraft.

2. Description of the Related Art

A water jet propulsion watercraft travels on water by a propulsive force generated by a jet propulsion device attached to a hull. The jet propulsion device sucks in and jets water to generate the propulsive force.

For example, a water jet propulsion watercraft according to a prior art disclosed in U.S. Pat. No. 6,875,064 B2 includes a pair of right and left jet propulsion devices disposed at a rear end of a hull. In this prior art, the pair of right and left jet propulsion devices respectively include stator nozzles 301R and 301L, steering nozzles 302R and 302L, and reverse gates 303R and 303L as shown in FIG. 28. Each of the stator nozzles 301R and 301L discharges a water flow, generated by rotation of an impeller, toward a rear of the hull. The steering nozzles 302R and 302L are rotatable to right and left about pivot axes 304R and 304L. By the steering nozzles 302R and 302L rotating to the right and left, the directions of the water flows from the stator nozzles 301R and 301L are changed to the right and left. The direction of the water jet propulsion watercraft is thereby changed.

When the water jet propulsion watercraft is to be driven in reverse, the reverse gates 303R and 303L are disposed at the rear of the steering nozzles 302R and 302L. The reverse gates 303R and 303L respectively include first scoops 306R and 306L and second scoops 307R and 307L. The first scoops 306R and 306L are disposed comparatively far from a hull centerline 305 of the water jet propulsion watercraft. The second scoops 307R and 307L are disposed closer to the centerline 305 than the first scoops 306R and 306L.

The first scoops 306R and 306L direct the water from the steering nozzles 302R and 302L diagonally to the front of the water jet propulsion watercraft. The second scoops 307R and 307L direct the water from the steering nozzles 302R and 302L toward the centerline 305 of the water jet propulsion watercraft.

To drive the water jet propulsion watercraft straightly in reverse, the steering nozzles 302R and 302L are set straight with respect to the hull (in directions parallel to the centerline 305). In this state, the water jetted from the steering nozzles 302R and 302L flows outside the reverse gates 303R and 303L through the first scoops 306R and 306L or the second scoops 307R and 307L.

In this state, a water flow F301 discharged from the first scoop 306R is directed to the right front. The water flow F301 applies a left rearward propulsive force to the hull. A water flow F302 discharged from the second scoop 307R is directed substantially directly to the left. The water flow F302 applies a substantially directly rightward propulsive force to the hull. Likewise, a water flow F304 discharged from the first scoop 306L is directed to the left front. The water flow F304 applies a right rearward propulsive force to the hull. A water flow F303 discharged from the second scoop 307L is directed substantially directly to the right. The water flow F303 applies a substantially directly leftward propulsive force to the hull. A resultant vector of the forces applied to the hull by the water flows F301 to F304 is directed substantially directly rearward. A heading direction of the water jet propulsion watercraft is thus a directly rear direction D306.

On the other hand, to drive the water jet propulsion watercraft in reverse to the left, the steering nozzles 302R and 302L are directed to the right as shown in FIG. 29. In this case, the water from the right steering nozzle 301R flows outside the right reverse gate 303R through the first scoop 306R of the right reverse gate 303R. The water from the left steering nozzle 301L flows outside the left reverse gate 303L through the second scoop 307L of the left reverse gate 303L.

In this state, a water flow F307 discharged from the first scoop 306R is directed to the right front. The water flow F307 applies a left rearward propulsive force to the hull. A water flow F308 discharged from the second scoop 307L is directed to the right rear. The water flow F308 applies a left frontward propulsive force to the hull. A resultant force of the propulsive forces generated by the water flows F307 and F308 is directed left rearward. Thus, theoretically, the heading direction of the water jet propulsion watercraft is a left rear direction D310.

To drive the water jet propulsion watercraft in reverse to the right, the steering nozzles 302R and 302L are rotated to the left and theoretically, the water jet propulsion watercraft is thereby driven in reverse in a right rear direction in a manner similar to that described above.

SUMMARY OF THE INVENTION

The inventors of preferred embodiments of the present invention described and claimed in the present application conducted an extensive study and research regarding a water jet propulsion watercraft, such as the one described above, and in doing so, discovered and first recognized new unique challenges and previously unrecognized possibilities for improvements as described in greater detail below.

When the jet propulsion watercraft is driven in reverse straightly as shown in FIG. 28, the water flows F302 and F303 from the second scoops 307R and 307L directly oppose and collide with each other. The propulsive forces due to the water flows F302 and F303 thus cancel each other out. Moreover, the water flows F302 and F303 are directed substantially at right angles to the hull and thus generate hardly any propulsive forces in a front/rear direction. Thus, when straight reverse drive is performed, the propulsive force is weak and a reverse drive speed is low.

As shown in FIG. 29, when the hull is driven in reverse to the left rear, whereas the water flow F307 from the first scoop 306R includes a frontward component, the water flow F308 from the second scoop 307L includes a rearward component. The front/rear direction components of the propulsive forces generated by the water flows F307 and F308 thus cancel each other out. Moreover, the propulsive forces generated by the water flows F307 and F308 are large in right/left direction components and small in front/rear direction components. The propulsive force in a reverse drive direction is thus weak. The same applies in the case of reverse drive in the right direction, and the propulsive force in the reverse drive direction is inadequate. Thus, in actuality, although the jet propulsion watercraft can be turned at a fixed point, it is difficult to change the direction of the hull while running in reverse. Thus, for example, it is difficult to perform reverse drive of the jet propulsion watercraft so as to draw a "figure-eight" on water, and this means that it is extremely difficult to move to a target point in the reverse drive state.

In order to overcome the previously unrecognized and unsolved challenges described above, a preferred embodiment of the present invention provides a water jet propulsion watercraft that includes a hull, a pair of jet propulsion devices attached to the hull and arranged right and left of a hull centerline, each jet propulsion device including a jetting unit arranged to jet water toward a rear of the hull, a deflector supported on the hull and arranged to rotate, with respect to the hull, to right and left within a predetermined rotation range including a straight drive position, the deflector including a forward drive jet port and a reverse drive jet port, the deflector arranged to change a jetting direction of the water jetted from the jetting unit, and a bucket supported on the hull independently of the deflector so as to be displaced between a forward drive position retreated from the forward drive jet port and a reverse drive position of blocking the forward drive jet port, the bucket including, a reflecting surface arranged to receive the water jetted from the forward drive jet port and to reflect the water toward an inner side of the deflector when the bucket is at the reverse drive position, and an auxiliary nozzle having an entrance opened to the reflecting surface and arranged to jet water introduced into the entrance along a hull right/left direction, wherein the entrance of the auxiliary nozzle is arranged at a position away from the forward drive jet port in the hull right/left direction and not opposing the forward drive jet port in a state where the bucket is arranged at the reverse drive position and the deflector is arranged at the straight drive position. The "hull centerline" is a straight line passing through centers of a stem and a stern of the hull in plan view.

When the water jet propulsion watercraft is to be driven straightly in reverse, the buckets are disposed at the reverse drive positions of blocking the forward drive jet ports and the deflectors are disposed at the straight drive positions. In this state, the entrances of the respective auxiliary nozzles do not oppose the forward drive jet ports. A large portion of the water jetted from the jetting unit is thus jetted from the reverse drive jet port. A large propulsive force in a reverse drive direction can thus be applied to the hull.

Further, when the water jet propulsion watercraft is to be turned to a right direction or a left direction while driving in reverse, the bucket is disposed at the reverse drive position of blocking the forward drive jet port and the deflector is turned to the right or the left from the straight drive position. A portion of the water jetted from the jetting unit is thus introduced into the auxiliary nozzle from the entrance opened in the reflecting surface of the bucket. A portion of the water jetted from the jetting unit is jetted from the reverse drive jet port. The water introduced into the auxiliary nozzle is thus jetted in the hull right/left direction and a propulsive force in the right/left direction is obtained by this jetting. By the jetting of the water from the reverse drive jet port, an adequate propulsive force in the reverse drive direction is obtained. The hull can thereby be turned while being driven in reverse.

In a preferred embodiment of the present invention, a pair of the auxiliary nozzles respectively corresponding to the pair of jet propulsion devices are arranged to jet water in directions that are right/left symmetrical.

According to this arrangement, a propulsive force for turning the hull in one of either the left direction or the right direction can be generated by causing water to jet from one of the auxiliary nozzles. A propulsive force for turning the hull in the other of either the left direction or the right direction can be generated by causing water to jet from the other auxiliary nozzle. The hull can thus be turned in either direction.

In a preferred embodiment of the present invention, the entrance of the auxiliary nozzle is arranged so as to be positioned further away from the hull centerline in the hull right/left direction than the forward drive jet port and not oppose the forward drive jet port in the state where the bucket is arranged at the reverse drive position and the deflector is arranged at the straight drive position, and the auxiliary nozzle is arranged such that the water introduced into the entrance is jetted along the hull right/left direction and toward the hull centerline.

For example, a case where, in the right jet propulsion device, the deflector is at the straight drive position and the bucket is at the reverse drive position is considered. In this state, the entrance formed in the reflecting surface of the bucket is positioned to the right side relative to a position opposite the deflector. The deflector thus opposes the entrance when the deflector is turned to the right side. The water flow discharged from the deflector is thereby introduced into the auxiliary nozzle through the entrance. The water introduced into the auxiliary nozzle is jetted toward the hull centerline, that is, toward the left side. A propulsive force that turns the stern to the right side is thereby generated. The hull can thus be moved in a right rear direction with the stern being turned to the right direction.

Likewise, a case where, in the left jet propulsion device, the deflector is at the straight drive position and the bucket is at the reverse drive position is considered. In this state, the entrance formed in the reflecting surface of the bucket is positioned to the left side relative to the position opposite the deflector. The deflector thus opposes the entrance when the deflector is turned to the left side. The water flow discharged from the deflector is thereby introduced into the auxiliary nozzle through the entrance. The water introduced into the auxiliary nozzle is jetted toward the hull centerline, that is, toward the right side. A propulsive force that turns the stern to the left side is thereby generated. The hull can thus be moved in a left rear direction with the stern being turned to the left direction.

For example, a steering apparatus that interlockingly turns the right and left deflectors to the right and left may be included. For example, if the right and left deflectors are turned to the right side with respect to the straight drive positions (the forward drive jet ports are moved to the right) by the steering apparatus when the buckets are at the forward drive positions, a propulsive force that moves the stern in a left front direction is generated. The hull is thereby driven forward while turning toward the right (clockwise) in plan view and moves in a right front direction. Likewise, when the right and left deflectors are turned to the left side with respect to the straight drive positions (the forward drive jet ports are moved to the left) by the steering apparatus, a propulsive force that moves the stern in a right front direction is generated. The hull is thereby driven forward while turning toward the left (counterclockwise) in plan view and moves in a left front direction. On the other hand, if the right and left deflectors are turned to the right side with respect to the straight drive positions when the buckets are at the reverse drive positions, a propulsive force that moves the stern in a right rear direction is generated. The hull is thereby driven in reverse while turning toward the left (counterclockwise) in plan view and moves in a right rear direction. Likewise, when the right and left deflectors are turned to the left side with respect to the straight drive positions, a propulsive force that moves the stern in a left rear direction is generated. The hull is thereby driven in reverse while turning toward the right (clockwise) in plan view and moves in a left rear direction. The steering direction and the movement direction of the hull are thus matched during forward drive and reverse drive. Excellent steering performance can thus be realized.

In a preferred embodiment of the present invention, the auxiliary nozzle includes a tunnel portion that defines a flow path in communication with the entrance and running in the hull right/left direction along an outer surface of the bucket.

According to this arrangement, a water flow can be guided from an inner side to the outer surface side of the bucket to arrange a water flow in the right/left direction at the outer surface side of the bucket. The water flow generated from the auxiliary nozzle can thereby be prevented from being influenced by a water flow at the reflecting surface side of the bucket. Consequently, a propulsive force in the right/left direction can be generated effectively.

In a preferred embodiment of the present invention, the entrance is preferably configured to receive a portion of the water jetted from the deflector when the bucket is arranged at the reverse drive position and the forward drive jet port of the deflector opposes the entrance.

According to this arrangement, when the forward drive jet port of the deflector opposes the entrance of the auxiliary nozzle, a portion of the water flow jetted from the forward drive jet port of the deflector is introduced into the auxiliary nozzle. The remainder portion of the water flow is reflected by the reflecting surface of the bucket and is jetted from the reverse drive jet port. A propulsive force in the hull right/left direction can thus be generated from the discharge water flow from the auxiliary nozzle and, at the same time, a propulsive force in the reverse drive direction can be generated by the discharge water flow from the reverse drive jet port. The hull can thereby be turned while being driven in reverse.

A preferred embodiment of the present invention further includes, a nozzle interlocking mechanism arranged to interlockingly rotate a pair of the deflectors respectively provided in the pair of right and left jet propulsion devices to the right and left, and a bucket interlocking mechanism arranged to interlockingly displace a pair of the buckets respectively provided in the pair of right and left jet propulsion devices between the forward drive positions and the reverse drive positions, wherein a water flow is not jetted from either of a pair of the auxiliary nozzles respectively provided in the pair of buckets when the pair of buckets are at the reverse drive positions and the pair of deflectors are at the straight drive positions, and a water flow is jetted from one of the pair of auxiliary nozzles respectively provided in the pair of buckets and a water flow is practically not jetted from the other auxiliary nozzle when the pair of buckets are at the reverse drive position and the pair of deflectors are rotated to either the right or the left from the straight drive positions.

According to this arrangement, the pair of deflectors are interlockingly rotated to the right and left and thus excellent motion performance (turning performance and propulsion performance) can be obtained during forward drive. On the other hand, during reverse drive, the pair of buckets can be moved respectively in an interlocked manner by the bucket interlocking mechanism to the reverse drive positions of blocking the forward drive jet ports of the corresponding deflectors. The water flows jetted from the pair of jetting units can thereby be caused to be jetted respectively from the reverse drive jet ports of the corresponding deflectors, and the hull can thus be driven in reverse by an adequate propulsive force. Further, when, in the state where the pair of buckets are at the respective reverse drive positions, the pair of deflectors are rotated to either the right or the left in an interlocked manner, a water flow is jetted from one of the pair of auxiliary nozzles while a water flow is practically not jetted from the other auxiliary nozzle. Canceling out of the right/left direction propulsive forces generated by the water flows jetted from the pair of auxiliary nozzles can thus be avoided.

For example, it is preferable to make arrangements such that a water flow in the right direction is generated from one of the auxiliary nozzles and a water flow in the left direction is generated from the other auxiliary nozzle. Turning in either of the right and left directions is thereby enabled during reverse drive. In this case, canceling out of the propulsive forces of the water flows generated by the pair of auxiliary nozzles can be avoided by arranging so that when a water flow is jetted from one of the auxiliary nozzles, a water flow is not jetted from the other auxiliary nozzle. A large propulsive force for turning the water jet propulsion watercraft can thereby be secured in an efficient manner, and the turning performance during reverse drive can thus be improved.

In a preferred embodiment of the present invention, the reverse drive jet port of the deflector is arranged to jet a water flow toward a front of the hull when the bucket is arranged at the reverse drive position. According to this arrangement, a large rearward propulsive force can be secured during reverse drive.

In a preferred embodiment of the present invention, the reverse drive jet port is arranged such that a water flow jetting direction when the deflector is at the straight drive position is a direction that includes a component directed away from the hull centerline.

The jetting unit of the jet propulsion device generally sucks in water from an intake (water intake portion) disposed at a front side relative to a jetting position and jets the water rearward. Thus, when a water flow is jetted toward the front of the hull from the reverse drive jet port, bubbles resulting from the water flow jetting may reach the intake, become sucked into the jetting unit, and cause cavitation. Thus, by setting the water flow jetting direction from the reverse drive jet port to the direction that includes the component directed away from the hull centerline, cavitation can be prevented. Consequently, a large reverse drive direction propulsive force can be obtained. Theoretically, it should be possible to maximize the propulsive force during reverse drive by making the water flow jetting direction of the reverse drive jet port parallel or substantially parallel to the hull centerline. However, in actuality, in consideration of the cavitation, the propulsive force during reverse drive can be maximized by making the water flow jetting direction of the reverse drive jet port non-parallel to the hull centerline.

On the other hand, when the pair of deflectors are rotated in the same direction from the straight drive positions to either the right or the left, the water flow jetting direction of one of the reverse drive jet ports approaches a direction parallel or substantially parallel to the hull centerline. A rearward direction propulsive force that is parallel or substantially parallel to the hull centerline can thereby be increased. That is, an adequate reverse drive direction propulsive force can be secured when performing reverse drive while turning. The water flow jetting direction of the other reverse drive jet port includes a component that gives rise to a propulsive force that moves the stern to the rotation direction of the deflector. The turning of the hull can thereby be facilitated. Moreover, the water flow jetting direction of the other reverse drive jet port is made larger in angle with respect to the hull centerline than during straight drive. The cavitation in the corresponding jet propulsion device can thereby be prevented further and a large propulsive force can thus be secured.

In a preferred embodiment of the present invention, the hull includes, a hull bottom with a shape that becomes higher from center to sides, and the reverse drive jet port is arranged such that the water flow jetting direction when the deflector is at the straight drive position is a direction that includes a component directed toward the hull centerline.

According to this arrangement, when straight drive to the rear is performed, the water flow that is jetted frontward from the reverse drive jet port can be shifted toward the hull centerline side with respect to the intake. Cavitation can thereby be prevented. On the other hand, when the pair of deflectors are rotated in the same direction from the straight drive positions to either the right or the left, the water flow jetting direction of one of the reverse drive jet ports approaches a direction parallel or substantially parallel to the hull centerline. A rearward direction propulsive force that is parallel or substantially parallel to the hull centerline can thereby be increased. That is, an adequate reverse drive direction propulsive force can be secured when performing reverse drive while turning. Further, the water flow jetting direction of the other reverse drive jet port includes a component that gives rise to a propulsive force that moves the stern to the rotation direction of the deflector. The turning of the hull can thereby be facilitated. Moreover, the water flow jetting direction of the other reverse drive jet port is made larger in the angle with respect to the hull centerline than during straight drive. The cavitation in the corresponding jet propulsion device can thereby be prevented further and a large propulsive force can thus be secured.

By the downward protrusion of the center of the hull bottom of the hull, the water flow from each reverse drive jet port can be prevented from flowing beyond the center of the hull and toward the intake of the jet propulsion device at the opposite side. Thus, the Occurrence of cavitation in the respective jet propulsion devices can thereby be prevented.

In a preferred embodiment of the present invention, a pair of the reverse drive jet ports respectively provided in the pair of right and left jet propulsion devices are arranged such that the water flow jetting directions when the deflectors are at the straight drive positions are non-parallel to the hull centerline and are right/left symmetrical.

According to this arrangement, when the hull is to be driven in reverse straightly along the hull centerline, the water flows from the respective reverse drive jet ports are made right/left symmetrical. The resultant force of the propulsive forces that are generated by the water flows is thus parallel or substantially parallel to the front/rear direction of the hull. Straightness during reverse drive can thus be improved.

When straight reverse drive is performed, the water flows that are jetted toward the front can be shifted away from the intakes. Cavitation can thereby be prevented.

On the other hand, when the pair of deflectors are rotated in the same direction from the straight drive positions to either the right or the left, the water flow jetting direction of one of the reverse drive jet ports approaches a direction parallel or substantially parallel to the hull centerline. A rearward direction propulsive force that is parallel or substantially parallel to the hull centerline can thereby be increased. That is, an adequate reverse drive direction propulsive force can be secured when performing reverse drive while turning. The water flow jetting direction of the other reverse drive jet port includes a component that gives rise to a propulsive force that moves the stern to the rotation direction of the deflector. The turning of the hull can thereby be facilitated. Moreover, the water flow jetting direction of the other reverse drive jet port is made larger in the angle with respect to the hull centerline than during straight drive. The cavitation in the corresponding jet propulsion device can thereby be prevented further and a large propulsive force can thus be secured.

A preferred embodiment of the present invention further includes, an intake opening at the hull bottom, and an intake duct arranged to guide water sucked in from the intake to the deflector, wherein the reverse drive jet port is arranged such that the water flow jetting direction when the deflector is at the straight drive position is a direction that is shifted away from the intake.

According to this arrangement, the water flow from the reverse drive jet port can be prevented from being directed toward the intake. Consequently, cavitation in the jet propulsion device can be prevented and a large propulsive force can thus be secured during reverse drive.

A preferred embodiment of the present invention provides a water jet propulsion watercraft that includes a hull, and a pair of jet propulsion devices attached to the hull and arranged right and left of a hull centerline, each of the jet propulsion devices including a jetting unit arranged to jet water toward a rear of the hull, a deflector supported on the hull and arranged to rotate, with respect to the hull, to right and left within a predetermined rotation range including a straight drive position, the deflector including a forward drive jet port and a reverse drive jet port, the deflector arranged to change a jetting direction of the water jetted from the jetting unit, the reverse drive jet port arranged such that the water flow jetting direction when the deflector is at the straight drive position is non-parallel to the hull centerline, and a bucket supported on the hull so as to be displaced between a forward drive position retreated from the forward drive jet port and a reverse drive position of blocking the forward drive jet port.

According to this arrangement, water can be jetted from the reverse drive jet port by disposing the bucket at the reverse drive position and thereby blocking the forward drive jet port. A large reverse drive direction propulsive force can thereby be applied to the hull. Moreover, when the deflector is at the straight drive position, the water flow jetting direction of the reverse drive jet port is non-parallel to the hull centerline. The water flow from the reverse drive jet port can thereby be shifted away from the intake. Cavitation in the jet propulsion device can thereby be prevented, and a large propulsive force can thus be secured during reverse drive.

In a preferred embodiment of the present invention, the reverse drive jet port of the deflector is arranged to jet a water flow toward a front of the hull when the bucket is arranged at the reverse drive position.

According to this arrangement, of the water flow generated at each jet propulsion device, a forward component that is parallel or substantially parallel to the hull centerline can be made larger and thus a larger rearward propulsive force can be applied to the hull.

In a preferred embodiment of the present invention, the reverse drive jet port is arranged such that a water flow jetting direction when the deflector is at the straight drive position is a direction that includes a component directed away from the hull centerline.

According to this arrangement, the water flow jetted toward the front of the hull from the reverse drive jet port can be shifted to an outer side of the hull with respect to the intake. Cavitation in the jet propulsion device can thereby be prevented and a large reverse drive propulsive force can thus be secured. Theoretically, it should be possible to maximize the propulsive force during reverse drive by making the water flow jetting direction of the reverse drive jet port parallel or substantially parallel to the hull centerline. However, in actuality, in consideration of the cavitation, the propulsive force during reverse drive can be maximized by making the water flow jetting direction of the reverse drive jet port non-parallel to the hull centerline.

On the other hand, when the pair of deflectors are rotated in the same direction from the straight drive positions to either the right or the left, the water flow jetting direction of one of the reverse drive jet ports approaches a direction parallel or substantially parallel to the hull centerline. A rearward direction propulsive force that is parallel or substantially parallel to the hull centerline can thereby be increased. That is, an adequate reverse drive direction propulsive force can be secured when performing reverse drive while turning. The water flow jetting direction of the other reverse drive jet port includes a component that gives rise to a propulsive force that moves the stern to the rotation direction of the deflector. The turning of the hull can thereby be facilitated. Moreover, the water flow jetting direction of the other reverse drive jet port is made larger in the angle with respect to the hull centerline than during straight drive. The cavitation in the corresponding jet propulsion device can thereby be further prevented and a large propulsive force can thus be secured.

In a preferred embodiment of the present invention, the hull includes, a hull bottom with a shape that becomes higher from center to sides, and the reverse drive jet port is arranged such that the water flow jetting direction when the deflector is at the straight drive position is a direction that includes a component directed toward the hull centerline.

According to this arrangement, when straight drive to the rear is to be performed, the water flow that is jetted toward the front from the reverse drive jet port can be shifted toward the hull centerline side with respect to the intake. Cavitation can thereby be prevented. On the other hand, when the pair of deflectors are rotated in the same direction from the straight drive positions to either the right or the left, the water flow jetting direction of one of the reverse drive jet ports approaches a direction parallel or substantially parallel to the hull centerline. A rearward direction propulsive force that is parallel or substantially parallel to the hull centerline can thereby be increased. That is, an adequate reverse drive direction propulsive force can be secured when performing reverse drive while turning. Further, the water flow jetting direction of the other reverse drive jet port includes a component that gives rise to a propulsive force that moves the stern to the rotation direction of the deflector. The turning of the hull can thereby be facilitated. Moreover, the water flow jetting direction of the other reverse drive jet port is made larger in the angle with respect to the hull centerline than during straight drive. The cavitation in the corresponding jet propulsion device can thereby be further prevented and a large propulsive force can thus be secured.

By the downward protrusion of the center of the hull bottom of the hull, the water flow from each reverse drive jet port can be prevented from flowing beyond the center of the hull and toward the intake of the jet propulsion device at the opposite side. Occurrence of cavitation in the respective jet propulsion devices can thereby be prevented.

In a preferred embodiment of the present invention, the pair of right and left reverse drive jet ports are arranged such that the water flow jetting directions when the deflectors are at the straight drive positions are right/left symmetrical.

According to this arrangement, when the hull is to be driven in reverse straightly along the hull centerline, the water flows from the respective reverse drive jet ports are right/left symmetrical. The resultant force of the propulsive forces that are generated by the water flows is thus parallel or substantially parallel to the front/rear direction of the hull. Straightness during reverse drive can thus be improved.

When reverse straight drive is performed, the water flows that are jetted toward the front can be shifted away from the intakes. Cavitation can thereby be prevented and a large propulsive force can be secured.

On the other hand, when the pair of deflectors are rotated in the same direction from the straight drive positions to either the right or the left, the water flow jetting direction of one of the reverse drive jet ports approaches a direction parallel or substantially parallel to the hull centerline. A rearward direction propulsive force that is parallel or substantially parallel to the hull centerline can thereby be increased. That is, an adequate reverse drive direction propulsive force can be secured when performing reverse drive while turning. Further, the water flow jetting direction of the other reverse drive jet port includes a component that gives rise to a propulsive force that moves the stern to the rotation direction of the deflector. The turning of the hull can thereby be facilitated. Moreover, the water flow jetting direction of the other reverse drive jet port is made larger in the angle with respect to the hull centerline than during straight drive. The cavitation in the corresponding jet propulsion device can thereby be prevented further and a large propulsive force can thus be secured.

A preferred embodiment of the present invention further includes an intake arranged to be opened at the hull bottom, and an intake duct arranged to guide the water sucked in from the intake to the deflector, wherein the reverse drive jet port is arranged such that the water flow jetting direction when the deflector is at the straight drive position is a direction that is shifted away from the intake.

According to this arrangement, the water flow from the reverse drive jet port can be prevented from being directed toward the intake. Consequently, cavitation in the jet propulsion device can be prevented and a large propulsive force can be secured.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
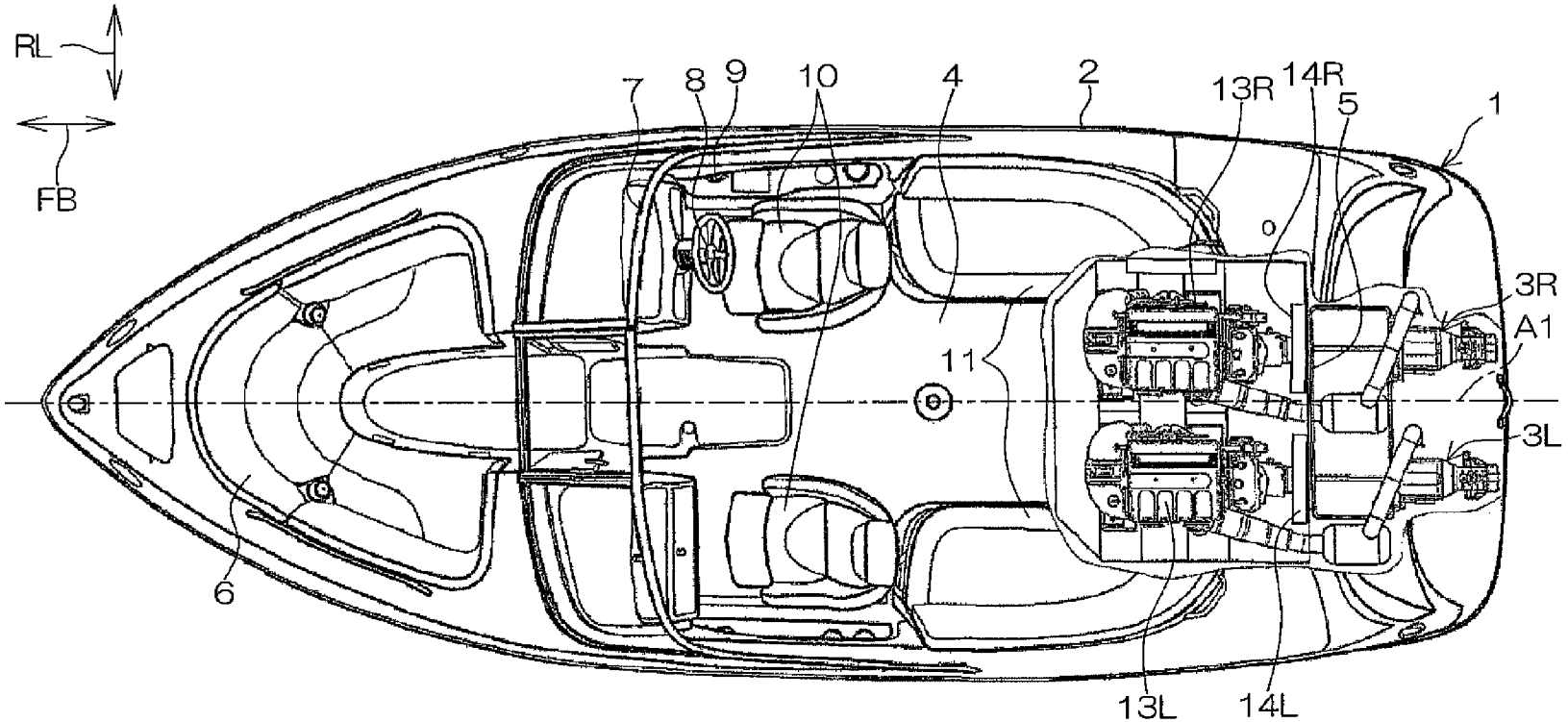
FIG. 1 is a plan view of a general arrangement of a water jet propulsion watercraft according to a first preferred embodiment of the present invention with a portion of a hull being broken away to show an arrangement of an interior of the hull.

FIG. 1 is a plan view of a general arrangement of a water jet propulsion watercraft 1 according to a first preferred embodiment of the present invention with a portion of a hull being broken away to show an arrangement of an interior of the hull. The water jet propulsion watercraft 1 is used for traveling on the water on a lake and at sea, etc. The water jet propulsion watercraft 1 preferably includes a hull 2, and a pair of right and left jet propulsion devices 3L and 3R attached to the hull 2 and arranged in a right/left symmetrical manner across a hull centerline A1. The hull centerline A1 is a straight line passing through centers of a stem and a stern in plan view.

The hull 2 extends long in a front/rear direction FB of the hull 2 and has a predetermined width in a right/left direction RL of the hull 2. In the following description, the front/rear direction FB of the hull 2 shall be referred to simply as the "front/rear direction FB." The right/left direction RL of the hull 2 shall be referred to simply as the "right/left direction RL." An up/down direction UD of the hull 2 when the water jet propulsion watercraft 1 is stationary at a normal orientation on water shall be referred to simply as the "up/down direction UD." Further, when simply "right/left," "front/rear," or "up/down" is mentioned, this shall signify the right/left direction, the front/rear direction, or the up/down direction of the hull 2.

The hull 2 includes a deck 4 and a hull body 5. A floor surface of the deck 4 is substantially parallel to the front/rear direction FB and the right/left direction RL. A front seat 6, a windshield 7, a steering wheel 8, a throttle/shift lever 9, a pair of right and left central seats 10, and a rear seat 11 are arranged on and attached to the deck 4 in that order from the front.

The steering wheel 8 is an operating member that is operated by a marine vessel operator to change a direction of the hull 2. By operation of the steering wheel 8, a direction in which water is jetted by the pair of right and left jet propulsion devices 3L and 3R can be changed to the right or the left.

The throttle/shift lever 9 is another operating member that is operated by the marine vessel operator. By operating the lever 9, the marine vessel operator can adjust outputs of engines 13R and 13L included in the pair of right and left jet propulsion devices 3L and 3R and can switch a heading direction of the hull 2 to a forward drive direction or a reverse drive direction.

Figure 2:
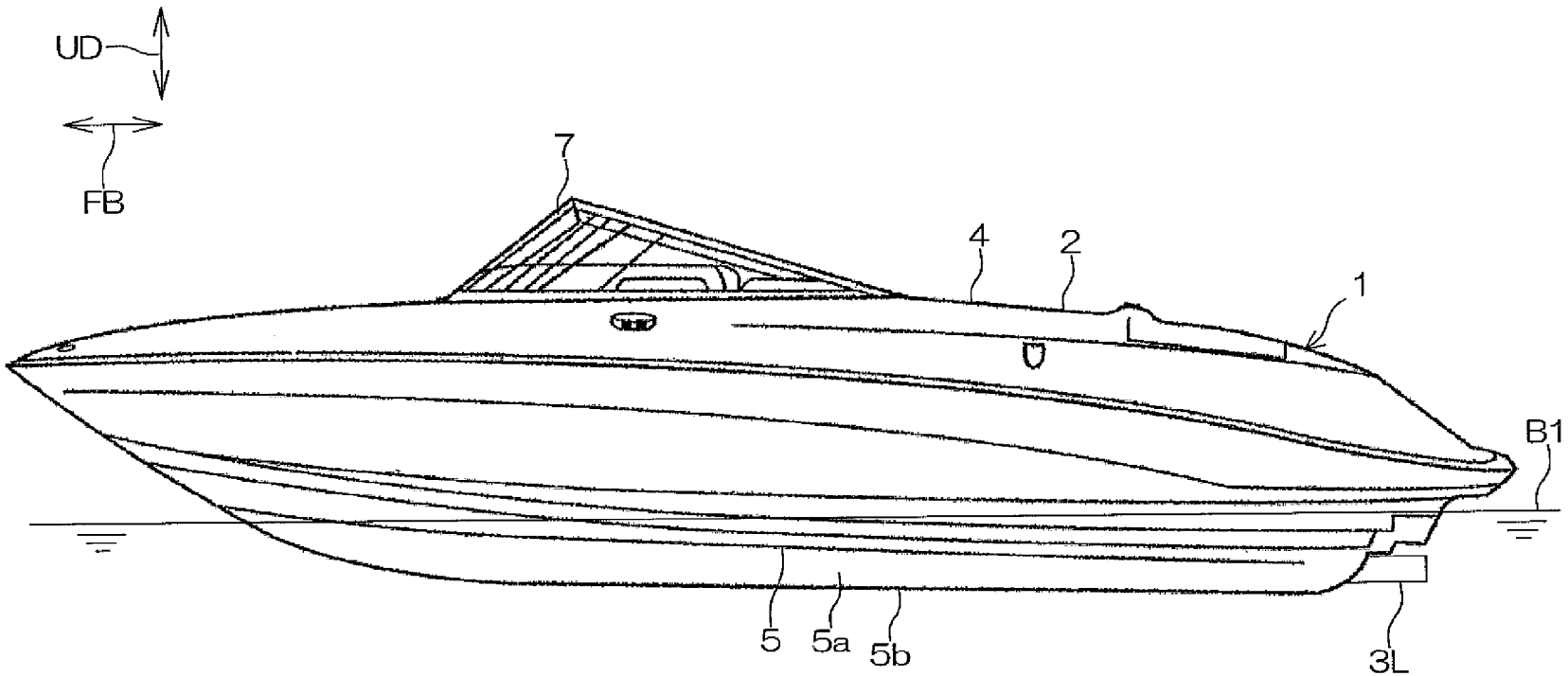
FIG. 2 is left side view of the water jet propulsion watercraft in a stationary state of floating on water.

FIG. 2 is left side view of the water jet propulsion watercraft 1 in a stationary state of floating on water. Referring to FIG. 1 and FIG. 2, the hull body 5 is arranged below the deck 4. The hull body 5 has a shape that is substantially right/left symmetrical about a ridgeline 5*b* that is arranged at a bottom surface 5*a* (hull bottom) of the hull body 5 and extends straight in the front/rear direction. The ridgeline 5*b* coincides with the hull centerline A1 in plan view. In the following description, a state of being symmetrical in regard to a plane (symmetry plane) that contains the hull centerline A1 and is parallel to the up/down direction UD shall be expressed simply as "right/left symmetrical."

When the water jet propulsion watercraft 1 is stopped on still water without waves, a draftline B1 of the water jet propulsion watercraft 1 is substantially horizontal to the front/rear direction FB.

Referring to FIG. 1, the pair of right and left engines 13R and 13L, a pair of right and left engine ECUs (electronic control units) 14R and 14L, and the pair of right and left jet propulsion devices 3R and 3L are attached to the hull body 5.

The pair of right and left engines 13R and 13L are attached to positions near the stern inside the hull body 5. The pair of right and left engines 13R and 13L are arranged in a right/left symmetrical manner. Each of the engines 13R and 13L is, for example, a multi-cylinder, four-cycle internal combustion engine. The right engine 13R is a drive source that provides a driving force to the right jet propulsion device 3R. The left engine 13L is a drive source that provides a driving force to the left jet propulsion device 3L. By obtaining the driving forces from engines 13R and 13L, the jet propulsion devices 3R and 3L suck in water from the hull bottom and jet the water. A propulsive force is thereby applied to the hull 2. The right engine ECU 14R controls the right engine 13R. The left engine ECU 14L controls the left engine 13L.

Figure 3:
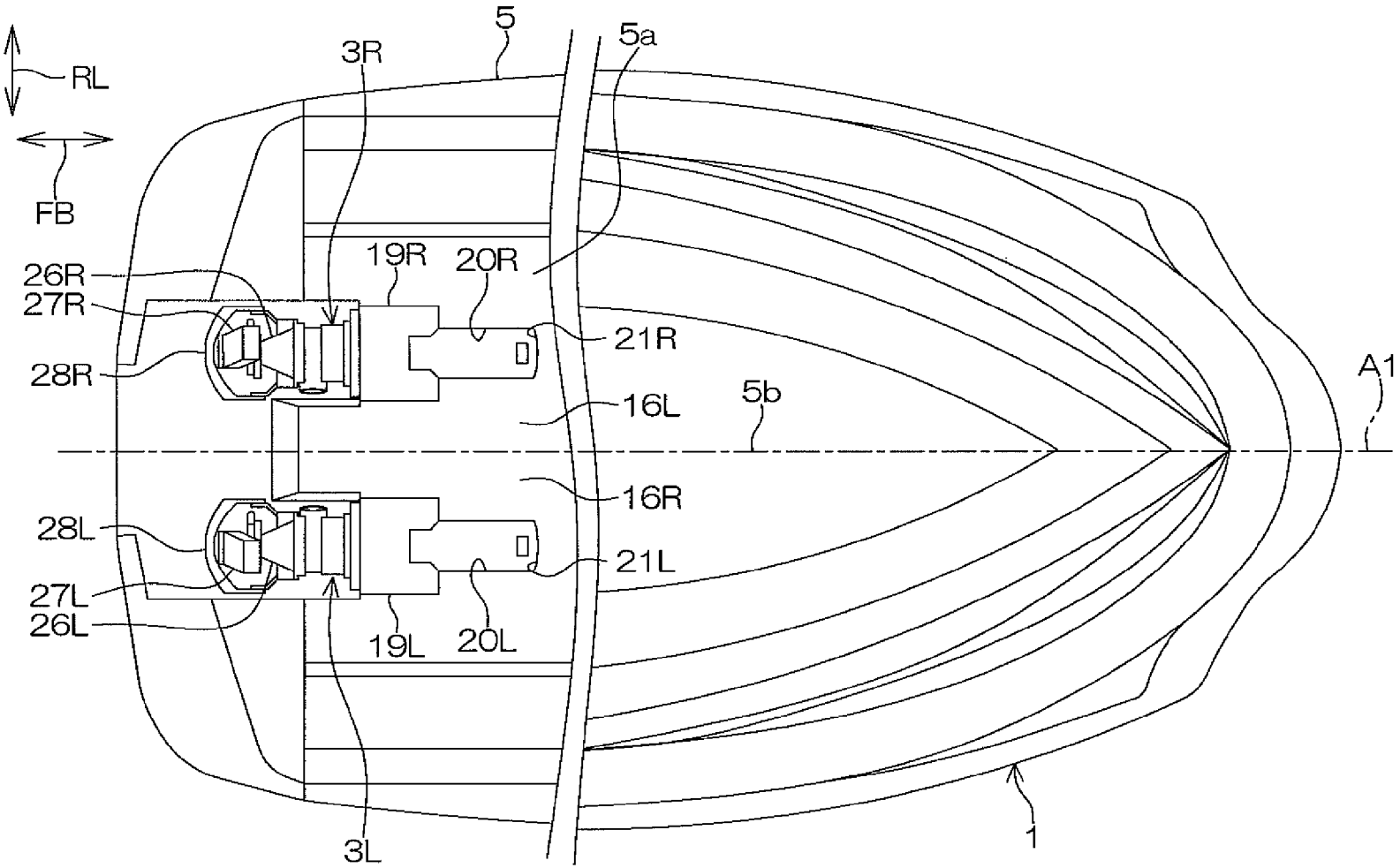
FIG. 3 is a bottom view of the water jet propulsion watercraft.
Figure 4:
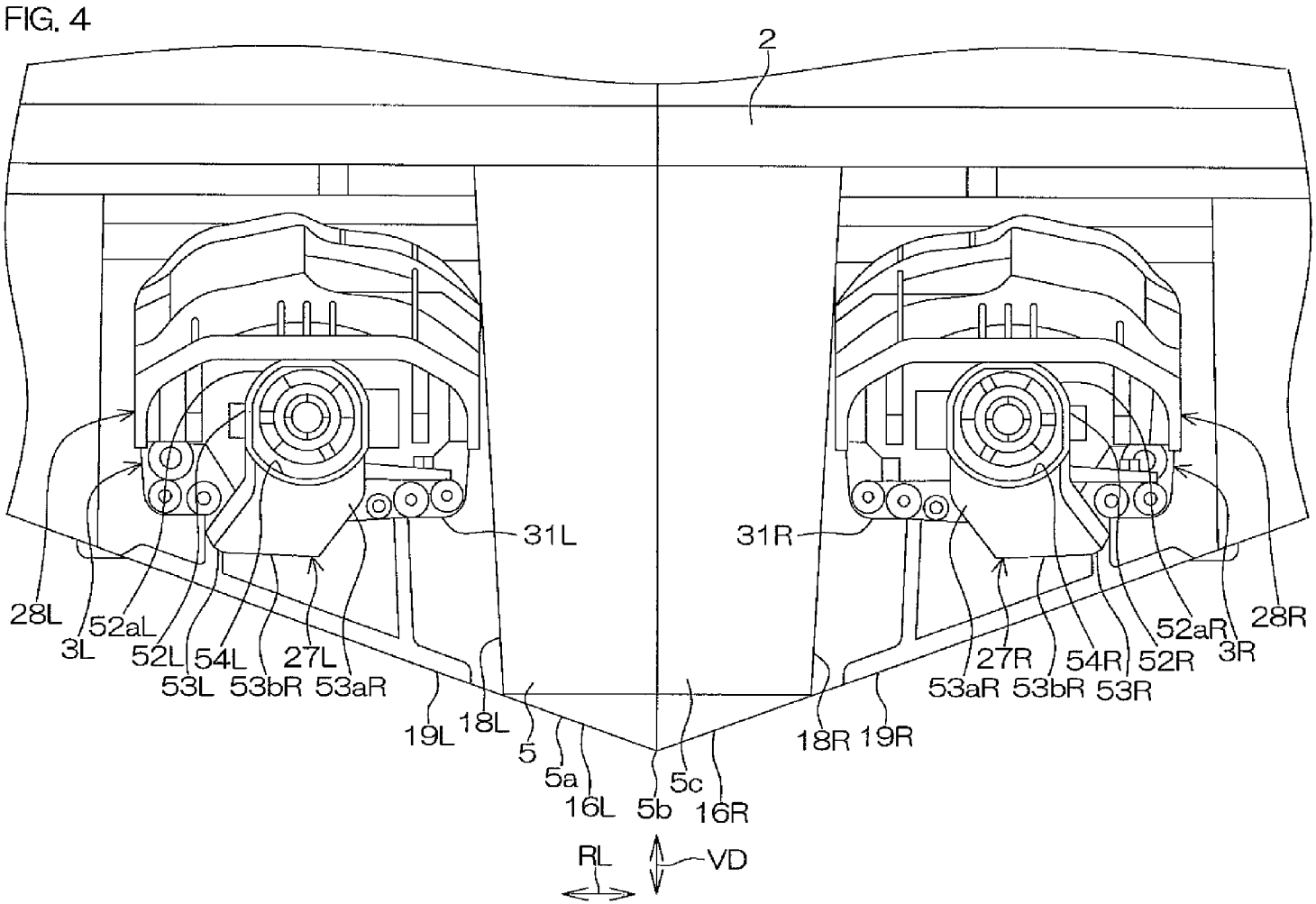
FIG. 4 is a rear view of principal portions in a vicinity of a pair of right and left jet propulsion devices as viewed from a rear of the hull.

FIG. 3 is a bottom view of the water jet propulsion watercraft 1. FIG. 4 is a rear view of principal portions in a vicinity of the pair of right and left jet propulsion devices 3R and 3L as viewed from a rear of the hull 2. Referring to FIG. 3 and FIG. 4, a pair of right and left inclined surfaces 16R and 16L are arranged at a rear end side of the bottom surface 5*a* of the hull body 5.

The pair of right and left inclined surfaces 16R and 16L are arranged right/left symmetrically. The right inclined surface 16R of the hull body 5 is inclined such that a portion that is further in the right direction from the ridgeline 5*b* is positioned further upward. The left inclined surface 16L of the hull body 5 is inclined such that a portion that is further in the left direction from the ridgeline 5*b* is positioned further upward. The bottom surface 5*b* of the hull 2 thus forms a hull bottom with a shape that becomes higher from center (ridgeline 5*b*) to sides.

The right jet propulsion device 3R is arranged at the upper right relative to the ridgeline 5*b* and the left jet propulsion device 3L is arranged at the upper left relative to the ridgeline 5*b*.

Figure 5:
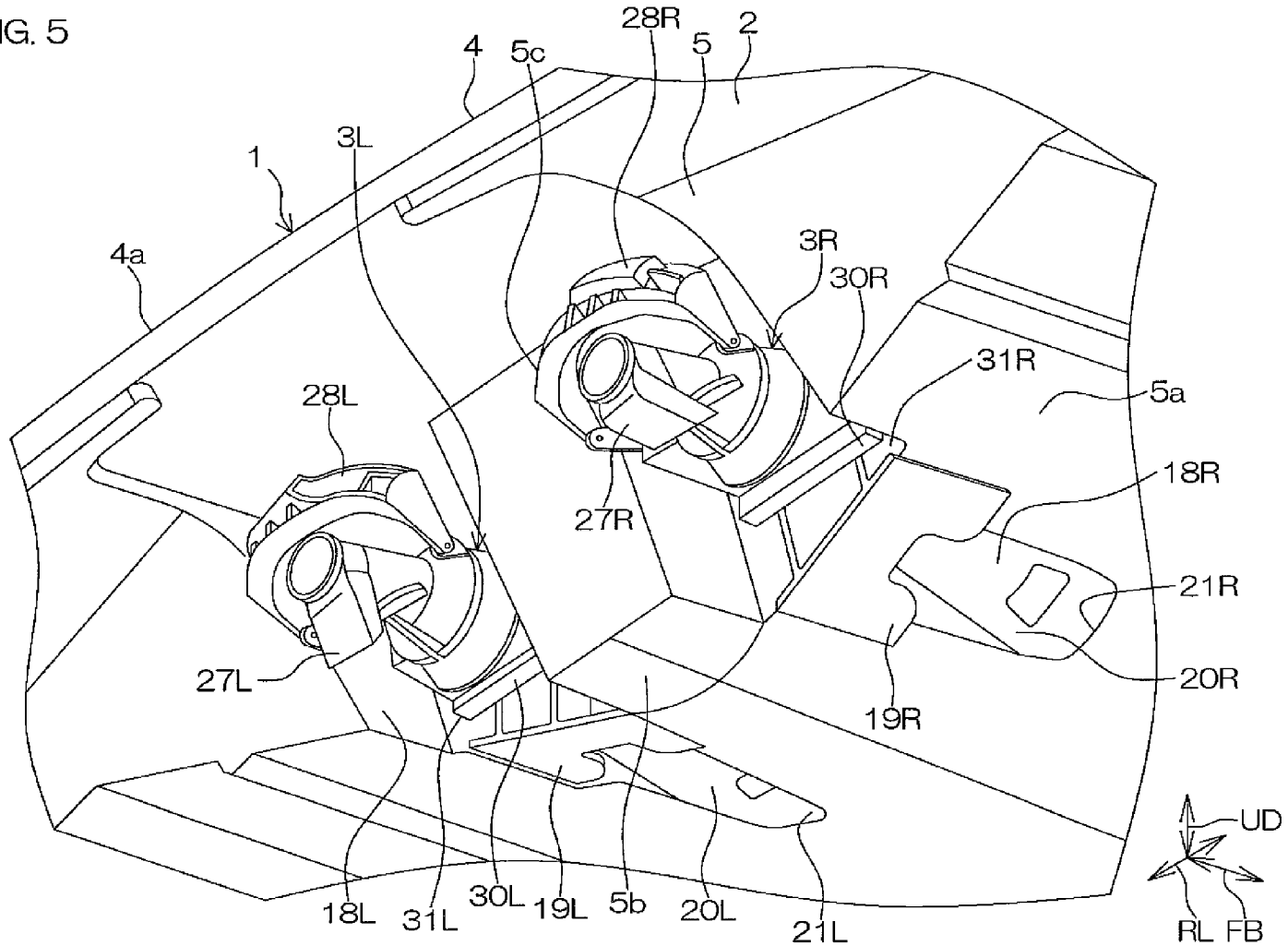
FIG. 5 is a perspective view of principal portions of the water jet propulsion watercraft as viewed from below the hull.

FIG. 5 is a perspective view of principal portions of the water jet propulsion watercraft 1 as viewed from below the hull 2. Referring to FIG. 5, a rear deck 4*a* extends rearward above a rear end of the hull body 5. At a rear end of a bottom portion of the hull body 5, a pair of right and left recessed portions 18R and 18L are formed right/left symmetrically. The pair of right and left recessed portions 18R and 18L are arranged to house a portion of the right jet propulsion device 3R and a portion of the left jet propulsion device 3L.

The right recessed portion 18R is arranged at a right side of the ridgeline 5*b*. The right recessed portion 18R extends in the front/rear direction, is arranged from a rear end portion of the bottom surface 5*a* of the hull body 5 to a rear surface 5*c* of the hull body 5, and is open to the rear at the rear surface 5*c*. A roof surface of the right recessed portion 18R is an inclined surface that becomes higher toward the rear.

The left recessed portion 18L is arranged at the left of the ridgeline 5*b*. The left recessed portion 18L extends in the front/rear direction, is arranged from a rear end portion of the bottom surface 5*a* of the hull body 5 to the rear surface 5*c* of the hull body 5, and is open to the rear at the rear surface 5*c*. A roof surface of the left recessed portion 18L is an inclined surface that becomes higher toward the rear.

Overall Arrangement of the Right Jet Propulsion Device 3R

Figure 6:
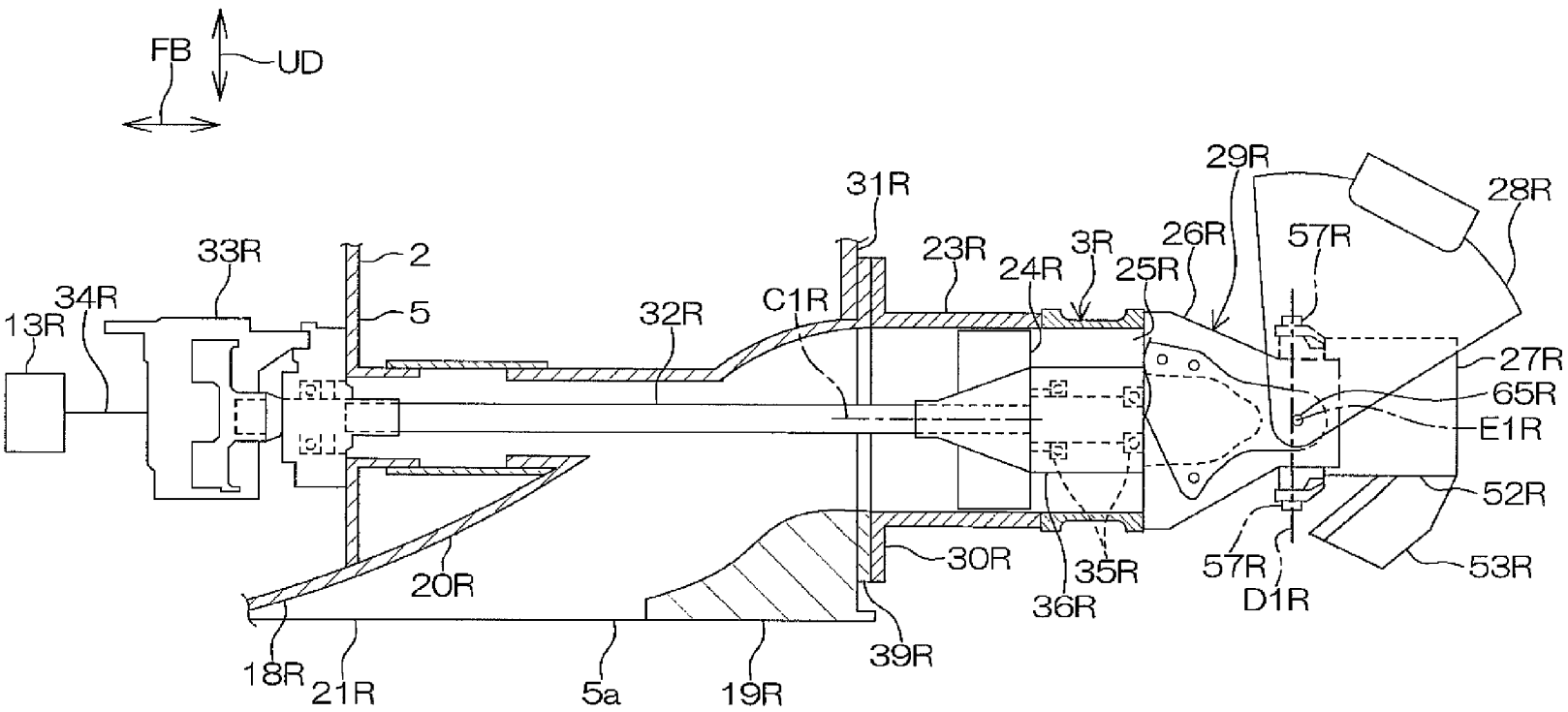
FIG. 6 is a sectional view of principal portions peripheral to the right jet propulsion device as viewed from a left side.

FIG. 6 is a sectional view of principal portions peripheral to the right jet propulsion device 3R as viewed from the left side. A right plate member 19R is attached from below to a rear end portion of the right recessed portion 18R. The right plate member 19R closes the rear end portion of the right recessed portion 18R from below. A right intake duct 20R is formed by the right recessed portion 18R and the right plate member 19R.

A right intake 21R, arranged to be opened to the bottom surface 5*a* of the hull body 5, is arranged at a front end of the right intake duct 20R. The right intake duct 20R guides water, sucked in from the right intake 21R, to a right jet nozzle 26R. An unillustrated grid member is attached to the right intake 21R. The grid member prevents debris and other foreign matter from entering into the right intake duct 20R.

The right jet propulsion device 3R is disposed to the rear of the right intake 21R. The right intake 21R and the right jet propulsion device 3R are aligned straightly in the front/rear direction.

The right jet propulsion device 3R includes a right jetting unit 29R, a right deflector 27R, and a right bucket 28R. The right jetting unit 29R sucks in water from the hull bottom of the hull 2 and jets the water toward the rear of the hull 2. The right jetting unit 29R includes a right housing 23R, a right impeller 24R, a right stator vane 25R, and the right jet nozzle 26R. The right impeller 24R and the right stator vane 25R are disposed inside the right housing 23R.

The right housing 23R is arranged to have a tubular shape. An annular flange 30R is provided at a front end of the right housing 23R. The annular flange 30R opposes a right transom surface 31R of the hull body 5 across an annular right transom plate 39R. The annular flange 30R is fixed to the right transom surface 31R preferably via bolts, for example, or other fastening members (not shown). The right intake duct 20R opens to the right transom surface 31R. A space inside the right housing 23R is in communication with a space inside the right intake duct 20R.

The right impeller 24R sucks in water from the right intake duct 20R and delivers the water to the right jet nozzle 26R. The right impeller 24R includes a plurality of blades disposed about its rotational axis line C1R. The right impeller 24R is fixed to an intermediate portion of a right driveshaft 32R.

The right driveshaft 32R extends in the front/rear direction and transmits an output of the right engine 13R to the right impeller 24R. The right driveshaft 32R is arranged inside the right housing 23R and the right intake duct 20R.

A front end portion of the right driveshaft 32R is coupled via a coupling 33R to a crankshaft 34R of the right engine 13R in a power transmittable manner. A rear end portion of the right driveshaft 32R is inserted through an interior of a right inner cylinder 36R and is rotatably supported in the right inner cylinder 36R via right bearings 35R and 35R.

The right stator vane 25R is a straightening vane that straightens a water flow generated by rotation of the right impeller 24R. The right stator vane 25R is arranged to the rear of the right impeller 24R. The right stator vane 25R includes a plurality of blades that are fixed inside the right housing 23R. Outer peripheral portions of the respective blades are fixed to the right housing 23R and inner peripheral portions are fixed to the right inner cylinder 36R.

The right jet nozzle 26R is a tubular member through which the water flow generated by rotation of the right impeller 24R passes and is fixed to a rear end portion of the right housing 23R. An intermediate portion in an axial direction of the right jet nozzle 26R is arranged to have a truncated conical shape and is made smaller in inner diameter toward the rear. A rear end portion of the right jet nozzle 26R is arranged to have a cylindrical shape with a substantially fixed inner diameter. According to this arrangement, the right jet nozzle 26R accelerates and jets the water flow generated by the right impeller 24R toward the rear.

The right deflector 27R is arranged to the rear of the right jet nozzle 26R and is arranged to change a jetting direction of the water jetted from the right jet nozzle 26R of the right jetting unit 29R. The right deflector 27R is arranged to have a hollow shape and jets the water, jetted from the right jet nozzle 26R, toward the rear or the front of the hull 2. The right deflector 27R includes a forward drive jet port 52R opened toward the rear, and a reverse drive jet port 53R opened toward the front.

The right deflector 27R is supported on the right jet nozzle 26R preferably via bolts 57R, for example. The bolts 57R are arranged above and below the right jet nozzle 26R along a right/left rotational axis line D1R that extends in the up/down direction UD. The right deflector 27R is thus rotatable to the right and the left about the right/left rotational axis line D1R with respect to the right jet nozzle 26R. The direction of flow of the water jetted to the right deflector 27R can be changed thereby.

The right bucket 28R is arranged to block the forward drive jet port 53R of the right deflector 27R when reverse drive of the water jet propulsion watercraft 1 is to be performed. The right bucket 28R is disposed adjacent the right deflector 27R.

More specifically, the right bucket 28R is supported on the right jet nozzle 26R preferably via bolts 65R, for example. The bolts 65R are arranged at the right and the left of the right jet nozzle 26R along an up/down rotational axis line E1R extending in the right/left direction RL (only the left bolt 65R is shown in FIG. 6). The right bucket 28R can rotate up and down about the up/down rotational axis line E1R with respect to the right jet nozzle 26R. The right bucket 28R is supported on the right jet nozzle 26R independently of the right deflector 27R and can be displaced independently of the right deflector 27R. The right bucket 28R is supported on the hull body 5 of the hull 2 via the right jet nozzle 26R, etc.

The right bucket 28R is arranged to be able to rotate up and down between a forward drive position and a reverse drive position. The forward drive position is the position at which the right bucket 28R is retreated upward relative to the forward drive jet port 52R of the right deflector 27R. The forward drive position is illustrated in FIG. 6. On the other hand, the reverse drive position is the position at which the right bucket 28R opposes the forward drive jet port 52R of the right deflector 27R. At the reverse drive position, the water flow is jetted toward the front from the reverse drive jet port 53R because the right bucket 28R blocks the forward drive jet port 52R.

As shown in FIG. 5, in the right jet propulsion device 3R, a portion to the rear of the right jet nozzle 26R protrudes to the rear of the right recessed portion 18R and is disposed below the rear deck 4*a*.

Overall Arrangement of the Left Jet Propulsion Device 3L

Figure 7:
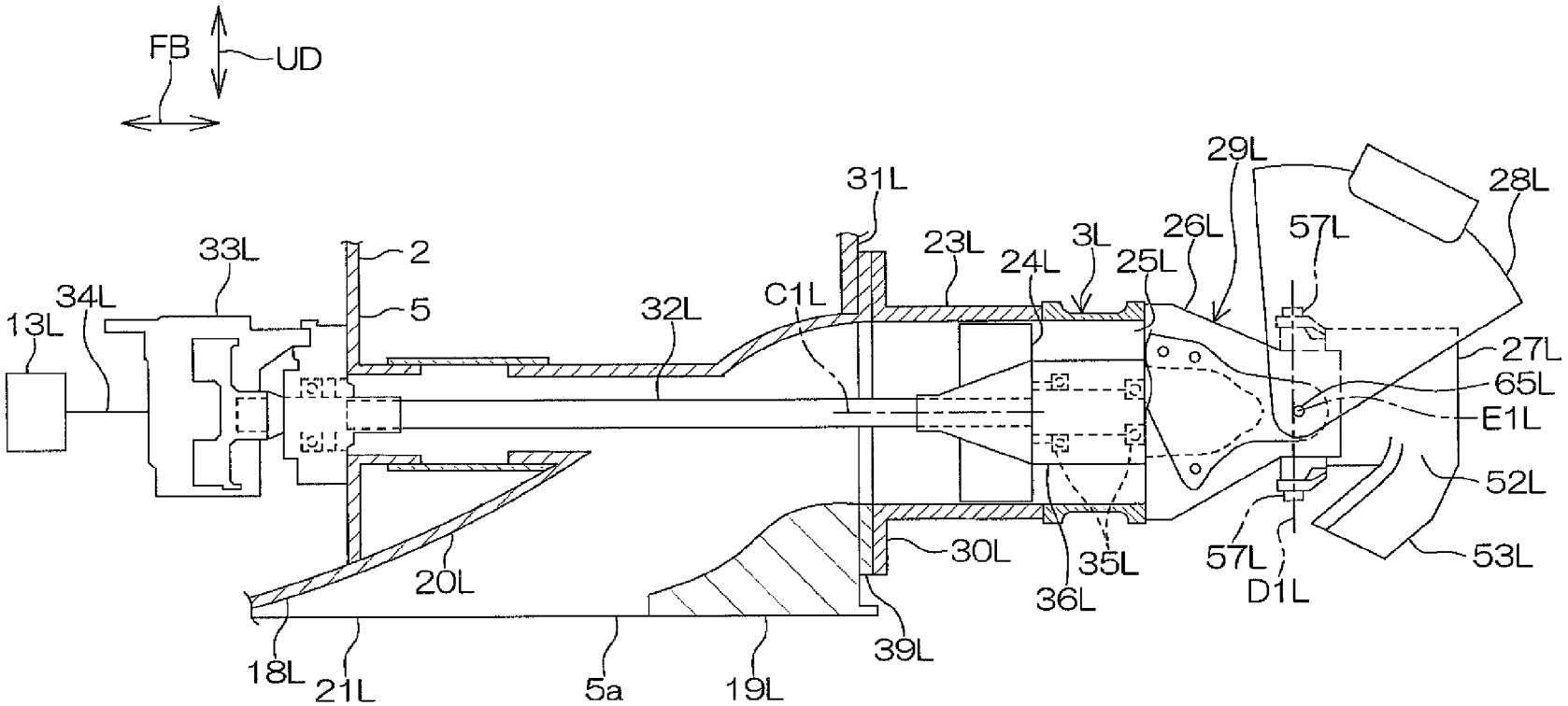
FIG. 7 is a sectional view of principal portions peripheral to the left jet propulsion device as viewed from the left side.

FIG. 7 is a sectional view of principal portions peripheral to the left jet propulsion device 3L as viewed from the left side. A left plate member 19L is attached from below to a rear end portion of the left recessed portion 18L. The left plate member 19L closes the rear end portion of the left recessed portion 18L from below. A left intake duct 20L is arranged by the left recessed portion 18L and the left plate member 19L.

A left intake 21L, arranged to be opened to the bottom surface 5*a* of the hull body 5, is arranged at a front end of the left intake duct 20L. The left intake duct 20L guides water, sucked in from the left intake 21L, to a left jet nozzle 26L. An unillustrated grid member is attached to the left intake 21L. The grid member prevents debris and other foreign matter from entering into the left intake duct 20L.

The left jet propulsion device 3L is disposed to the rear of the left intake 21L. The left intake 21L and the left jet propulsion device 3L are aligned straightly in the front/rear direction.

The left jet propulsion device 3L includes a left jetting unit 29L, a left deflector 27L, and a left bucket 28L. The left jetting unit 29L sucks in water from the hull bottom of the hull 2 and jets the water toward the rear of the hull 2. The left jetting unit 29L includes a left housing 23L, a left impeller 24L, a left stator vane 25L, and the left jet nozzle 26L. The left impeller 24L and the left stator vane 25L are disposed inside the left housing 23L.

The left housing 23L is arranged to have a tubular shape. An annular flange 30L is provided at a front end of the left housing 23L. The annular flange 30L opposes a left transom surface 31L of the hull body 5 across an annular left transom plate 39L. The annular flange 30L is fixed to the left transom surface 31L preferably via bolts or other fastening members (not shown). The left intake duct 20L opens to the left transom surface 31L.

A space inside the left housing 23L is in communication with a space inside the left intake duct 20L.

The left impeller 24L sucks in water from the left intake duct 20L and delivers the water to the left jet nozzle 26L. The left impeller 24L includes a plurality of blades disposed about its rotational axis line C1L. The left impeller 24L is fixed to an intermediate portion of a left driveshaft 32L.

The left driveshaft 32L extends in the front/rear direction and transmits an output of the left engine 13L to the left impeller 24. The left driveshaft 32L is arranged inside the left housing 23L and the left intake duct 20L.

A front end portion of the left driveshaft 32L is coupled via a coupling 33L to a crankshaft 34L of the left engine 13L in a power transmittable manner. A rear end portion of the left driveshaft 32L is inserted through an interior of a left inner cylinder 36L and is rotatably supported in the left inner cylinder 36L via left bearings 35L and 35L.

The left stator vane 25L is a straightening vane that straightens a water flow generated by rotation of the left impeller 24L. The left stator vane 25L is arranged to the rear of the left impeller 24L. The left stator vane 25L includes a plurality of blades that are fixed inside the left housing 23L. Outer peripheral portions of the respective blades are fixed to the left housing 23L and inner peripheral portions are fixed to the left inner cylinder 36L.

The left jet nozzle 26L is a tubular member through which the water flow generated by rotation of the left impeller 24L passes and is fixed to a rear end portion of the left housing 23L. An intermediate portion in an axial direction of the left jet nozzle 26L is arranged to have a truncated conical shape and is made smaller in inner diameter toward the rear. A rear end portion of the left jet nozzle 26L is arranged to have a cylindrical shape with a substantially fixed inner diameter. According to this arrangement, the left jet nozzle 26L accelerates and jets the water flow generated by the left impeller 24L toward the rear.

The left deflector 27L is arranged to the rear of the left jet nozzle 26L and is arranged to change a jetting direction of the water jetted from the left jet nozzle 26L of the left jetting unit 29L. The left deflector 27L is arranged to have a hollow shape and jets the water, jetted from the left jet nozzle 26L, toward the rear or the front of the hull 2. The left deflector 27L includes a forward drive jet port 52L opened toward the rear, and a reverse drive jet port 53L opened toward the front.

The left deflector 27L is supported on the left jet nozzle 26L preferably via bolts 57L, for example. The bolts 57L are arranged above and below the left jet nozzle 26L along a right/left rotational axis line D1L that extends in the up/down direction UD. The left deflector 27L is thus rotatable to the right and the left about the right/left rotational axis line D1L with respect to the left jet nozzle 26L. The direction of flow of the water jetted to the left deflector 27L can be changed thereby.

The left bucket 28L is arranged to block the forward drive jet port 53L of the left deflector 27L when reverse drive of the water jet propulsion watercraft 1 is to be performed. The left bucket 28L is disposed adjacent the left deflector 27L.

More specifically, the left bucket 28L is supported on the left jet nozzle 26L preferably via bolts 65L, for example. The bolts 65L are arranged at the right and the left of the left jet nozzle 26L along an up/down rotational axis line E1R extending in the right/left direction RL (only the left bolt 65L is shown in FIG. 7). The left bucket 28L can rotate up and down about the up/down rotational axis line E1L with respect to the left jet nozzle 26L. The left bucket 28L is supported on the left jet nozzle 26L independently of the left deflector 27L and can be displaced independently of the left deflector 27L. The left bucket 28L is supported on the hull body 5 of the hull 2 via the left jet nozzle 26L, etc.

The left bucket 28L is arranged to rotate up and down between a forward drive position and a reverse drive position. The forward drive position is the position at which the left bucket 28L is retreated upward relative to the forward drive jet port 52L of the left deflector 27L. The forward drive position is illustrated in FIG. 7. On the other hand, the reverse drive position is the position at which the left bucket 28L opposes the forward drive jet port 52L of the left deflector 27L. At the reverse drive position, the water flow is jetted toward the front from the reverse drive jet port 53L because the left bucket 28L blocks the forward drive jet port 52L.

As shown in FIG. 5, in the left jet propulsion device 3L, a portion to the rear of the left jet nozzle 26L protrudes to the rear of the left recessed portion 18L and is disposed below the rear deck 4*a*.

Figure 8:
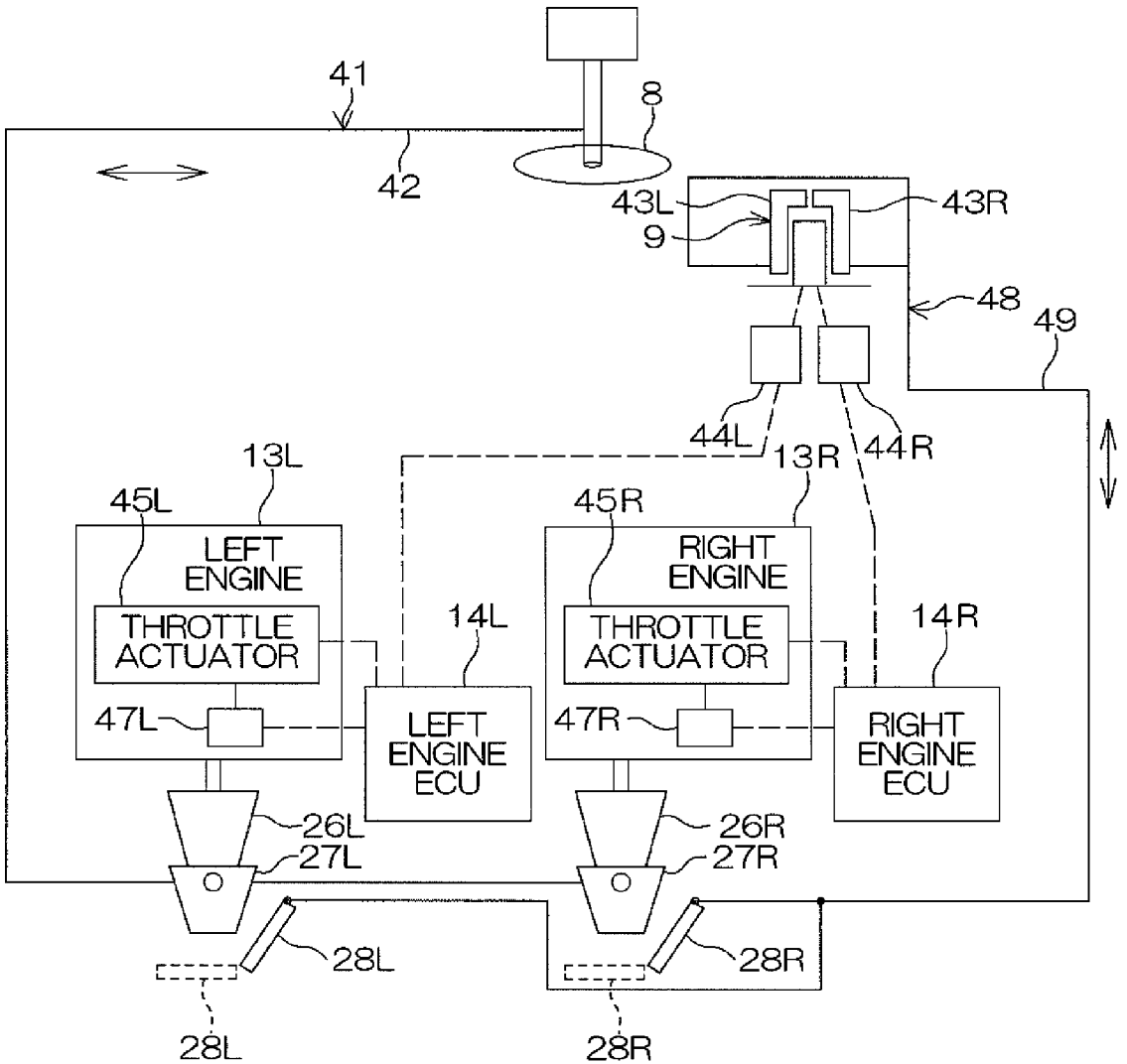
FIG. 8 is a schematic view of an arrangement of principal portions of the water jet propulsion watercraft.

FIG. 8 is a schematic view of an arrangement of principal portions of the water jet propulsion watercraft 1. The water jet propulsion watercraft 1 includes a nozzle interlocking mechanism 41 that interlockingly rotates the right deflector 27R and the left deflector 27L to the right and left. The nozzle interlocking mechanism 41 includes the steering wheel 8 and a steering cable 42.

One end of the steering cable 42 is connected to the steering wheel 8. The steering cable 42 is, for example, a push-pull type cable and is pushed and pulled by rotational operation of the steering wheel 8. The other end of the steering cable 42 is branched in two. These other ends are respectively connected to the right deflector 27R and the left deflector 27L.

A rotational force of the steering wheel 8 is transmitted to the right deflector 27R and the left deflector 27L via the steering cable 42. The right deflector 27R and the left deflector 27L are thereby respectively rotated interlockingly to the right and the left.

The throttle/shift lever 9 includes a right lever 43R and a left lever 43L. The levers 43R and 43L are arranged to enable rotational operations in the front/rear direction about respective lower ends of the levers 43R and 43L as centers of rotation. A rotational operation position of the right lever 43R is detected by a right accelerator position sensor 44R. Likewise, a rotational operation position of the left lever 43L is detected by a left accelerator position sensor 44L. The accelerator position sensors 44R and 44L are electrically connected to the right engine ECU 14R and the left engine ECU 14L and respectively output signals corresponding to the positions of the levers 43R and 43L.

The right engine ECU 14R is electrically connected to a right throttle actuator 45R, provided in the right engine 13R, and controls driving of the right throttle actuator 45R. An opening degree of a throttle valve of the right engine 13R is thereby controlled and consequently, the output of the right engine 13R is controlled. The opening degree of the throttle valve of the right engine 13R is detected by a right throttle position sensor 47R and a detection signal thereof is input into the right engine ECU 14R. Likewise, the left engine ECU 14L is electrically connected to a left throttle actuator 45L, provided in the left engine 13L, and controls driving of the left throttle actuator 45L. An opening degree of a throttle valve of the left engine 13L is thereby controlled and consequently, the output of the left engine 13L is controlled. The opening degree of the throttle valve of the left engine 13L is detected by a left throttle position sensor 47L and a detection signal thereof is input into the left engine ECU 14L.

The water jet propulsion watercraft 1 also includes a bucket interlocking mechanism 48 that interlockingly displaces the right bucket 28R and the left bucket 28L between the forward drive positions and the reverse drive positions.

The bucket interlocking mechanism 48 includes a right lever 43R, a left lever 43L, and an operation cable 49. The operation cable 49 is, for example, a push-pull type cable and is pushed and pulled by operations of the levers 43R and 43L. Of the operation cable 49, a tip at the throttle/shift lever 9 side is branched in two and connected to the right lever 43R and the left lever 43L. Of the operation cable 49, a tip at the side of the respective buckets 28R and 28L is branched in two and connected to the right bucket 28R and the left bucket 28L, respectively.

When, for example, the right lever 43R and the left lever 43L are respectively at predetermined neutral positions, the right engine 13R and the left engine 13L are in idling states.

When the right lever 43R and the left lever 43L are respectively tilted forward relative to the neutral positions, the output signals from the right throttle position sensor 47R and the left throttle position sensor 47L change. When the right lever 43R and the left lever 43L are respectively tilted forward by not less than a predetermined amount relative to the neutral positions, control for increasing the output of the right engine 13R and the output of the left engine 13L is performed.

Likewise, when the right lever 43R and the left lever 43L are respectively tilted rearward relative to the neutral positions, the output signals from the right throttle position sensor 47R and the left throttle position sensor 47L change. When the right lever 43R and the left lever 43L are respectively tilted rearward by not less than a predetermined amount relative to the neutral positions, control for increasing the output of the right engine 13R and the output of the left engine 13L is performed.

Further, when the right lever 43R and the left lever 43L are respectively tilted rearward by not less than the predetermined amount relative to the neutral positions, operation forces of the right lever 43R and the left lever 43L are arranged to be transmitted to the right bucket 28R and the left bucket 28L via the operation cable 49. The right bucket 28R is thereby displaced from the forward drive position to the reverse drive position at the rear of the right deflector 27R, and the left bucket 28L is displaced from the forward drive position to the reverse drive position at the rear of the left deflector 27L. That is, the right and left buckets 28R and 28L are displaced in an interlocked manner to the reverse drive positions.

In FIG. 8, the right bucket 28R and the left bucket 28L in straight drive positions are indicated by solid lines, and the right bucket 28R and the left bucket 28L in the reverse drive positions are indicated by phantom line.

When the right lever 43R and the left lever 43L are respectively returned so that the tilt amounts from the neutral positions are less than the predetermined amounts, the right bucket 28R retreats from the position at the rear of the right deflector 27R and returns to the forward drive position. Likewise, the left bucket 28L retreats from the position at the rear of the left deflector 27L and returns to the forward drive position. That is, the right and left buckets 28R and 28L return to the forward drive positions in an interlocked manner.

Though unillustrated, the right bucket 28R and the left bucket 28L are respectively provided with return springs that apply elastic forces that guide the buckets to the forward drive positions. By the actions of the return springs, the right bucket 28R and the left bucket 28L return to the forward drive positions.

Figure 9:
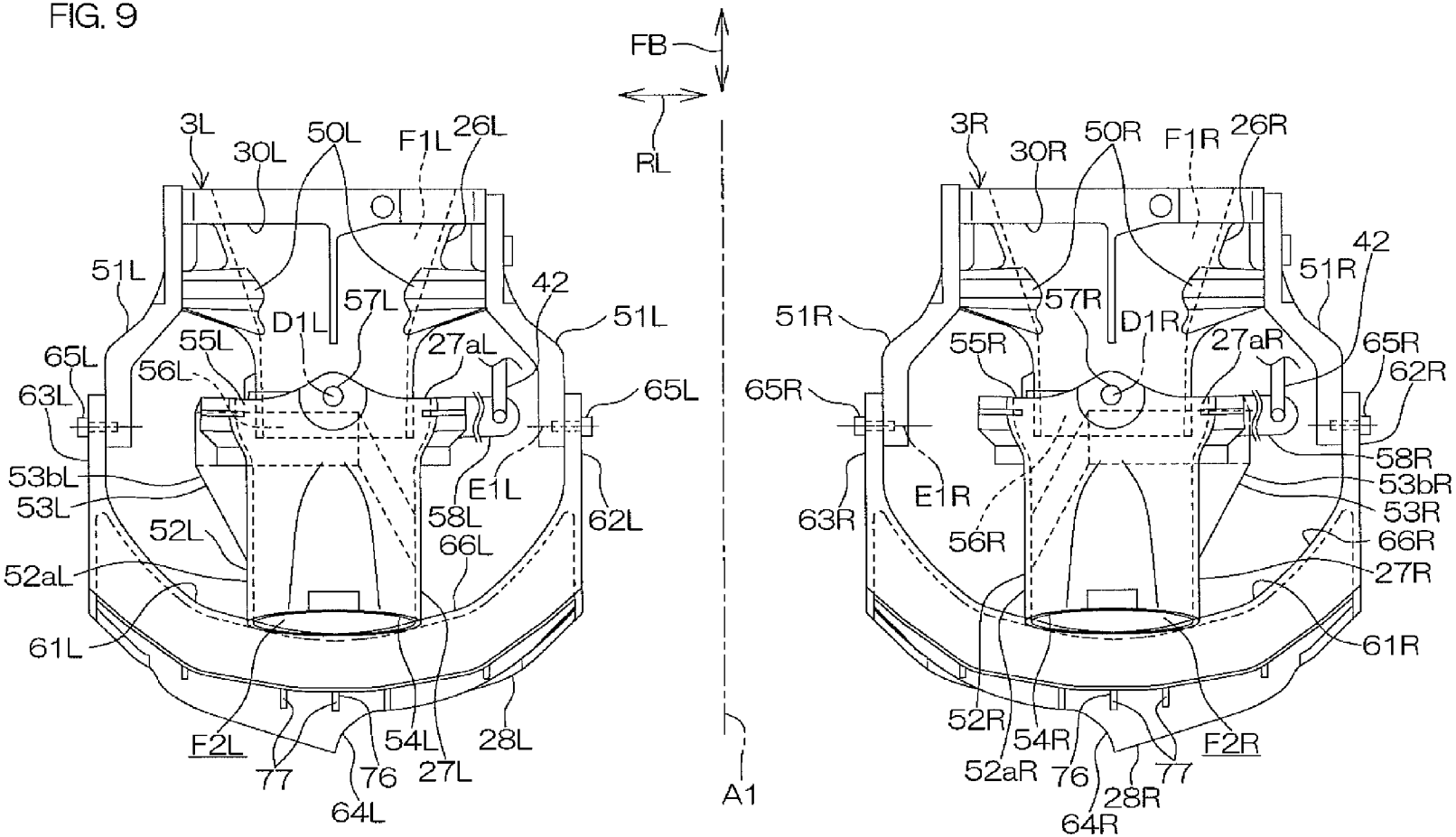
FIG. 9 is a plan view of a periphery of a rear end of the right jet propulsion device and a periphery of a rear end of the left jet propulsion device.
Figure 10:
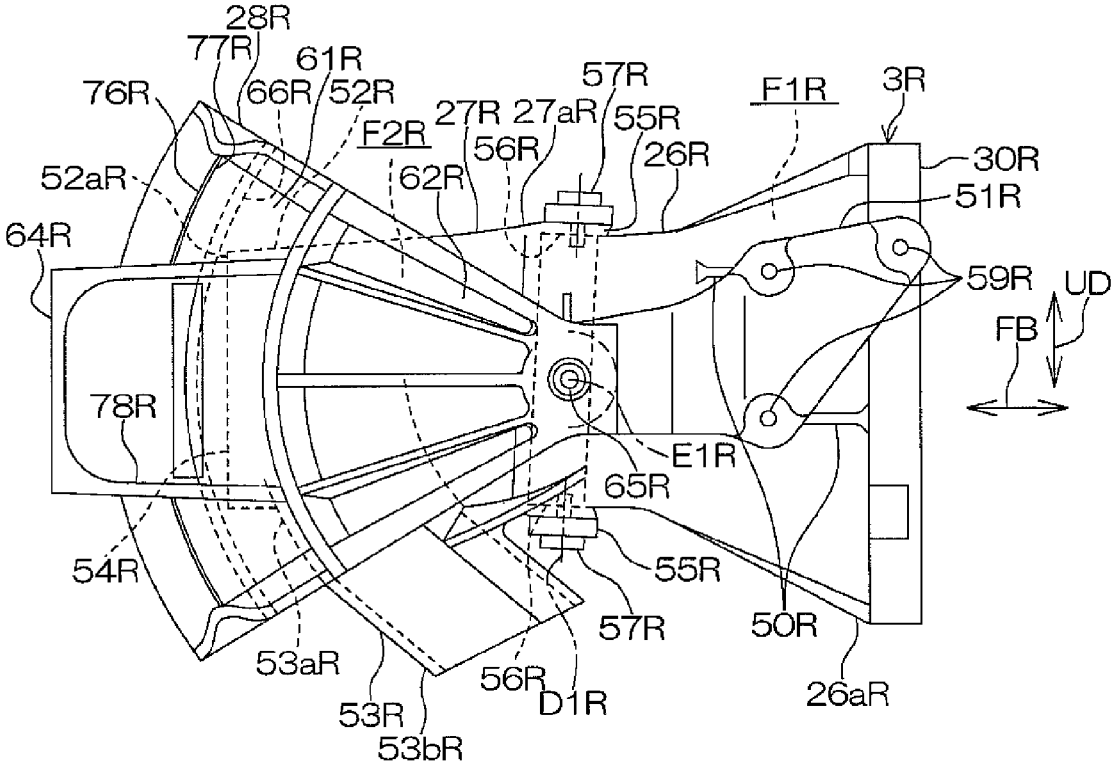
FIG. 10 is a right side view of the periphery of the rear end portion of the right jet propulsion device and shows a state during reverse drive.

Detailed Arrangement of the Right Deflector 27R and the Right Bucket 28R FIG. 9 is a plan view of a periphery of a rear end of the right jet propulsion device 3R and a periphery of a rear end of the left jet propulsion device 3L. In FIG. 9, a state where the right bucket 28R and the left bucket 28L are respectively at the reverse drive positions are shown. FIG. 10 is aright side view of the periphery of the rear end portion of the right jet propulsion device 3R and shows the state where the right bucket 28R is disposed at the reverse drive position.

Referring to FIG. 9 and FIG. 10, the right jet nozzle 26R is arranged substantially to have a truncated conical shape and, from a front end portion to an intermediate portion, the nozzle is preferably has a tubular shape that becomes smaller in outer diameter toward the rear. A rear end portion of the right jet nozzle 26R is arranged to have a cylindrical shape with a substantially fixed outer diameter. A space F1R inside the right jet nozzle 26R extends straightly along the front/rear direction FB.

Two pairs of stay attachment bosses 50R that extend in the right/left direction are provided integrally on an outer circumference of the right jet nozzle 26R. A pair of right and left bucket stays 51R are fixed preferably via bolts 59R, for example, to a flange portion arranged at a front edge portion of the right jet nozzle 26R and to the stay attachment bosses 50R. The bucket stays 51R extend rearward from the stay attachment bosses 50R and rear ends thereof are aligned in the right/left direction RL with a rear end portion of the right jet nozzle 26R.

The right deflector 27R includes the forward drive jet port 52R arranged to perform forward drive of the water jet propulsion watercraft 1 by jetting water rearward and the reverse drive jet port 53R arranged to perform reverse drive of the water jet propulsion watercraft 1 by jetting water forward.

The forward drive jet port 52R is arranged substantially to have a truncated conical shape and preferably has a tubular shape with which an outer diameter and an inner diameter decrease toward the rear. A space F2R inside the forward drive jet port 52R thus decreases in cross-sectional area (cross-sectional area of a section orthogonal to the front/rear direction FB) toward the rear. The space F2R extends straightly along the forward/rear direction FB when the right deflector 27R is at the straight drive position. A front end portion of the forward drive jet port 52R is fitted with a rear end portion of the right jet nozzle 26R. The space F2R inside the forward drive jet port 52R and the space F1R inside the right jet nozzle 26R are thereby put in direct communication. When the right deflector 27R is at the straight drive position, a rear end opening 54R faces directly rearward. The front end portion of the forward drive jet port 52R is larger than the rear end portion of the right jet nozzle 26R and a gap is formed between the two. The front end portion of the forward drive jet port 52R thus surrounds the rear end portion of the right jet nozzle 26R from the outer side.

When the right deflector 27R is at the straight drive position, the water jetted from the right jet nozzle 26R to the right deflector 27R is jetted rearward from the rear end opening 54R of the right deflector 27R without being changed in orientation in the right/left direction.

A pair of upper and lower attachment portions 55R are provided on a front end portion 27*a*R of the right deflector 27R. The pair of upper and lower attachment portions 55R are attached via bolts 57R, for example, to a pair of upper and lower bosses 56R provided at the rear end portion of the right jet nozzle 26R. A central axis line of each bolt 57R coincides with the right/left rotational axis line D1R that extends substantially in the up/down direction UD. The right deflector 27R is thereby enabled to rotate to the right and the left about the right/left rotational axis line D1R.

A cable attachment portion 58R, for attachment of the steering cable 42, is arranged integrally to a right side of a front end of the forward drive jet nozzle 26R. A tip portion of the steering cable 42 is attached to the cable attachment portion 58R via a ball joint or other joint (not shown). By the steering cable 42 being pulled and the tip portion thereof being displaced forward, the right deflector 27R is rotated to the right side. On the tip portion, by the steering cable 42 being pushed and the other end thereof being displaced rearward, the right deflector 27R is rotated to the left side.

Figure 11:
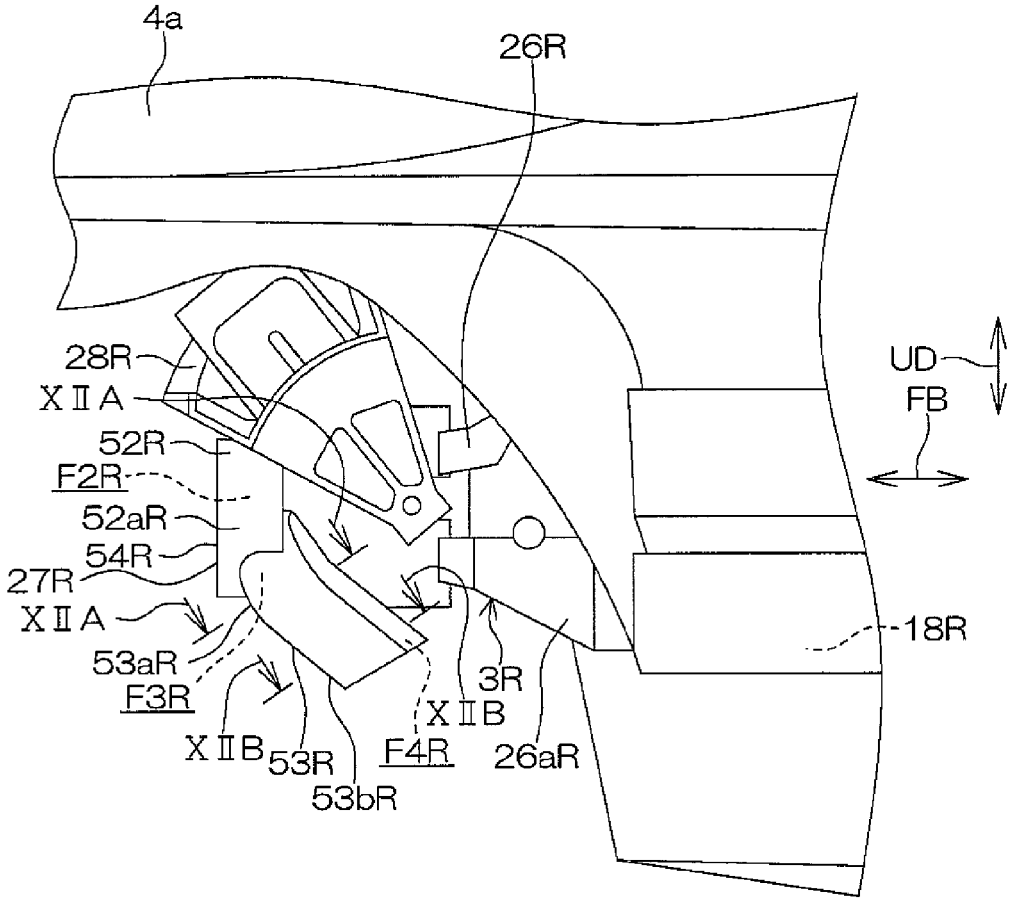
FIG. 11 is a right side view of the periphery of the rear end portion of the right jet propulsion device and shows a state during forward drive.

FIG. 11 is a right side view of the periphery of the rear end portion of the right jet propulsion device 3R and shows a state where the right bucket 28R is disposed at the forward drive position. Referring to FIG. 4 and FIG. 11, the reverse drive jet port 53R is branched downward from a rear end portion 52*a*R of the forward drive jet port 52R. The reverse drive jet port 53R includes a first portion 53*a*R and a second portion 53*b*R.

The first portion 53*a*R is connected to the rear end portion 52*a*R of the forward drive jet port 52R and extends obliquely downward so that a more forward side thereof is positioned further downward. When the right deflector 27R is at the straight drive position, the first portion 53*a*R is aligned along the front/rear direction FB in plan view. In the right/left direction RL, a center of the first portion 53*a*R substantially coincides with a center of the forward drive jet port 52R.

The second portion 53*b*R is connected to the first portion 53*a*R and extends obliquely downward so that a more forward side thereof is positioned further to the lower right. A lower end of the second portion 53*b*R is substantially matched in up/down direction position with a lower end portion 26*a*R of the right jet nozzle 26R. More specifically, the lower end of the second portion 53*b*R opens at a region not higher than a lower end height of the right jet nozzle 26R. A space inside the forward drive jet port 52R is thereby put in communication with a space below the right deflector 27R via the first portion 53*a*R and the second portion 53*b*R.

Figure 12A:
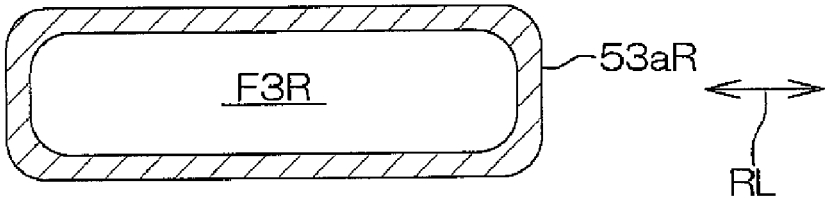
FIG. 12A is a sectional view taken on line XIIA-XIIA of FIG. 11.
Figure 12B:
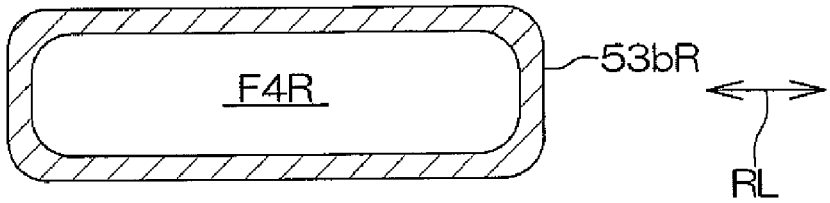
FIG. 12B is a sectional view taken on line XIIB-XIIB of FIG. 11.

As shown in FIG. 12A and FIG. 12B, a space F3R inside the first portion 53*a*R and a space F4R inside the second portion 53*b*R are respectively arranged to have rectangular cross-sectional shapes that are elongated in the right/left direction RL and have substantially the same opening shape. An opening cross-sectional area of the reverse drive jet port 53 is smaller than an opening cross-sectional area of the forward drive jet port 52.

Referring to FIG. 9 and FIG. 10, the right bucket 28R is, for example, an integrally molded member made of synthetic resin. When at the reverse drive position, the right bucket 28R exhibits a U-shaped configuration in plan view and a fan-shaped configuration in right side view.

The right bucket 28R includes a main bucket body 61R, a right extension portion 62R arranged at the right side of the main bucket body 61R, a left extension portion 63R arranged at the left side of the main bucket body 61R, and an auxiliary nozzle 64R arranged to the rear of the main bucket body 61R.

The right extension portion 62R is supported on the right bucket stay 51R via the bolt 65R, for example. Likewise, the left extension portion 63R is supported on the left bucket stay 51R via the bolt 65R. Central axis lines of the respective bolts 65R are coincident with the up/down rotational axis line E1R that extends substantially along the right/left direction RL.

The right bucket 28 is thereby enabled to rotate up and down about the up/down rotational axis line E1R. The up/down rotational axis line E1R and the right/left rotational axis line D1R are substantially matched in position in the front/rear direction FB.

The right extension portion 62R and the left extension portion 63R are arranged to have fan-shaped configurations that become wider in width the further away from the up/down rotational axis line E1R.

The main bucket body 61R is arranged to have an arcuate plate shape having a predetermined thickness in plan view when at the reverse drive position. When the right bucket 28R is at the reverse drive position, the main bucket body 61R blocks the rear end opening 54R of the forward drive jet port 52R from the rear.

Figure 13:
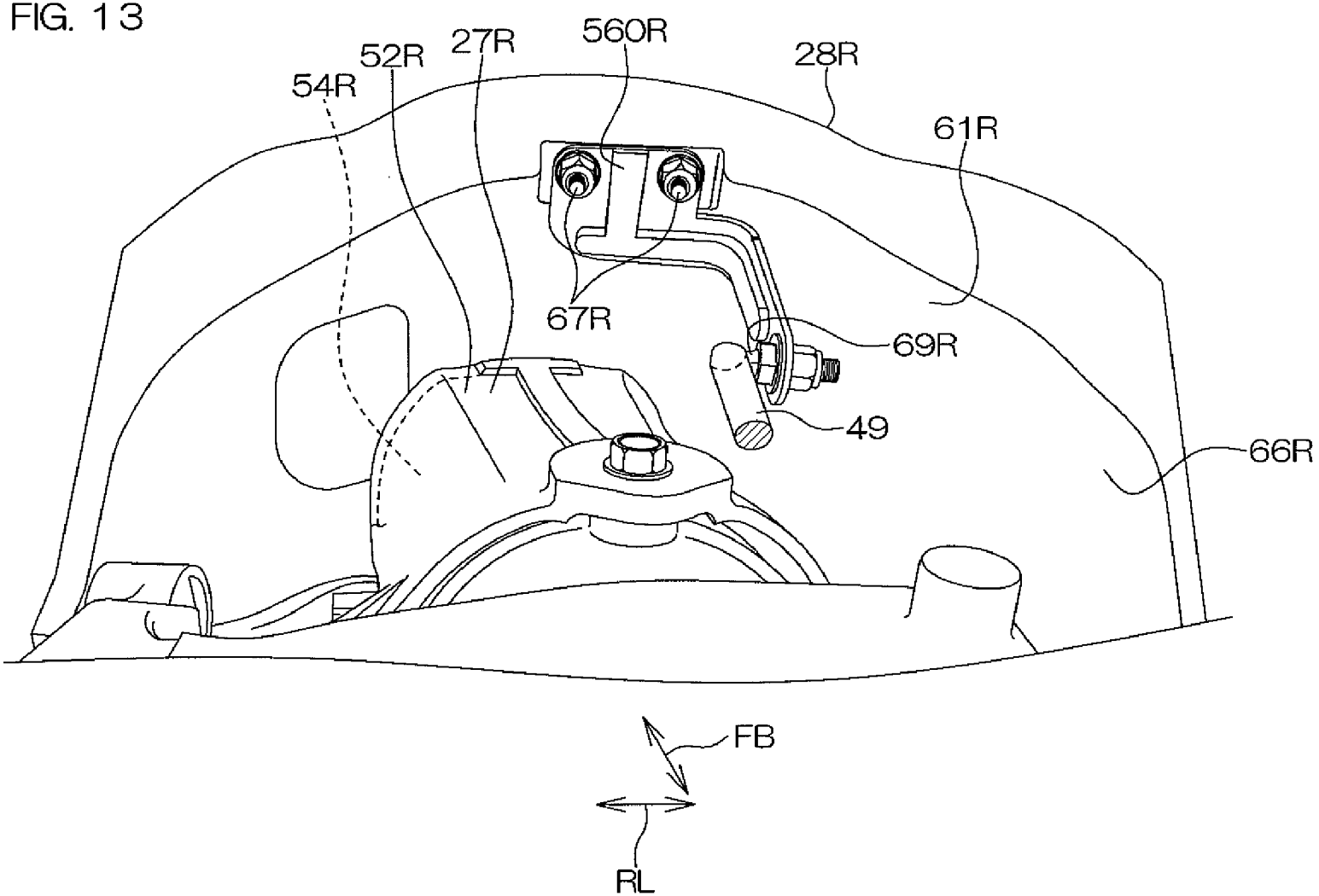
FIG. 13 is a perspective view of a periphery of a right deflector.

FIG. 13 is a perspective view of an arrangement of a periphery of the right deflector 27R. An inner peripheral surface of the main bucket body 61R is a reflecting surface 66R. When the right bucket 28R is at the reverse drive position, the reflecting surface 66R reflects the water jetted from the forward drive jet port 52R toward an inner side of the right deflector 27R. The reflected water is jetted toward the rear from the reverse drive jet port 53R. A rearward reaction force thereby acts on the right bucket 28R and the water jet propulsion watercraft 1 can be driven in reverse. The reflecting surface 66R is arranged to have a smooth, concavely curved surface (partial spherical surface) without undulations and surrounds the right deflector 27R when the right bucket 28R is at the reverse drive position.

A cable attachment portion 560R for attachment of a tip portion of the operation cable 49 is provided at an upper end portion of the main bucket body 61R. The cable attachment portion 560R is, for example, a metal member and is fixed to an inner side surface of the main bucket body 61R preferably via bolts 67R, for example. The cable attachment portion 560R is arranged to have an L-shaped configuration in plan view when the right bucket 28R is at the reverse drive position and extends forward from the main bucket body 61R. A spherical joint or other joint 69R is fixed to a front end portion of the cable attachment portion 560R. The tip portion of the operation cable 49 is connected to the joint 69R.

By the operation cable 49 being pushed rearward and the tip portion thereof being displaced rearward, the right bucket 28R is rotated to the lower side (rear side). The right bucket 28R is thereby displaced from the forward drive position to the reverse drive position and blocks the rear end opening 54R of the forward drive jet port 52R of the right deflector 27R from the rear.

On the other hand, by the operation cable 49 being pulled and the tip portion thereof being displaced forward, the right bucket 28R is rotated from the reverse drive position to the upper side (front side) as shown in FIG. 11. The right bucket 28R is thereby displaced to the forward drive position that is retreated from the rear of the rear end opening 54R of the forward drive jet port 52R of the right deflector 27R.

Figure 14:
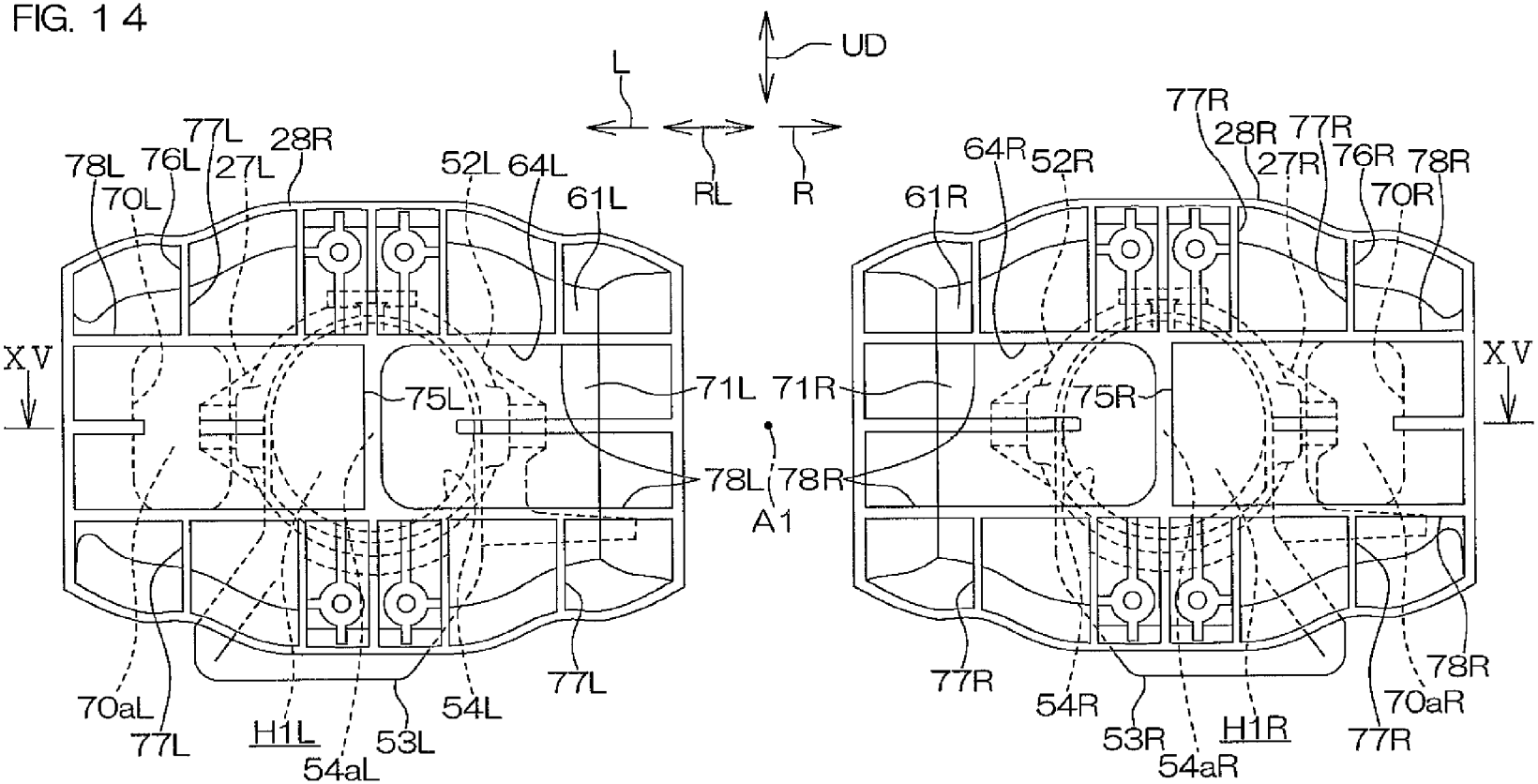
FIG. 14 is a rear view of respective buckets when the buckets are at reverse drive positions.
Figure 15:
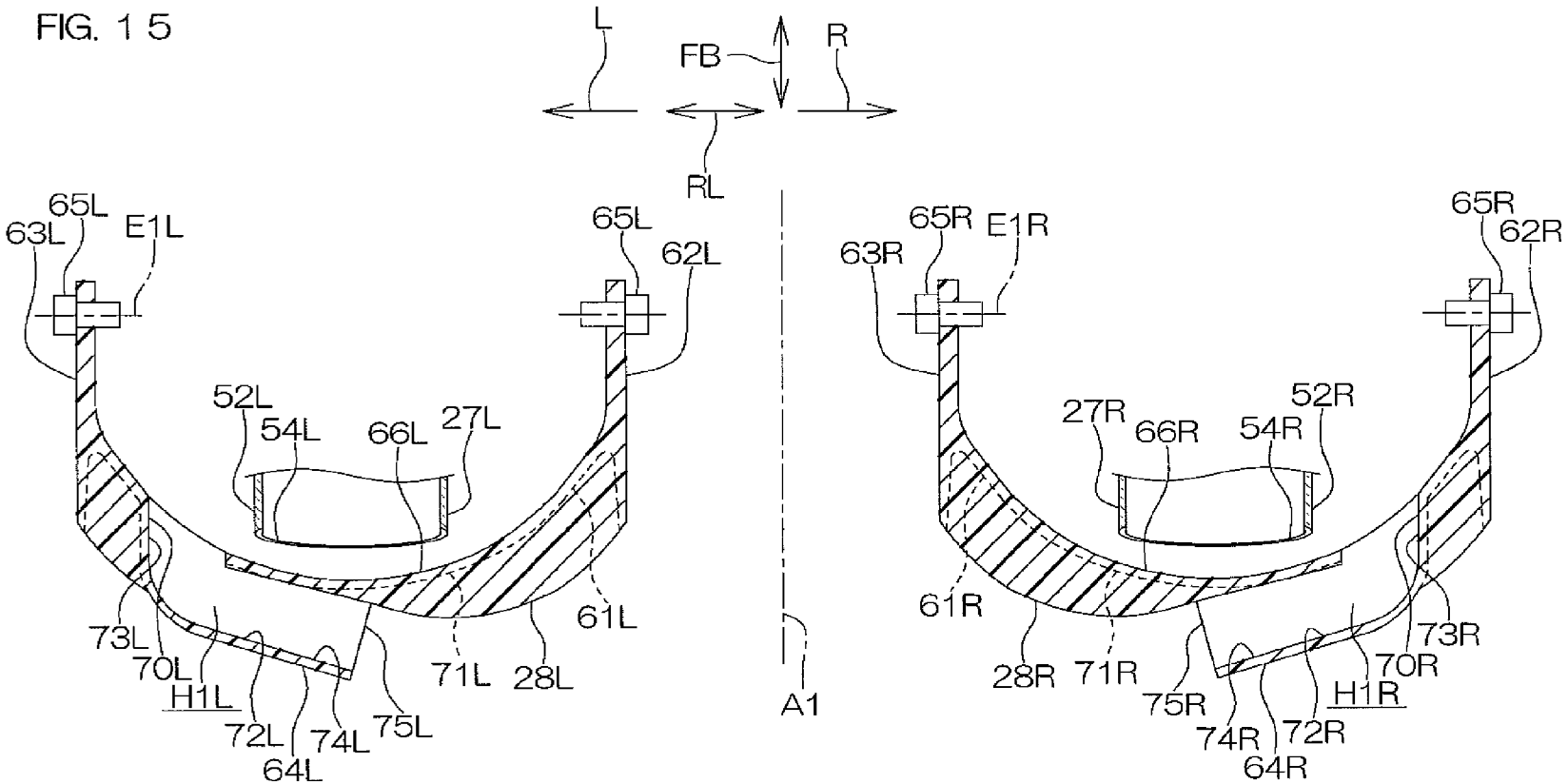
FIG. 15 is a sectional view taken on line XV-XV of FIG. 14.

FIG. 14 is a rear view of the buckets 28R and 28L when the buckets are at the reverse drive positions. FIG. 15 is a sectional view taken on line XV-XV of FIG. 14.

As shown in FIG. 14 and FIG. 15, the auxiliary nozzle 64R has an entrance 70R that opens to the reflecting surface 66R and is arranged to jet water, which has been introduced into the entrance 70R, along the right/left direction RL (left direction L).

The auxiliary nozzle 64R includes the entrance 70R, a tunnel portion 72R, and an exit 75R. The tunnel portion 72R defines a flow path H1R that is in communication with the entrance 70R and runs in the right/left direction RL (left direction L) along an outer surface 71R of the main bucket body 61R.

The entrance 70R is arranged to receive a portion of the water jetted from the forward drive jet port 52R of the right deflector 27R when the right deflector 27R is rotated to the right. The entrance 70R is arranged to have a rectangular or substantially rectangular shape that is vertically long in the up/down direction UD.

A center 70*a*R of the entrance 70R is arranged to be substantially matched in position in the up/down direction UD with a center 54*a*R of the rear end opening 54R of the forward drive jet port 52R when the right bucket 28R is at the reverse drive position. When the right deflector 27R is at the straight drive position, the center 70*a*R of the entrance 70R is arranged to the right side relative to the center 54R of the rear end opening 54R. The entrance 70R is thereby positioned further away from the hull centerline A1 in the right direction R than the forward drive jet port 52R when the right bucket 28R is at the reverse drive position. A length in the up/down direction of the entrance 70R is shorter than a length in up/down direction of the rear end opening 54R.

In a state where the right bucket 28R is arranged at the reverse drive position and the forward drive jet port 52R is arranged at the straight drive position, the entrance 70R does not oppose the forward drive jet port 52R but is positioned away from the forward drive jet port 52R in the right direction R.

The tunnel portion 72R guides the water, received from the entrance 70R, to the rear of the main bucket body 61R and converts the direction of progress of the water to the left direction L.

The tunnel portion 72R includes a curved portion 73R, connected to the entrance 70R and curving more toward the left side the further away from the entrance 70R, and a rectilinear portion 74R, connected to the curved portion 73R and extending straightly or substantially straightly toward the left direction L side. The rectilinear portion 74R extends toward the left direction L (hull centerline A1 side). In a direction of progress of the flow path H1R of the tunnel portion 72R, the flow path H1R is substantially fixed in cross-sectional area and substantially fixed in position in the up/down direction UD.

The exit 75R of the tunnel portion 72R is positioned at a left end of the rectilinear portion 74R and is positioned substantially centrally in the right/left direction of the main bucket body 61R. The exit 75R faces the hull centerline A1 (left direction L) side. The water flow that passes through the tunnel portion 72 is jetted parallel or substantially parallel to the direction of extension of the rectilinear portion 74R. The water from the auxiliary nozzle 64 is thereby jetted toward the hull centerline A1 along the left direction L.

A plurality of ribs 76R are arranged on the outer surface 71R of the main bucket body 61R. The plurality of ribs 76R include a plurality of vertical ribs 77R arranged to extend in the up/down direction UD, and a plurality of lateral ribs 78R arranged to extend in the right/left direction RL. A plurality of the vertical ribs 77R are arranged so as to be spaced apart by intervals in the right/left direction. The lateral ribs 78R preferably include two lateral ribs 78R that extend to the left from the exit 75R of the auxiliary nozzle 64R, for example. These two lateral ribs 78R not only reinforce the main bucket body 61R but also function as water flow guides that guide the water, jetted toward the hull centerline A1 from the exit 75R, toward the hull centerline A1.

Detailed Arrangement of the Left Deflector 27L and the Left Bucket 28L

Figure 16:
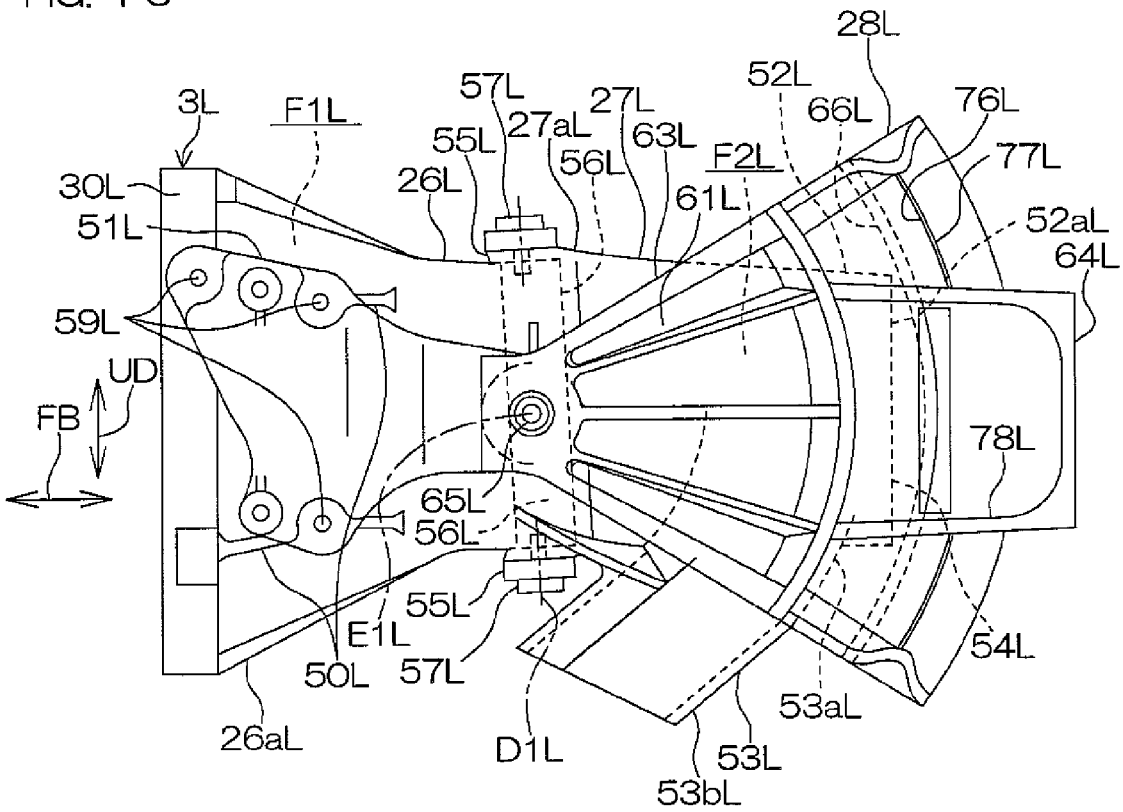
FIG. 16 is a left side view of a periphery of a rear end portion of the left jet propulsion device and shows a state during reverse drive.

FIG. 16 is a left side view of a periphery of a rear end portion of the left jet propulsion device 3L and shows the state where the left bucket 28L is arranged at the reverse drive position. Referring to FIG. 9 and FIG. 16, the left jet nozzle 26L is arranged substantially to a truncated conical shape and, from a front end portion to an intermediate portion, the nozzle preferably has a tubular shape that becomes smaller in outer diameter toward the rear. A rear end portion of the left jet nozzle 26L is arranged to have a cylindrical shape with a substantially fixed outer diameter. A space F1L inside the left jet nozzle 26L extends straightly along the front/rear direction FB.

Two pairs of stay attachment bosses 50L that extend in the right/left direction are provided integrally on an outer circumference of the left jet nozzle 26L. A pair of right and left bucket stays 51L are fixed preferably via bolts 59L, for example, to a flange portion arranged at a front edge portion of the left jet nozzle 26L and to the stay attachment bosses 50L. The bucket stays 51L extend rearward from the stay attachment bosses 50L and rear ends thereof are aligned in the right/left direction RL with a rear end portion of the left jet nozzle 26L.

The left deflector 27L includes the forward drive jet port 52L arranged to perform forward drive of the water jet propulsion watercraft 1 by jetting water rearward and the reverse drive jet port 53L arranged to perform reverse drive of the water jet propulsion watercraft 1 by jetting water forward.

The forward drive jet port 52L is arranged substantially to have a truncated conical shape and a tubular shape with which an outer diameter and an inner diameter decrease toward the rear. A space F2L inside the forward drive jet port 52L thus decreases in cross-sectional area (cross-sectional area of a section perpendicular or substantially perpendicular to the front/rear direction FB) toward the rear. The space F2L extends straightly along the forward/rear direction FB when the left deflector 27L is at the straight drive position. A front end portion of the forward drive jet port 52L is fitted with a rear end portion of the left jet nozzle 26L. The space F2L inside the forward drive jet port 52L and the space F1L inside the left jet nozzle 26L are thereby put in direct communication. When the left deflector 27L is at the straight drive position, a rear end opening 54L faces directly rearward. The front end portion of the forward drive jet port 52L is larger than the rear end portion of the left jet nozzle 26L and a gap is formed between the two. The front end portion of the forward drive jet port 52L thus surrounds the rear end portion of the left jet nozzle 26L from the outer side.

When the left deflector 27L is at the straight drive position, the water jetted from the left jet nozzle 26L to the left deflector 27L is jetted rearward from the rear end opening 54L of the left deflector 27L without being changed in orientation in the right/left direction.

A pair of upper and lower attachment portions 55R are provided on a front end portion 27*a*L of the left deflector 27L. The pair of upper and lower attachment portions 55L are attached preferably via bolts 57L, for example, to a pair of upper and lower bosses 56L provided at the rear end portion of the left jet nozzle 26L. A central axis line of each bolt 57L coincides with the right/left rotational axis line D1L that extends substantially in the up/down direction UD. The left deflector 27L is thereby enabled to rotate to the right and the left about the right/left rotational axis line D1L.

A cable attachment portion 58L, for attachment of the steering cable 42, is provided integrally to a right side of a front end of the forward drive jet nozzle 26L. A tip portion of the steering cable 42 is attached to the cable attachment portion 58L via a ball joint or other joint (not shown). By the steering cable 42 being pulled and the tip portion thereof being displaced forward, the left deflector 27L is rotated to the right side. On the other hand, by the steering cable 42 being pushed and the tip portion thereof being displaced rearward, the left deflector 27L is rotated to the left side.

Figure 17:
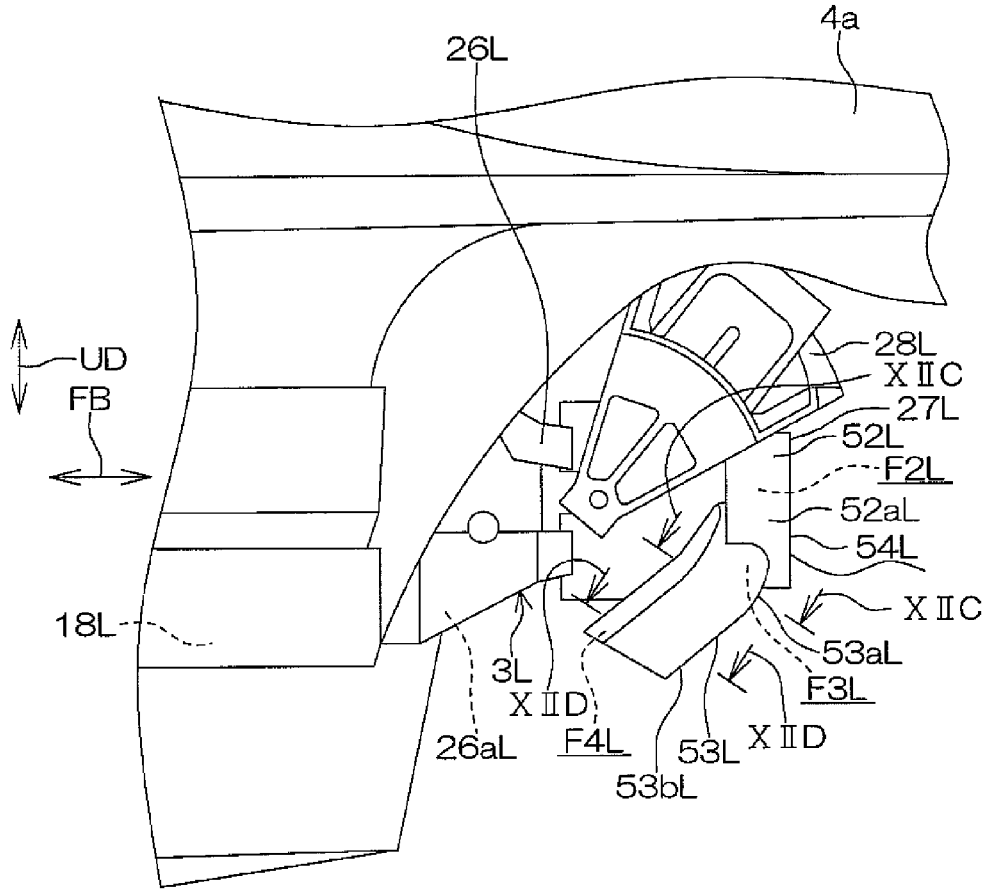
FIG. 17 is a left side view of the periphery of the rear end portion of the left jet propulsion device and shows a state during forward drive.

FIG. 17 is a left side view of the periphery of the rear end portion of the left jet propulsion device 3L and shows a state where the left bucket 28L is arranged at the forward drive position. Referring to FIG. 4 and FIG. 17, the reverse drive jet port 53L is branched downward from a rear end portion 52*a*L of the forward drive jet port 52L. The reverse drive jet port 53L includes a first portion 53*a*L and a second portion 53*b*L.

The first portion 53*a*L is connected to the rear end portion 52*a*L of the forward drive jet port 52L and extends obliquely downward so that a more forward side thereof is positioned further downward. When the right deflector 27R is at the straight drive position, the first portion 53*a*L is aligned along the front/rear direction FB in plan view. In the right/left direction RL, a center of the first portion 53*a*L substantially coincides with a center of the forward drive jet port 52L.

The second portion 53*b*L is connected to the first portion 53*a*L and extends obliquely downward so that a more forward side thereof is positioned further to the lower left. A lower end of the second portion 53*b*L is substantially matched in up/down direction position with a lower end portion 26*a*L of the left jet nozzle 26L. More specifically, the lower end of the second portion 53*b*L opens at a region not higher than a lower end height of the left jet nozzle 26L. A space inside the forward drive jet port 52L is thereby put in communication with a space below the left deflector 27L via inside the first portion 53*a*L and the second portion 53*b*L.

Figure 12C:
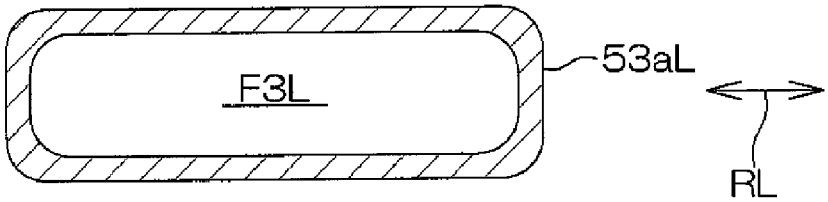
FIG. 12C is a sectional view taken on line XIIC-XIIC of FIG. 17.
Figure 12D:
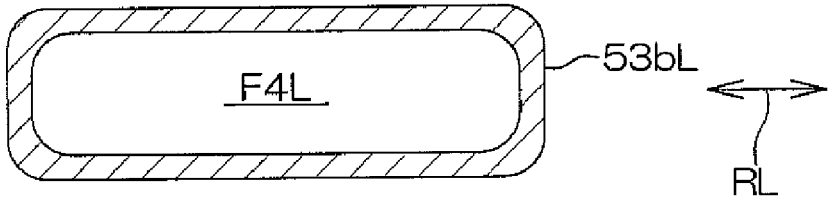
FIG. 12D is a sectional view taken on line XIID-XIID of FIG. 17.

As shown in FIG. 12C and FIG. 12D, a space F3L inside the first portion 53*a*L and a space F4L inside the second portion 53*b*L are respectively arranged to have rectangular cross-sectional shapes that are elongated in the right/left direction RL and have substantially the same opening shape. An opening cross-sectional area of the reverse drive jet port 53L is smaller than an opening cross-sectional area of the forward drive jet port 52L.

Referring to FIG. 9 and FIG. 16, the left bucket 28L is, for example, an integrally molded member made of synthetic resin. When at the reverse drive position, the left bucket 28L exhibits a U-shaped configuration in plan view and a fan-shaped configuration in left side view.

The left bucket 28L includes a main bucket body 61L, a left extension portion 63L arranged at the left side of the main bucket body 61L, a right extension portion 62L arranged at the right side of the main bucket body 61L, and an auxiliary nozzle 64L disposed to the rear of the main bucket body 61L.

The left extension portion 63L is supported on the left bucket stay 51L preferably via the bolt 65L, for example. Likewise, the right extension portion 62L is supported on the right bucket stay 51L preferably via the bolt 65L, for example. Central axis lines of the respective bolts 65L are coincident with the up/down rotational axis line E1L that extends substantially along the right/left direction RL.

The left bucket 28 is thereby enabled to rotate up and down about the up/down rotational axis line E1L. The up/down rotational axis line E1L and the right/left rotational axis line D1L are substantially matched in position in the front/rear direction FB.

The left extension portion 63L and the right extension portion 62L are arranged to have fan-shaped configurations that become wider in width the further away from the up/down rotational axis line E1L.

The main bucket body 61L is arranged to have an arcuate plate shape having a predetermined thickness in plan view when at the reverse drive position. When the left bucket 28L is at the reverse drive position, the main bucket body 61L blocks the rear end opening 54L of the forward drive jet port 52L from the rear.

Figure 18:
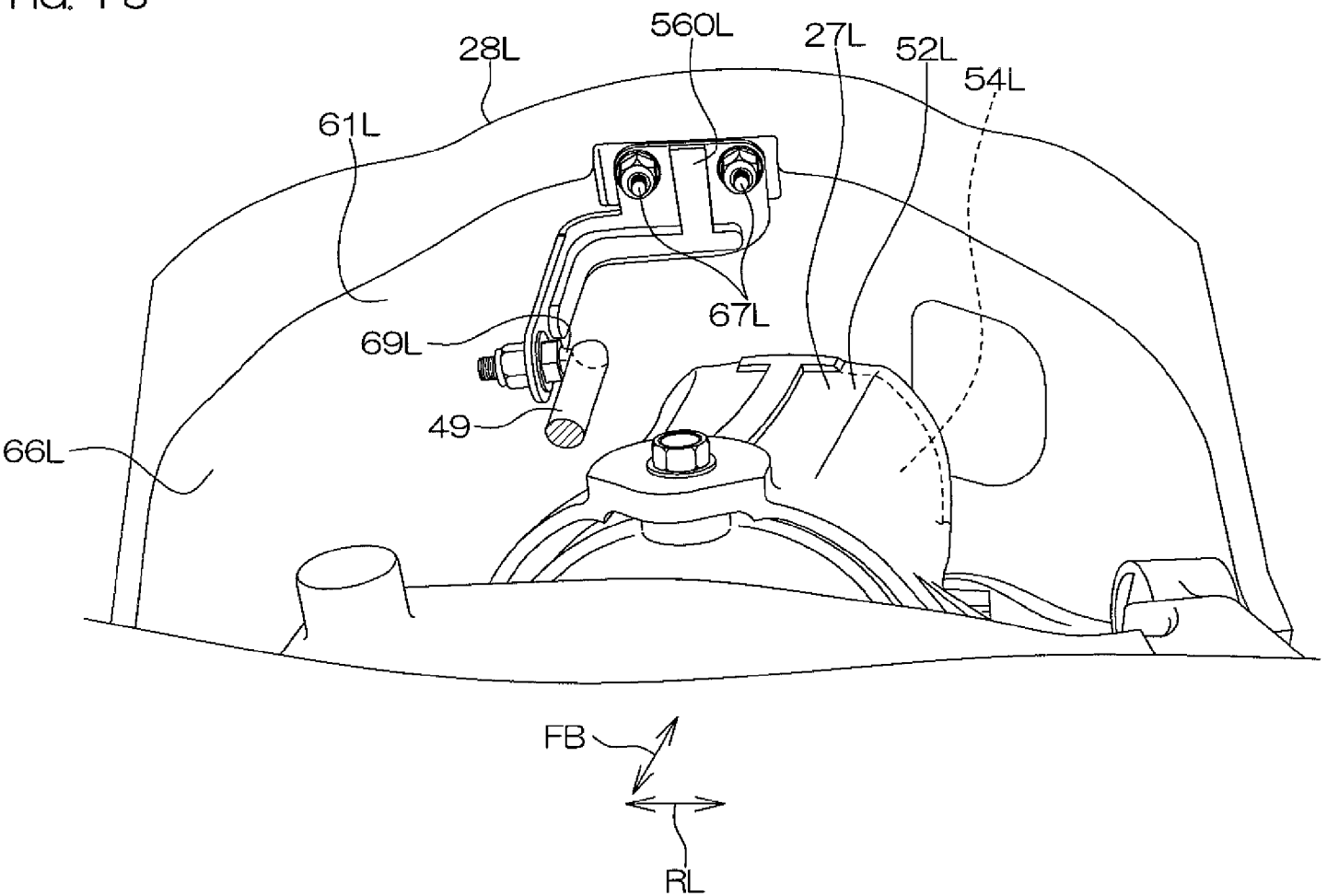
FIG. 18 is a perspective view of a periphery of a left deflector.

FIG. 18 is a perspective view of an arrangement of a periphery of the left deflector 27L. An inner peripheral surface of the main bucket body 61L is a reflecting surface 66L. When the left bucket 28L is at the reverse drive position, the reflecting surface 66L reflects the water jetted from the forward drive jet port 52L toward an inner side of the left deflector 27L. The reflected water is jetted toward the front from the reverse drive jet port 53L. A rearward reaction force thereby acts on the left bucket 28L and reverse drive of the water jet propulsion watercraft 1 can be performed. The reflecting surface 66L is arranged to have a smooth, concavely curved surface (partial spherical surface) without undulations and surrounds the left deflector 27L when the left bucket 28L is at the reverse drive position.

A cable attachment portion 560L for attachment of a tip portion of the operation cable 49 is provided at an upper end portion of the main bucket body 61L. The cable attachment portion 560L is, for example, a metal member and is fixed to an inner side surface of the main bucket body 61L preferably via bolts 67L, for example. The cable attachment portion 560L is arranged to have an L-shaped configuration in plan view when the left bucket 28L is at the reverse drive position and extends forward from the main bucket body 61L. A spherical joint or other joint 69L is fixed to a front end portion of the cable attachment portion 560L. The tip portion of the operation cable 49 is connected to the joint 69L.

By the operation cable 49 being pushed rearward and the tip portion thereof being displaced rearward, the left bucket 28L is rotated to the lower side (rear side). The left bucket 28L is thereby displaced from the forward drive position to the reverse drive position and blocks the rear end opening 54L of the forward drive jet port 52L of the left deflector 27L from the rear.

On the other hand, by the operation cable 49 being pulled and the tip portion thereof being displaced forward the left bucket 28L is rotated from the reverse drive position to the upper side (front side) as shown in FIG. 17. The left bucket 28L is thereby displaced to the forward drive position that is retreated from the rear of the rear end opening 54L of the forward drive jet port 52L of the left deflector 27L.

As shown in FIG. 14 and FIG. 15, the auxiliary nozzle 64L has an entrance 70L that opens to the reflecting surface 66L and is arranged to jet water, which has been introduced into the entrance 70L, along the right/left direction RL (right direction R).

The auxiliary nozzle 64L includes the entrance 70L, a tunnel portion 72L, and an exit 75L. The tunnel portion 72L defines a flow path H1L that is in communication with the entrance 70L and runs in the right/left direction RL (right direction R) along an outer surface 71L of the main bucket body 61L.

The entrance 70L is arranged to receive a portion of the water jetted from the forward drive jet port 52L of the left deflector 27L when the left deflector 27L is rotated to the left. The entrance 70L is arranged to have a rectangular or substantially rectangular shape that is vertically long in the up/down direction UD.

A center 70*a*L of the entrance 70L is arranged to be substantially matched in position in the up/down direction UD with a center 54*a*L of the rear end opening 54L of the forward drive jet port 52L when the left bucket 28L is at the reverse drive position. When the left deflector 27L is at the straight drive position, the center 70*a*L of the entrance 70L is arranged to the left side relative to the center 540L of the rear end opening 54L. The entrance 70L is thereby positioned further away from the hull centerline A1 in the left direction L than the forward drive jet port 52L when the left bucket 28L is at the reverse drive position. A length in the up/down direction of the entrance 70L is shorter than a length in up/down direction of the rear end opening 54L.

In a state where the left bucket 28L is arranged at the reverse drive position and the forward drive jet port 52L is arranged at the straight drive position, the entrance 70L does not oppose the forward drive jet port 52L but is positioned away from the forward drive jet port 52L in the left direction L.

The tunnel portion 72L guides the water, received from the entrance 70L, to the rear of the main bucket body 61L and converts the direction of progress of the water to the right direction R.

The tunnel portion 72L includes a curved portion 73L connected to the entrance 70L and curving more toward the right side the further away from the entrance 70L, and a rectilinear portion 74L, connected to the curved portion 73L and extending straightly or substantially straightly toward the right direction R side. The rectilinear portion 74L extends toward the right direction R (hull centerline A1 side). In a direction of progress of the flow path H1L of the tunnel portion 72L, the flow path H1L is substantially fixed in cross-sectional area and substantially fixed in position in the up/down direction UD.

The exit 75L of the tunnel portion 72L is positioned at a left end of the rectilinear portion 74L and is positioned substantially centrally in the right/left direction of the main bucket body 61L. The exit 75L faces the hull centerline A1 (right direction R) side. The water flow that passes through the tunnel portion 72L is jetted parallel or substantially parallel to the direction of extension of the rectilinear portion 74L. The water from the auxiliary nozzle 64 is thereby jetted toward the hull centerline A1 along the right direction R.

By the auxiliary nozzles 64R and 64L being right/left symmetrical about the hull centerline A1 in plan view, the auxiliary nozzles 64R and 64L jet water in right/left symmetrical directions.

A plurality of ribs 76L are arranged on the outer surface 71L of the main bucket body 61L. The plurality of ribs 76L include a plurality of vertical ribs 77L arranged to extend in the up/down direction UD, and a plurality of lateral ribs 78L arranged to extend in the right/left direction RL. A plurality of the vertical ribs 77L are arranged so as to be spaced apart by intervals in the right/left direction. The lateral ribs 78L include two lateral ribs 78L that extend to the right from the exit 75L of the auxiliary nozzle 64L. These two lateral ribs 78L not only reinforce the main bucket body 61L but also function as water flow guides that guide the water, jetted toward the hull centerline A1 from the exit 75L, toward the hull centerline A1.

Description of Operations of the Water Jet Propulsion Watercraft 1

Next, a forward drive operation and a reverse drive operation of the water jet propulsion watercraft 1 shall now be described. The forward drive operation and the reverse drive operation of the water jet propulsion watercraft 1 shall be described on the basis of a state of the water jet propulsion watercraft 1 in plan view. The description shall be premised on the outputs of the pair of right and left engines 13R and 13L being equal.

Forward Drive Operation of the Water Jet Propulsion Watercraft 1

Figure 19A:
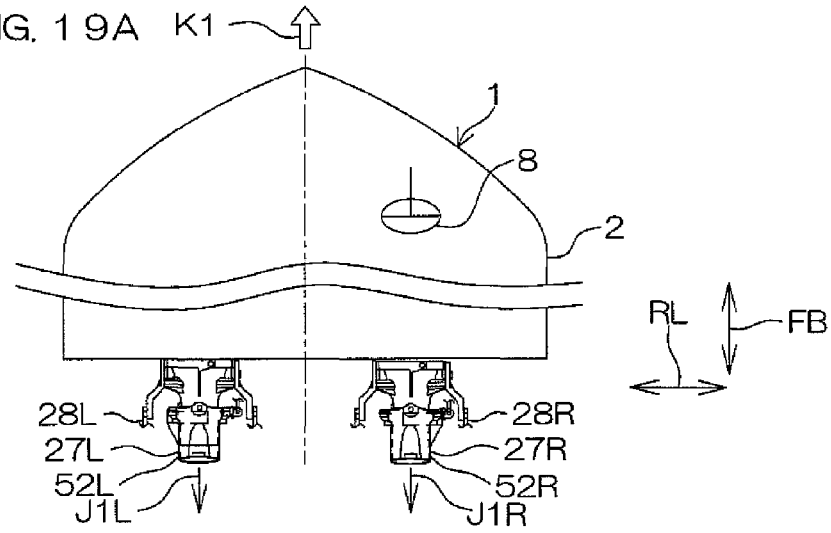
FIG. 19A is schematic plan view of a state where straight forward drive of the water jet propulsion watercraft is being performed.

Referring to FIG. 19A, when forward drive of the water jet propulsion watercraft 1 is being performed, the pair of right and left buckets 28R and 28L are at the forward drive positions and are retreated from the rear of the pair of right and left deflectors 27R and 27L. The water from the forward drive jet ports 52R and 52L of the pair of right and left deflectors 27R and 27L is thereby jetted rearward. Upon receiving the reaction force of the jetted water, the water jet propulsion watercraft 1 is driven forward.

When the steering wheel 8 is at the straight drive position, the pair of right and left deflectors 27R and 27L are at the respective straight drive positions and the forward drive jet ports 52R and 52L thereof face directly rearward. Jetting directions J1R and J1L of the water from the forward jet ports 52R and 52L in this state are parallel or substantially parallel to the front/rear direction FB, and the water jet propulsion watercraft 1 is driven straight forward along a heading direction K1.

Figure 19B:
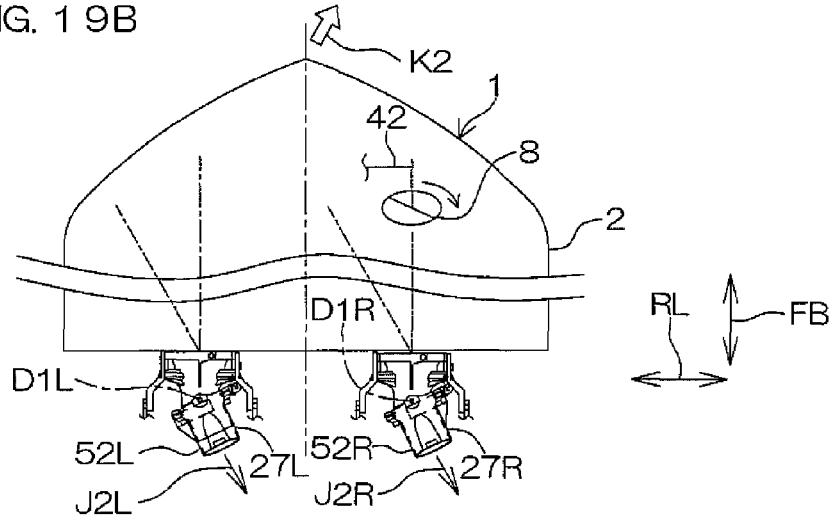
FIG. 19B is schematic plan view of a state where rightward forward drive (forward drive while turning right) of the water jet propulsion watercraft is being performed.

When an operation for steering to the right is performed by the steering wheel 8 being rotated to the right as shown in FIG. 19B, the rotational force is transmitted to the pair of right and left deflectors 27R and 27L via the steering cable 42. The pair of right and left deflectors 27R and 27L are thereby rotated to the right. Jetting directions J2R and J2L of the water from the forward drive jet ports 52R and 52L are thereby set to right rear directions. The stern is thereby pushed toward the left front and the water jet propulsion watercraft 1 driven forward while turning right (clockwise). That is, the watercraft 1 heads in a right front direction along a heading direction K2.

A state of steering maximally to the right is shown in FIG. 19B. In this state, the right deflector 27R is rotated, for example, by about 25 degrees to the right about the right/left rotational axis line D1R from the straight drive position. Likewise, the left deflector 27L is rotated, for example, by about 25 degrees to the right about the right/left rotational axis line D1L from the straight drive position.

Figure 19C:
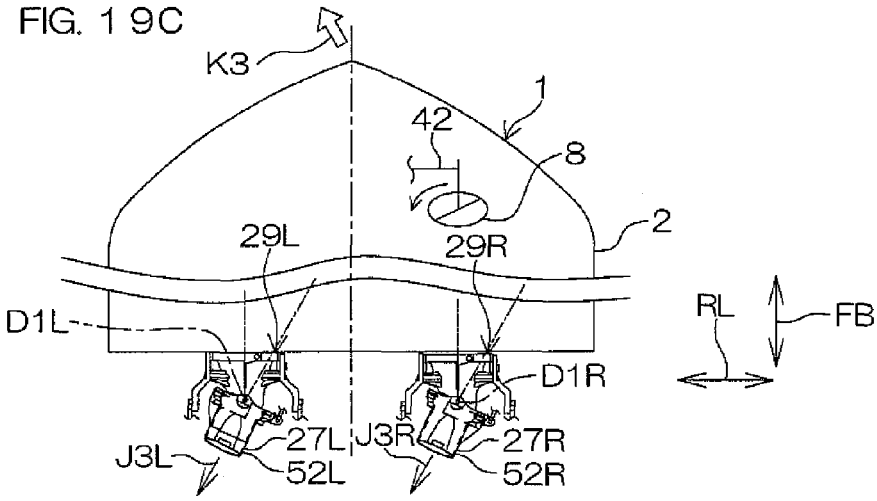
FIG. 19C is schematic plan view of a state where leftward forward drive (forward drive while turning left) of the water jet propulsion watercraft is being performed.

When an operation for steering to the left is performed by the steering wheel 8 being rotated to the left as shown in FIG. 19C, the rotational force is transmitted to the pair of right and left deflectors 27R and 27L via the steering cable 42. The pair of right and left deflectors 27R and 27L are thereby rotated to the left. Jetting directions J3R and J3L of the water from the forward drive jet ports 52R and 52L are thereby set to left rear directions. The stern is thereby pushed toward a right front direction and the water jet propulsion watercraft 1 is driven forward while turning to the left (counterclockwise). That is, the watercraft 1 heads in a left front direction along a heading direction K3.

A state of steering maximally to the left is shown in FIG. 19C. In this state, the right deflector 27R is rotated, for example, by about 25 degrees to the left about the right/left rotational axis line D1R from the straight drive position. Likewise, the left deflector 27L is rotated, for example, by 25 degrees to the left about the right/left rotational axis line D1L from the straight drive position.

As described above, the right deflector 27R can be rotated within a maximum angular range of about 50 degrees to the right and left with respect to the hull 2 (right jetting unit 29R). Likewise, the left deflector 27L can be rotated within a maximum angular range of 50 degrees to the right and left with respect to the hull 2 (left jetting unit 29L).

Reverse Drive Operation of the Water Jet Propulsion Watercraft 1

Figure 20:
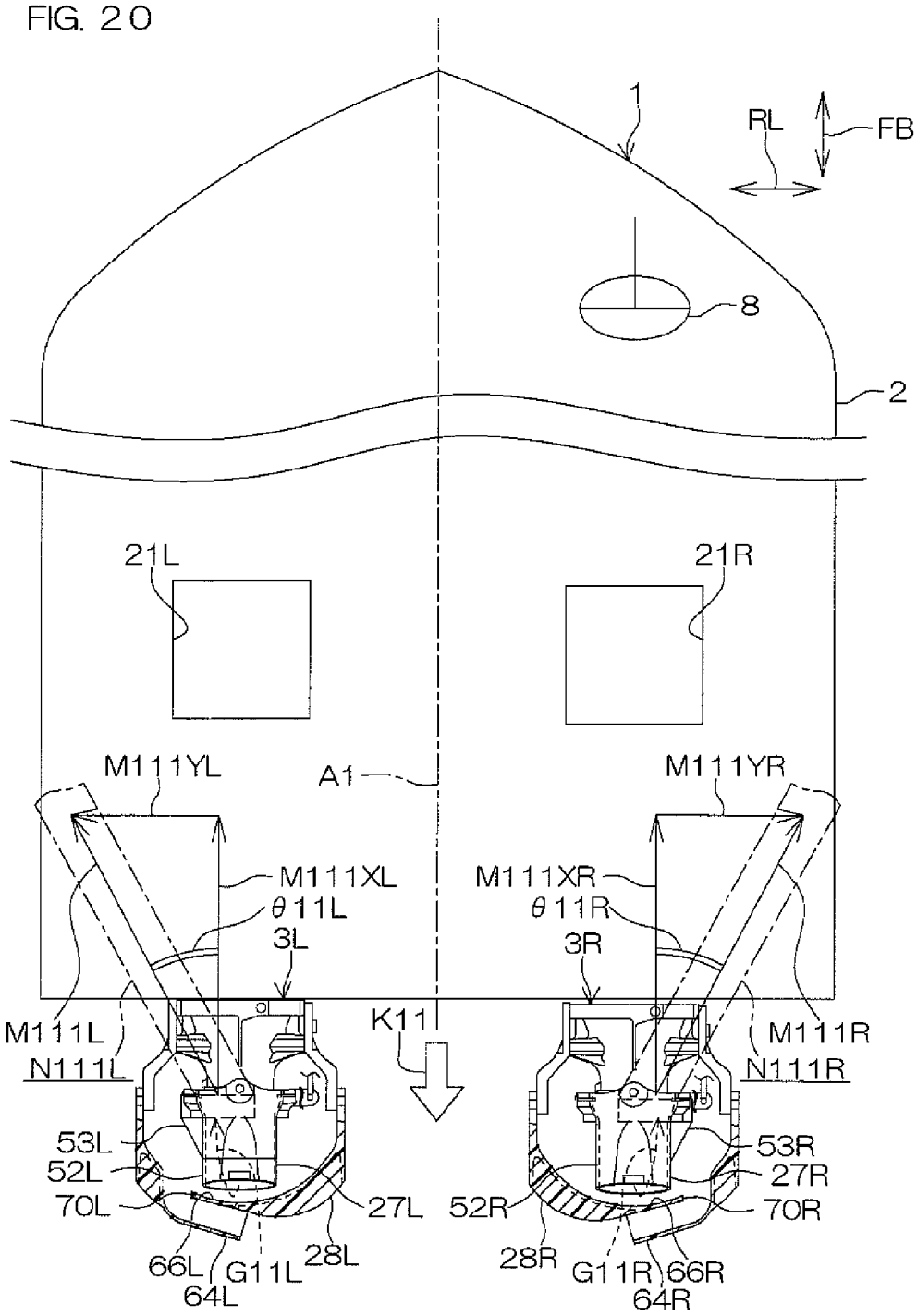
FIG. 20 is schematic plan view of a state where straight reverse drive of the water jet propulsion watercraft is being performed.

Referring to FIG. 20, when straight reverse drive of the water jet propulsion watercraft 1 is being performed, the pair of right and left deflectors 27R and 27L are at the straight drive positions. The pair of right and left buckets 28R and 28L are at the reverse drive positions and are positioned at the rear of the pair of right and left deflectors 27R and 27L. In this state, the forward drive jet ports 52R and 52L of the pair of right and left deflectors 27R and 27L do not oppose the entrances 70R and 70L of the auxiliary nozzles 64R and 64L.

If the forward drive jet port 52R opposes the entrance 70R along the direction of jetting water, this state shall be referred to simply by the expression, "the forward drive jet port 52R opposes the entrance 70R," and if not, the state shall be referred to simply by the expression, "the forward drive jet port 52R does not oppose the entrance 70R."

Likewise, if the forward drive jet port 52L opposes the entrance 70L along the direction of jetting water, this state shall be referred to simply by the expression, "the forward drive jet port 52L opposes the entrance 70L," and if not, the state shall be referred to simply by the expression, "the forward drive jet port 52L does not oppose the entrance 70L."

As indicated by arrows G11R and G11L, the water flows from the forward drive jet ports 52R and 52L are reflected by the reflecting surfaces 66R and 66L and flow out from the reverse drive jet ports 53R and 53L. In this state, the water flows from the forward drive jet ports 52R and 52L do not flow into the auxiliary nozzles 64R and 64L.

A water flow M111R that flows out from the reverse drive jet port 53R is jetted in a right front direction. The water flow M111R is jetted at substantially the same width as the width of the space at the inner side of the reverse drive jet port 53R. A range of the water flow M111R from the reverse drive jet port 53R is, for example, the range indicated by N111R and is shifted away from the right intake 21R.

Likewise, a water flow M111L that flows out from the reverse drive jet port 53L is jetted in a left front direction. The water flow M111L is jetted at substantially the same width as the width of the space at the inner side of the reverse drive jet port 53L. A range of the water flow M111L from the reverse drive jet port 53L is, for example, the range indicated by N111L and is shifted away from the left intake 21L.

The jetting directions of the water flows M111R and M111L from the reverse drive jet ports 53R and 53L are thus directed to the front of the hull 2, are right/left symmetrical across the hull centerline A1, and are non-parallel to the hull centerline A1.

The water flow M111R includes a component M111YR that separates to the right from the hull centerline A1 and a component M111XR that is directed toward the front of the hull 2. An angle θ11R arranged by a direction of the water flow M111R and the hull centerline A1 is approximately 25 degrees and is equal to a maximum value of a rotatable angle of the right deflector 27R from the straight drive position.

The water flow M111L includes a component M111YL that separates to the left from the hull centerline A1 and a component M111XL that is directed toward the front of the hull 2. An angle θ11L arranged by a direction of the water flow M111L and the hull centerline A1 is approximately 25 degrees and is equal to a maximum value of a rotatable angle of the left deflector 27L from the straight drive position.

By the above, the resultant force of the propulsive forces generated by the water flows M111R and M111L is a rearward force that is parallel to the hull centerline A1 of the hull 2 and the hull 2 heads straightly in a rearward heading direction K11.

Figure 21:
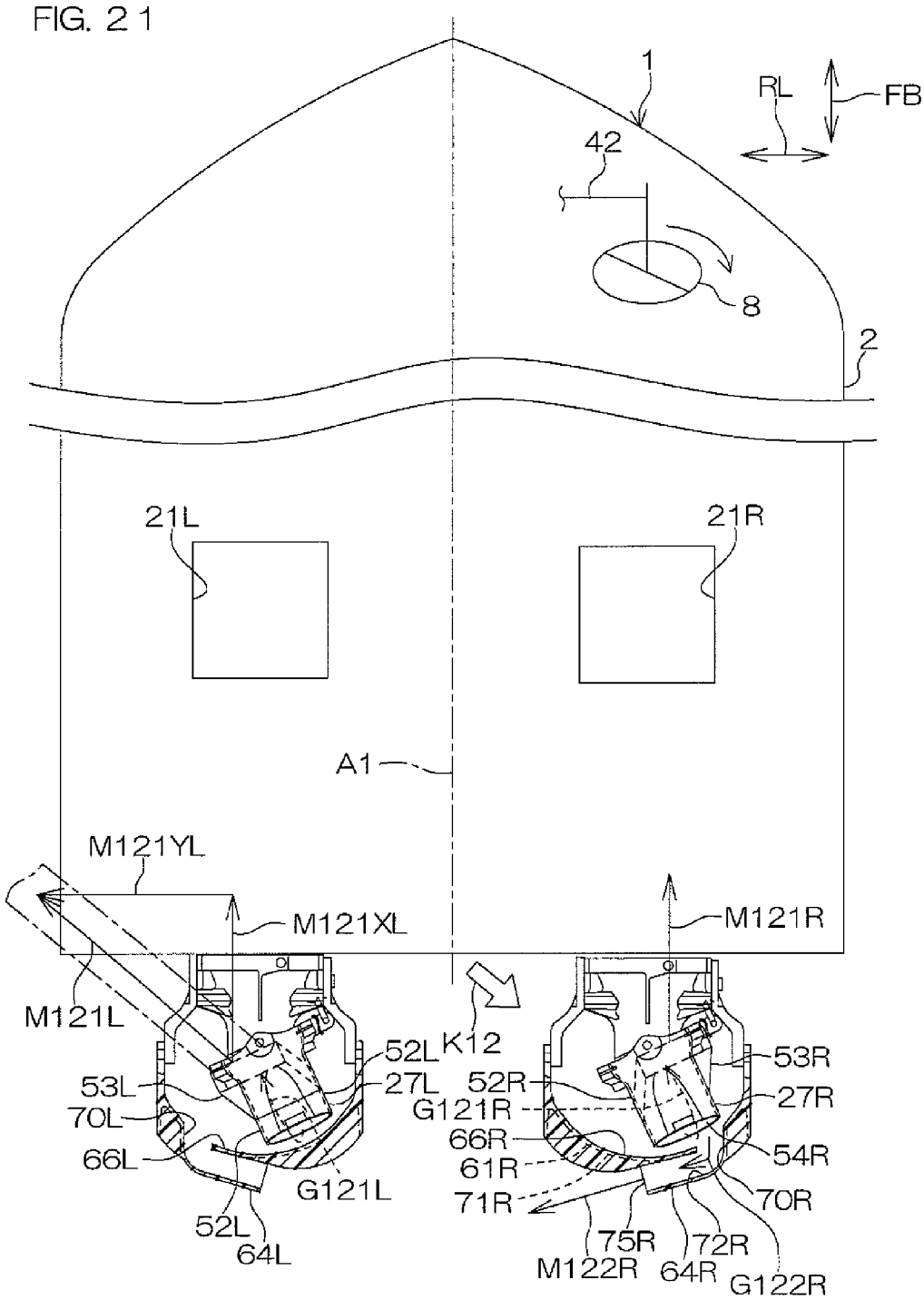
FIG. 21 is schematic plan view of a state where rightward reverse drive (reverse drive while turning left) of the water jet propulsion watercraft is being performed.

On the other hand, when, as shown in FIG. 21, the steering wheel 8 is rotated from the straight reverse drive state to the maximum steering angle to the right, the pair of right and left deflectors 27R and 27L are rotated in the right direction. A portion of the rear end opening 54R of the forward jet port 52R of the right deflector 27R is thereby arranged to oppose the entrance 70R of the auxiliary nozzle 64R. In the example of FIG. 21, a portion of approximately half in the width direction of the rear end opening 54R opposes the entrance 70R. A portion of the water flow from the forward drive jet port 52R of the right deflector 27R is thereby received by the entrance 70R of the auxiliary nozzle 64R.

The water flow received by the entrance 70R from the right deflector 27R proceeds through the tunnel portion 72R and inside the auxiliary nozzle 64R as indicated by an arrow G122R. This water flow is further jetted practically toward the left along the outer surface 71R of the main bucket body 61R from the exit 75R of the auxiliary nozzle 64R. A water flow M122R that is jetted toward the left from the exit 75R is thereby generated.

The water flow that is not received by the entrance 70R from the forward drive jet port 52R of the right deflector 27R is reflected by the reflecting surface 66R and is directed to the reverse drive jet port 53R as indicated by an arrow G121R. The water flow directed to the reverse drive jet port 53R arranges a water flow M121R that is jetted straight forward from the reverse drive jet port 53R. The water flow M121R is jetted parallel or substantially parallel to the hull centerline A1.

The forward drive jet port 52L of the left deflector 27L does not oppose the entrance 70L of the auxiliary nozzle 64L and a water flow is thus not jetted from the auxiliary nozzle 64L. The water flow from the forward drive jet port 52L of the left deflector 27L is reflected by the reflecting surface 66L and is directed to the reverse drive jet port 53L as indicated by an arrow G121L. The water flow directed to the reverse drive jet port 53L arranges a water flow M121L that is jetted in a left front direction from the reverse drive jet port 53L.

The water flow M121L includes a component M121YL that separates to the left from the hull centerline A1 and a component M121XL that is directed to the front of the hull 2.

Consequently, a resultant force of the propulsive forces generated by the water flows M121R, M122R, and M121L is a force that is directed to a right rear direction of the hull 2. The hull 2 thus proceeds in a right rearward heading direction K12 in accordance with the direction of the resultant force. More specifically, a propulsive force that is directed in the right rear direction acts on the stern and the water jet propulsion watercraft 1 is thus driven in reverse while turning in the left direction (counterclockwise).

The water flows M121R, M122R, and M121L arise as described above when the rightward rotation angles from the straight drive positions of the pair of right and left deflectors 27R and 27L are, for example, not less than several degrees. On the other hand, when the rightward rotation angles are zero to less than the several degrees, the forward drive jet port 52R does not oppose the entrance 70R of the auxiliary nozzle 64R. In this case, the water jet propulsion watercraft 1 is driven rightward in reverse by the water flows M121R and M121L. In the case where the water flow 122R from the auxiliary nozzle 64R is arranged, the stern can be moved more strongly in the right direction and thus a strong turning force can be obtained.

Figure 22:
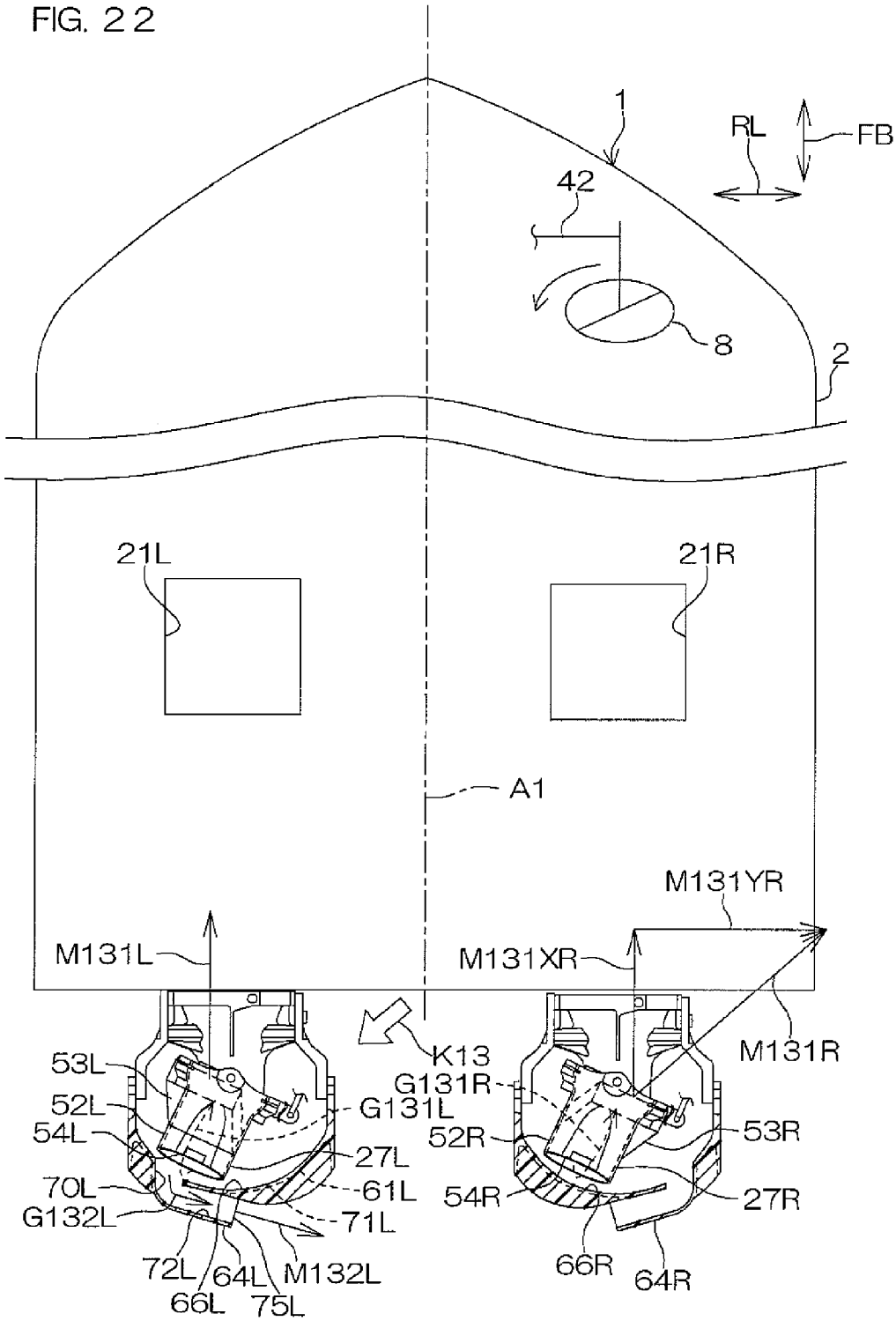
FIG. 22 is schematic plan view of a state where leftward reverse drive (reverse drive while turning right) of the water jet propulsion watercraft is being performed.

On the other hand, as shown in FIG. 22, when the steering wheel 8 is rotated from the straight reverse drive state to the maximum steering angle in the left direction, the pair of right and left deflectors 27R and 27L are rotated in the left direction. A portion of the rear end opening 54L of the forward jet port 52L of the left deflector 27L is thereby arranged to oppose the entrance 70L of the auxiliary nozzle 64L. In the example of FIG. 22, a portion of approximately half in the width direction of the rear end opening 54L opposes the entrance 70L. A portion of the water flow from the forward drive jet port 52L of the right deflector 27L is thereby received by the entrance 70L of the auxiliary nozzle 64L.

The water flow received by the entrance 70L from the left deflector 27L proceeds through the tunnel portion 72L and inside the auxiliary nozzle 64L as indicated by an arrow G132L. This water flow is further jetted practically toward the right along the outer surface 71L of the main bucket body 61L from the exit 75L of the auxiliary nozzle 64L. A water flow M132L that is jetted toward the right from the exit 75L is thereby generated.

The water flow that is not received by the entrance 70L from the forward drive jet port 52L of the left deflector 27L is reflected by the reflecting surface 66L and is directed to the reverse drive jet port 53L as indicated by an arrow G131L. The water flow directed to the reverse drive jet port 53L arranges a water flow M131L that is jetted straight forward from the reverse drive jet port 53L. The water flow M131L is jetted parallel or substantially parallel to the hull centerline A1.

The forward drive jet port 52R of the right deflector 27R does not oppose the entrance 70R of the auxiliary nozzle 64R and a water flow is thus not jetted from the auxiliary nozzle 64R. The water flow from the forward drive jet port 52R of the right deflector 27R is reflected by the reflecting surface 66R and is directed to the reverse drive jet port 53R as indicated by an arrow G131R. The water flow directed to the reverse drive jet port 53R arranges a water flow M131R that is jetted in a right front direction from the reverse drive jet port 53R.

The water flow M131R includes a component M131YR that separates to the right from the hull centerline A1 and a component M131XR that is directed to the front of the hull 2.

Consequently, a resultant force of the propulsive forces generated by the water flows M131L, M132L, and M131R is a force that is directed to a left rear direction of the hull 2. The hull 2 thus proceeds in a left rearward heading direction K13 in accordance with the direction of the resultant force. More specifically, a propulsive force that is directed in the left rear direction acts on the stern and the water jet propulsion watercraft 1 is thus driven in reverse while turning in the right direction (clockwise).

The water flows M131L, M132L, and M131R arise as described above when the leftward rotation angles from the straight drive positions of the pair of right and left deflectors 27R and 27L are, for example, not less than several degrees. On the other hand, when the leftward rotation angles are zero to less than the several degrees, the forward drive jet port 52L does not oppose the entrance 70L of the auxiliary nozzle 64L. In this case, the water jet propulsion watercraft 1 is driven leftward in reverse by the water flows M131L and M131R. In the case where the water flow 132L from the auxiliary nozzle 64L is arranged, the stern can be moved more strongly in the left direction and thus a strong turning force can be obtained.

As described above, according to the first preferred embodiment of the present invention, the following advantageous effects can be obtained. That is, when straight reverse drive of the water jet propulsion watercraft 1 is to be performed, the buckets 28R and 28L are arranged at the reverse drive positions of blocking the forward drive jet ports 52R and 52L, and the deflectors 27R and 28R a repositioned at the straight drive positions. In this state, the entrances 70R and 70L of the auxiliary nozzles 64R and 64L do not oppose the forward drive jet ports 52R and 52L. Large portions of the water jetted from the jetting units 29R and 29L are thus jetted from the reverse drive jet ports 53R and 53L. A large propulsive force in the reverse drive direction can thus be applied to the hull 2.

When the water jet propulsion watercraft 1 is to be turned to the right direction while driving in reverse, the buckets 28R and 28L are arranged at the reverse drive positions of blocking the forward drive jet ports 52R and 52L, and the deflectors 27R and 27L are turned to the right from the straight drive positions. A portion of the water jetted from the jetting unit 29R is thus introduced into the auxiliary nozzle 64R from the entrance 70R opened in the reflecting surface 66R of the bucket 28R.

A portion of the water jetted from the jetting unit 29R is jetted from the reverse drive jet port 53R. The water introduced into the auxiliary nozzle 64R is thus jetted in the right/left direction RL and a propulsive force in the right/left direction RL is obtained by this jetting. By the jetting of the water from the reverse drive jet port 53R, an adequate propulsive force in the reverse drive direction is obtained. The hull 2 can thereby be turned while being driven in reverse.

Likewise, when the water jet propulsion watercraft 1 is to be turned to the left direction while driving in reverse, the buckets 28R and 28L are arranged at the reverse drive positions of blocking the forward drive jet ports 52R and 52L, and the deflectors 27R and 27L are turned to the left from the straight drive positions. A portion of the water jetted from the jetting unit 29L is thus introduced into the auxiliary nozzle 64L from the entrance 70L opened in the reflecting surface 66L of the bucket 28L.

A portion of the water jetted from the jetting unit 29L is jetted from the reverse drive jet port 53L. The water introduced into the auxiliary nozzle 64L is thus jetted in the right/left direction RL and a propulsive force in the right/left direction RL is obtained by this jetting. By the jetting of the water from the reverse drive jet port 53L, an adequate propulsive force in the reverse drive direction is obtained. The hull 2 can thereby be turned while being driven in reverse.

The auxiliary nozzles 64R and 64L are arranged to jet water in directions that are right/left symmetrical in plan view. A propulsive force for turning the hull 2 in the right direction R can thereby be generated by causing water to jet from the auxiliary nozzle 64R at the right side. A propulsive force for turning the hull 2 in the left direction L can be generated by causing water to jet from the auxiliary nozzle 64L at the left side. The hull 2 can thereby be turned in either the right or left direction.

A case where the right deflector 27R is at the straight drive position and the right bucket 28R is at the reverse drive position in the right jet propulsion device 3R is considered. In this case, the entrance 70R arranged in the reflecting surface 66R of the right bucket 28R is positioned to the right relative to the position opposite the right deflector 27R. Thus, when the right deflector 27R is turned to the right, the right deflector 27R opposes the entrance 70R. The water flow discharged from the right deflector 27R is thereby introduced into the auxiliary nozzle 64R through the entrance 70R. The water introduced into the auxiliary nozzle 64R is jetted toward the hull centerline A1, that is, toward the left side. A propulsive force that turns the stern to the right side is thereby generated. The hull 2 can thus be moved in a right rear direction with the stern being turned to the right direction R.

Likewise, a case where the left deflector 27L is at the straight drive position and the left bucket 28L is at the reverse drive position in the left jet propulsion device 3L is considered. In this case, the entrance 70L arranged in the reflecting surface 66L of the left bucket 28L is positioned to the left relative to the position opposite the left deflector 27L. Thus, when the left deflector 27L is turned to the left, the left deflector 27L opposes the entrance 70L. The water flow discharged from the left deflector 27L is thereby introduced into the auxiliary nozzle 64L through the entrance 70L. The water introduced into the auxiliary nozzle 64L is jetted toward the hull centerline A1, that is, toward the right side. A propulsive force that turns the stern to the left side is thereby generated. The hull 2 can thus be moved in a left rear direction with the stern being turned to the left direction L.

If when the buckets 28R and 28L are at the forward drive positions, the right and left deflectors 27R and 27L are turned to the right side with respect to the straight drive positions (the forward drive jet ports 52R and 52L are moved to the right) by rotating the steering wheel 8 to the right, a propulsive force that moves the stern in the left front direction is generated. Forward-drive right turning is thereby enabled. Likewise, when the right and left deflectors 28R and 28L are turned to the left side with respect to the straight drive positions (the forward drive jet ports 52R and 52L are moved to the left) by rotating the steering wheel 8 to the left, a propulsive force that moves the stern in the right front direction is generated. Forward-drive left turning is thereby enabled.

On the other hand, if when the buckets 28R and 28L are at the reverse drive positions by rotating the steering wheel 8 to the right, the right and left deflectors 27R and 27L are turned to the right side with respect to the straight drive positions, a propulsive force that moves the stern in the right rear direction is generated. The hull 2 can thereby be turned to the right side while being driven in reverse. Likewise, by rotating the steering wheel 8 to the left, when the right and left deflectors 27R and 27L are turned to the left side with respect to the straight drive positions, a propulsive force that moves the stern in a left rear direction is generated. The hull 2 can thereby be turned to the left side while being driven in reverse. The steering direction of the steering wheel 8 and the turning direction of the hull 2 are thus matched during forward drive and reverse drive. Excellent steering performance can thus be realized. The marine vessel running direction during reverse drive of the water jet propulsion watercraft 1 can be controlled by operating the steering wheel 8 in the same manner as in operating a steering wheel when a passenger vehicle is driven in reverse. Even better steering performance can thus be realized.

With the respective auxiliary nozzles 64R and 64L, flow paths H1R and H1L that run along the outer surfaces 71R and 71L of the buckets 28R and 28L are arranged. Water flows can thereby be guided from the inner sides to the corresponding outer surface 71R and 71L sides of the buckets 28R and 28L to form water flows in the right/left direction RL at the outer surface 71R and 71L sides of the buckets 28R and 28L. The water flows generated from the respective auxiliary nozzles 64R and 64L can thereby be prevented from being influenced by water flows at the reflecting surface 66R and 66L sides of the corresponding buckets 28R and 28L. Consequently, a propulsive force in the right/left direction RL can be generated effectively.

The entrances 70R and 70L of the respective auxiliary nozzles 64R and 64L preferably have a configuration arranged to receive portions of the water jetted from the deflectors 27R and 27L. Thus, when one of either of the forward drive jet ports 52R and 52L opposes the entrance 70R or 70L of the corresponding auxiliary nozzle 64R or 64L, a portion of the water flow jetted from the forward drive jet port 52R or 52L of one of either of the deflectors 27R and 27L is introduced into the corresponding auxiliary nozzle 64R or 64L. The remainder portion of the water flow is reflected by the reflecting surface 66R or 66L of the corresponding bucket 28R or 28L and is jetted from the corresponding reverse drive jet port 53R or 53L. A propulsive force in the right/left direction RL can thereby be generated from the discharge water flow from each of the auxiliary nozzles 64R and 64L and, at the same time, a propulsive force in the reverse drive direction can be generated by the discharge water flow from the respective reverse drive jet ports 53R and 53L. The hull 2 can thereby be turned while being driven in reverse.

By the provision of the nozzle interlocking mechanism 41, the pair of deflectors 27R and 27L are interlockingly rotated to the right and left and thus excellent motion performance (turning performance and propulsion performance) can be obtained during forward drive. Further, during reverse drive, the pair of buckets 28R and 28L can be respectively moved interlockingly by the bucket interlocking mechanism 48 to the reverse drive positions of blocking the forward drive jet ports 52R and 52L of the corresponding deflectors 27R and 27L. The water flows jetted from the pair of jetting units 29R and 29L can thereby be caused to be jetted respectively from the reverse drive jet ports 53R and 53L of the corresponding deflectors 27R and 27L, and the hull 2 can thus be driven in reverse by an adequate propulsive force. Further, when, in the state where the pair of buckets 28R and 28L are at the respective reverse drive positions, the pair of deflectors 27R and 27L are interlockingly rotated to either the right or the left, a water flow is jetted from one of the pair of auxiliary nozzles 64R and 64L while a water flow is practically not jetted from the other auxiliary nozzle. Canceling out of the propulsive forces in the right/left direction RL that are generated by the water flows jetted from the pair of auxiliary nozzles 64R and 64L can thus be avoided.

Moreover, arrangements are made so that a water flow is generated toward the right direction R from the auxiliary nozzle 64L and a water flow is generated toward the left direction L from the auxiliary nozzle 64R. Turning in either of the right and left directions is thereby enabled during reverse drive. In this case, canceling out of the propulsive forces due to the water flows generated by the pair of auxiliary nozzles 64R and 64L can be avoided because a water flow is not jetted from the other auxiliary nozzle 64L or 64R when a water flow is jetted from one auxiliary nozzle 64R or 64L. A large propulsive force for turning the water jet propulsion watercraft 1 can thereby be secured in an efficient manner, and the motion performance during reverse drive can thus be improved.

The reverse drive jet ports 53R and 53L of the deflectors 27R and 27L are arranged to jet water flows toward the front of the hull 2. Thus, of the water flows generated by the respective jet propulsion devices 3R and 3L, the proportion of components that are directed forward and are parallel or substantially parallel to the hull centerline A1 can be increased. A large rearward propulsive force can thereby be secured during reverse drive.

The jetting directions of the water flows M111R and M111L from the reverse drive jet ports 53R and 53L when the deflectors 27R and 27L are at the straight drive positions are directions that respectively include components M111YR and M111YL that are directed away from the hull centerline A1. The respective jetting units 29R and 29L sucks in water from the corresponding intakes 21R and 21L arranged at the front relative to the jetting positions and j et the water rearward. Thus, when water flows are jetted toward the front of the hull from the reverse drive jet ports 53R and 53L, bubbles resulting from the water flow jetting may reach the corresponding intakes 21R and 21L, become sucked into the jetting units 29R and 29L, and may cause cavitation. The jetting directions of the water flows M111R and M111L from the reverse drive jet ports 53R and 53L are thus set to the directions (right front and left front) that include the components directed away from the hull centerline A1. The water flows M111R and M111L from the reverse drive jet ports 53R and 53L can thus be shifted to the outer sides of the hull 2 with respect to the intakes 21R and 21L. Cavitation in the respective jet propulsion devices 3R and 3L can thereby be prevented. Consequently, a large reverse drive direction propulsive force can be obtained. Theoretically, it should be possible to obtain a maximum reverse drive direction propulsive force when the water flow jetting directions of the reverse drive jet ports 53R and 53L are parallel or substantially parallel to the hull centerline A1. However, in actuality, in consideration of the cavitation, the propulsive force toward the rear can be maximized when the water flow jetting directions of the reverse drive jet ports 53R and 53L are non-parallel to the hull centerline A1.

On the other hand, when the pair of deflectors are rotated in the right direction from the straight drive positions, the water flow jetting direction of one reverse drive jet port 53R becomes a direction that is closer to being parallel to the hull centerline A1. A rearward direction propulsive force that is parallel or substantially parallel to the hull centerline A1 can thereby be increased. That is, an adequate reverse drive direction propulsive force can be secured when performing reverse drive while turning. The water flow jetting direction of the other reverse drive jet port 53L becomes a direction with which a propulsive force that moves the stern to the rotation direction of the deflectors 27R and 27L is generated. The turning of the hull 2 can thereby be facilitated. Moreover, the water flow jetting direction of the other reverse drive jet port 53L is larger in angle with respect to the hull centerline A1 than during straight drive. The cavitation in the corresponding jet propulsion device 3L can thereby be further prevent.

Likewise, when the pair of deflectors are rotated in the left direction from the straight drive positions, the water flow jetting direction of the reverse drive jet port 53L becomes a direction that is closer to being parallel or substantially parallel to the hull centerline A1. A rearward direction propulsive force that is parallel or substantially parallel to the hull centerline A1 can thereby be increased. That is, an adequate reverse drive direction propulsive force can be secured when performing reverse drive while turning. The water flow jetting direction of the reverse drive jet port 53R becomes a direction with which a propulsive force that moves the stern to the rotation direction of the deflectors 27R and 27L is generated. The turning of the hull 2 can thereby be facilitated. Moreover, the water flow jetting direction of the other reverse drive jet port 53R is larger in angle with respect to the hull centerline A1 than during straight drive. The cavitation in the corresponding jet propulsion device 3R can thereby be further prevented.

When the pair of deflectors 27R and 27L are at the straight drive positions, the jetting directions of the water flows M111R and M111L of the reverse drive jet ports 53R and 53L are non-parallel to the hull centerline A1 and are right/left symmetrical. Thus, when the hull 2 is to be driven in reverse straightly along the hull centerline A1, the water flows M111R and M111L from the reverse drive jet ports 53R and 53L are right/left symmetrical. The resultant force of the propulsive forces that are generated by the water flows M111R and M111L is thus substantially parallel to the front/rear direction of the hull. Straightness during reverse drive can thus be improved. When reverse straight drive is performed, the water flows that are jetted toward the front can be shifted away from the intakes 21R and 21L. Cavitation in the jet propulsion devices 3R and 3L can thereby be prevented.

The respective reverse drive jet ports 53R and 53L are arranged such that the jetting directions of the water flows M111R and M111L when the respective deflectors 27R and 27L are at the straight drive positions are directions that are shifted away from the corresponding intakes 21R and 21L. The water flows M111R and M111L from the respective reverse drive jet ports 53R and 53L can thereby be prevented from being directed toward the corresponding intakes 21R and 21L. Consequently, cavitation in the respective jet propulsion devices 3R and 3L can be prevented.

Water can be jetted from the respective reverse drive jet ports 53R and 53L by being arranged the respective buckets 28R and 28L at the reverse drive positions and blocked the respective forward drive jet ports 52R and 52L. A large reverse drive direction propulsive force can thereby be applied to the hull 2. Moreover, when the deflectors 27R and 27L are at the straight drive positions, the jetting directions of the water flows M111R and M111L of the reverse drive jet ports 53R and 53L are non-parallel to the hull centerline A1. The water flows from the respective reverse drive jet ports 53R and 53L can thereby be shifted away from the corresponding intakes 21R and 21L. Cavitation in the respective jet propulsion devices 3R and 3L can thereby be prevented, and a large reverse drive direction propulsive force can thus be secured.

Second Preferred Embodiment

Figure 23:
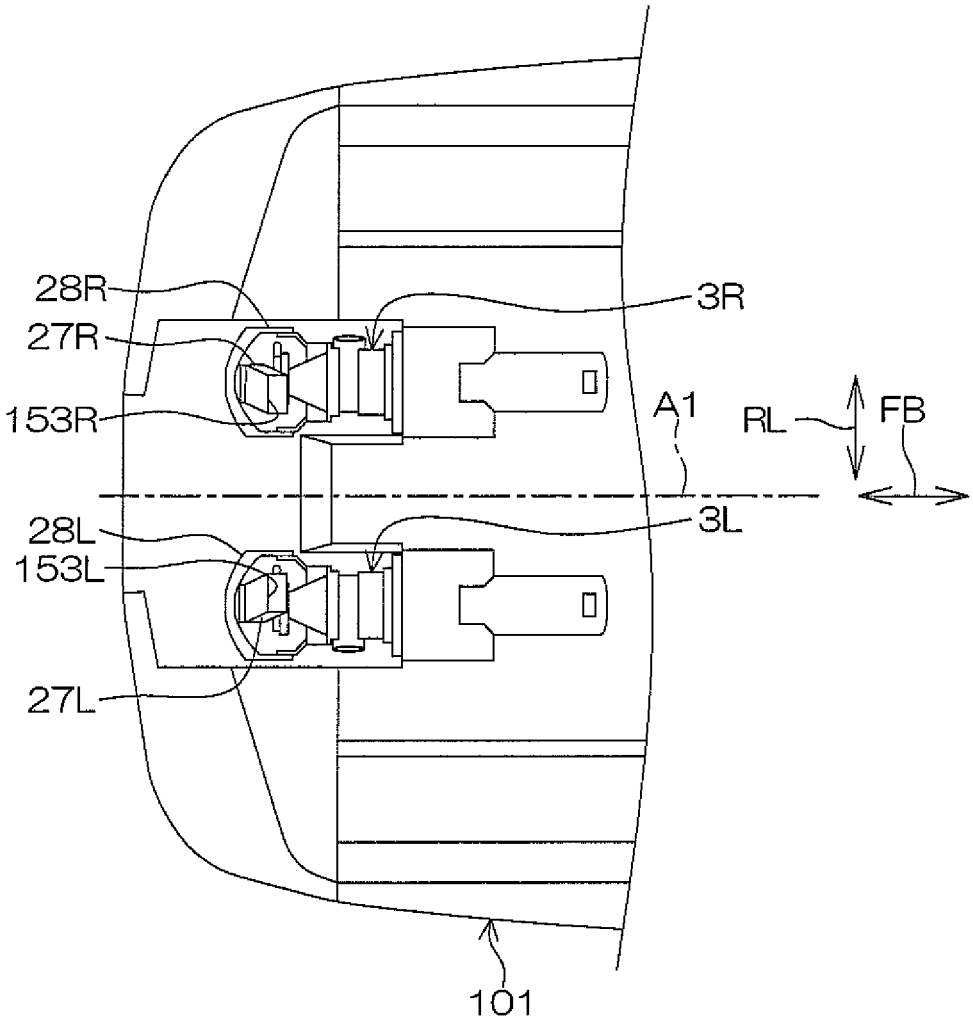
FIG. 23 is a bottom view of principal portions of a water jet propulsion watercraft according to a second preferred embodiment of the present invention.

FIG. 23 is a bottom view of principal portions of a water jet propulsion watercraft 101 according to a second preferred embodiment of the present invention. In the following description, arrangements, actions, and effects that differ from those of the first preferred embodiment shall be described. Arrangements that are the same as those of the first preferred embodiment shall be provided with the same symbols, and description of the arrangements, actions, and effects thereof shall be omitted.

A principal point of difference of the water jet propulsion watercraft 101 according to the second preferred embodiment of the present invention with respect to the water jet propulsion watercraft 1 according to the first preferred embodiment of the present invention lies in the arrangement of reverse drive jet ports 153R and 153L included in the deflectors 27R and 27L. Specifically, water flow jetting directions of the reverse drive jet ports 153R and 153L of the respective deflectors 27R and 27L when the water jet propulsion watercraft 101 is driven straightly in reverse include components that are directed toward the hull centerline A1.

Figure 24:
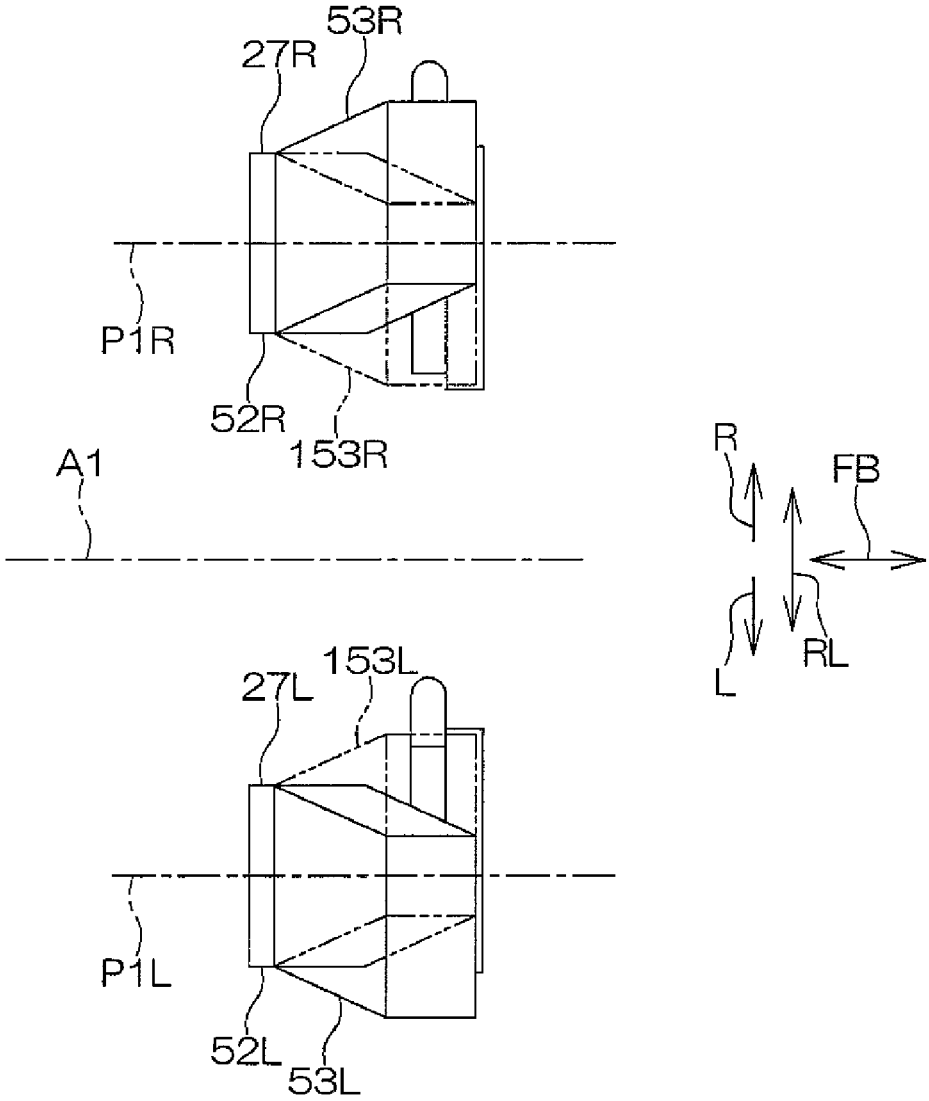
FIG. 24 is schematic bottom view of principal portions for describing a difference between a reverse drive jet port in the first preferred embodiment and a reverse drive jet port in the second preferred embodiment of the present invention.

For comparison, a schematic bottom view of the right deflector 27R and the left deflector 27L of the first preferred embodiment of the present invention is shown in FIG. 24. The reverse drive jet port 53R of the right deflector 27R in the first preferred embodiment of the present invention is inclined in a direction of separating away from the hull centerline A1 with respect to a central axis line P1R of the forward drive jet port 52R (to the right front of the hull). On the other hand, the reverse drive jet port 153R of the right deflector 27R in the second preferred embodiment of the present invention is inclined in a direction of approaching the hull centerline A1 with respect to a central axis line P1R of the forward drive jet port 52R (to the front left of the hull). For example, a position of the reverse drive jet port 153R in bottom view may be symmetrical to the reverse drive jet port 53R with a vertical plane, containing the central axis line P1R of the forward drive jet port 52R, as a plane of symmetry.

Likewise, the reverse drive jet port 53R of the left deflector 27L in the first preferred embodiment of the present invention is inclined in a direction of separating away from the hull centerline A1 with respect to a central axis line P1L of the forward drive jet port 52L (to the front left of the hull). On the other hand, the reverse drive jet port 153L of the left deflector 27L in the second preferred embodiment of the present invention is inclined in a direction of approaching the hull centerline A1 with respect to a central axis line P1L of the forward drive jet port 52L (to the right front of the hull). For example, a position of the reverse drive jet port 153L in bottom view may be symmetrical to the reverse drive jet port 53L with a vertical plane, containing the central axis line P1L of the forward drive jet port 52L, as a plane of symmetry.

Reverse Drive Operation of the Water Jet Propulsion Watercraft 101

Figure 25:
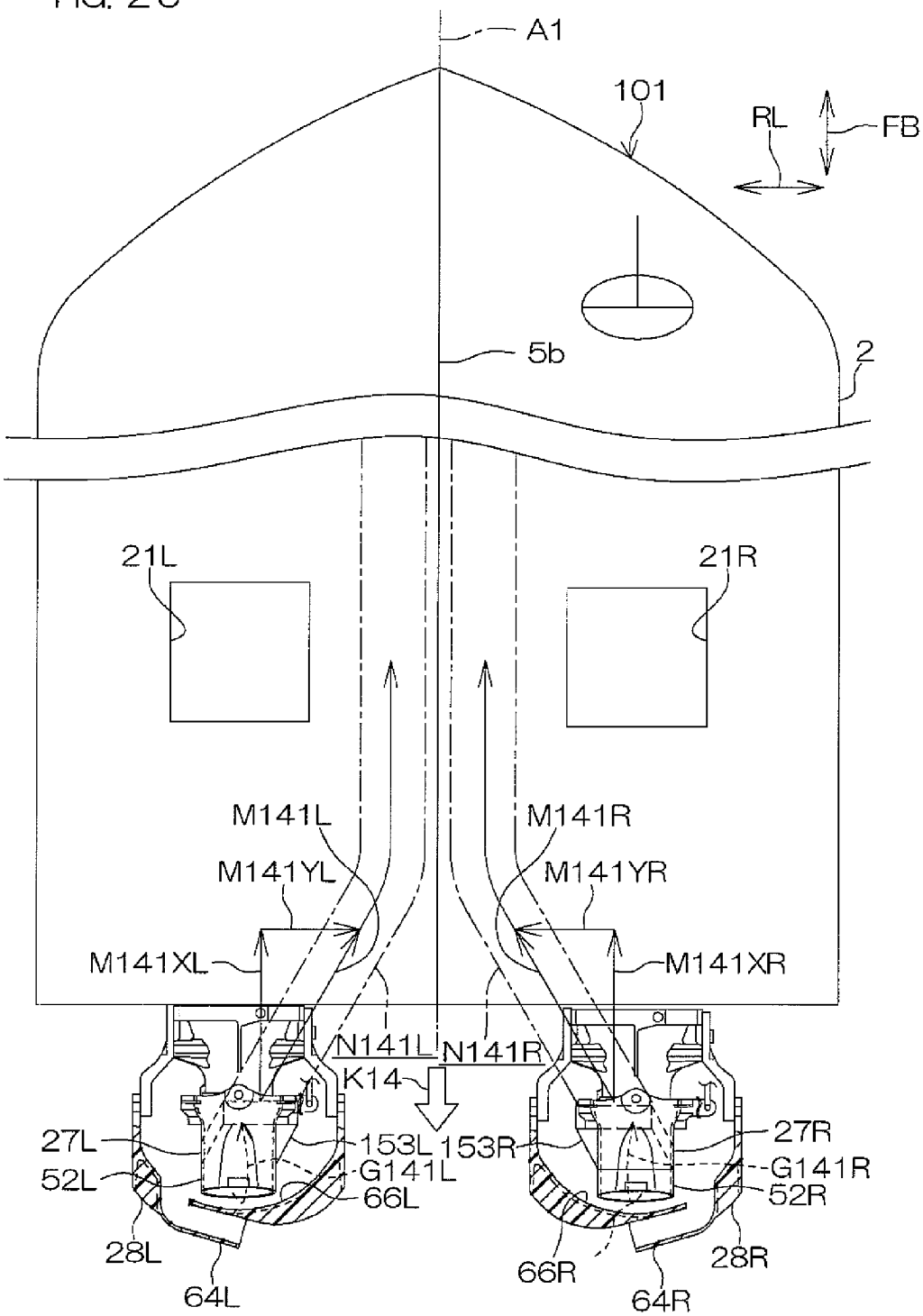
FIG. 25 is schematic plan view of a state where straight reverse drive of the water jet propulsion watercraft of the second preferred embodiment is being performed.

FIG. 25 is schematic plan view of the water jet propulsion watercraft 101. When straight reverse drive of the water jet propulsion watercraft 101 is to be performed, the pair of right and left deflectors 27R and 27L are arranged at the straight drive positions. The pair of right and left buckets 28R and 28L are arranged at the reverse drive positions, that is, at the rear of the pair of right and left deflectors 27R and 27L. In this state, the forward drive jet ports 52R and 51R of the pair of right and left deflectors 27R and 27L do not oppose the entrances 70R and 70L of the auxiliary nozzles 64R and 64L. The water flows from the forward drive jet ports 52R and 52L are thereby reflected by the reflecting surfaces 66R and 66L and flow out from the reverse drive jet ports 153R and 153L as indicated by arrows G141R and G141L. The water flows from the forward drive jet ports 52R and 52L do not flow into the auxiliary nozzles 64R and 64L.

A water flow M141R that flows out from the reverse drive jet port 153R is jetted in the left front direction. The water flow M141R is jetted at substantially the same width as the width of a space at an inner side of the reverse drive jet port 153R. A range of the water flow M141R from the reverse drive jet port 153R is, for example, the range indicated by N141R and is shifted away from the right intake 21R.

The water flow M141R hits a portion near the ridgeline 5*b* of the bottom surface of the hull 2 and thus does not reach the left side of the hull centerline A1. Thus, after proceeding toward the hull centerline A1, the water flow M141R is directed forward substantially in parallel to the hull centerline A1. In accordance with the water flow M141R, the water flow range N141R extends forward in parallel or substantially parallel to the hull centerline A1.

Likewise, a water flow M141L that flows out from the reverse drive jet port 153L is jetted in the right front direction. The water flow M141L is jetted at substantially the same width as the width of a space at an inner side of the reverse drive jet port 153L. A range of the water flow M141L from the reverse drive jet port 153L is, for example, the range indicated by N141L and is shifted away from the left intake 21L.

The water flow M141L hits a portion near the ridgeline 5*b* of the bottom surface of the hull 2 and thus does not reach the right side of the hull centerline A1. Thus, after proceeding toward the hull centerline A1, the water flow M141L is directed forward substantially in parallel to the hull centerline A1. In accordance with the water flow M141L, the water flow range N141L extends forward in parallel or substantially parallel to the hull centerline A1.

The jetting directions of the water flows M141R and M141L from the reverse drive jet ports 153R and 153L are thus directed to the front of the hull 2. The jetting directions of the water flows M141R and M141L are right/left symmetrical across the hull centerline A1 and are non-parallel to the hull centerline A1.

Immediately after being jetted from the reverse drive jet port 153R, the water flow M141R includes a component M141YR that proceeds to the left toward the hull centerline A1 and a component M141XR that is directed to the front of the hull 2.

Immediately after being jetted from the reverse drive jet port 153L, the water flow M141L includes a component M141YL that proceeds to the right toward the hull centerline A1 and a component M141XL that is directed to the front of the hull 2.

As a result, the resultant force of the respective propulsive forces (reaction forces) generated by jetting of the water flows M141R and M141L is a rearward force that is parallel or substantially parallel to the hull centerline A1 of the hull 2. The hull 2 thereby heads straightly in a rearward heading direction K14.

Figure 26:
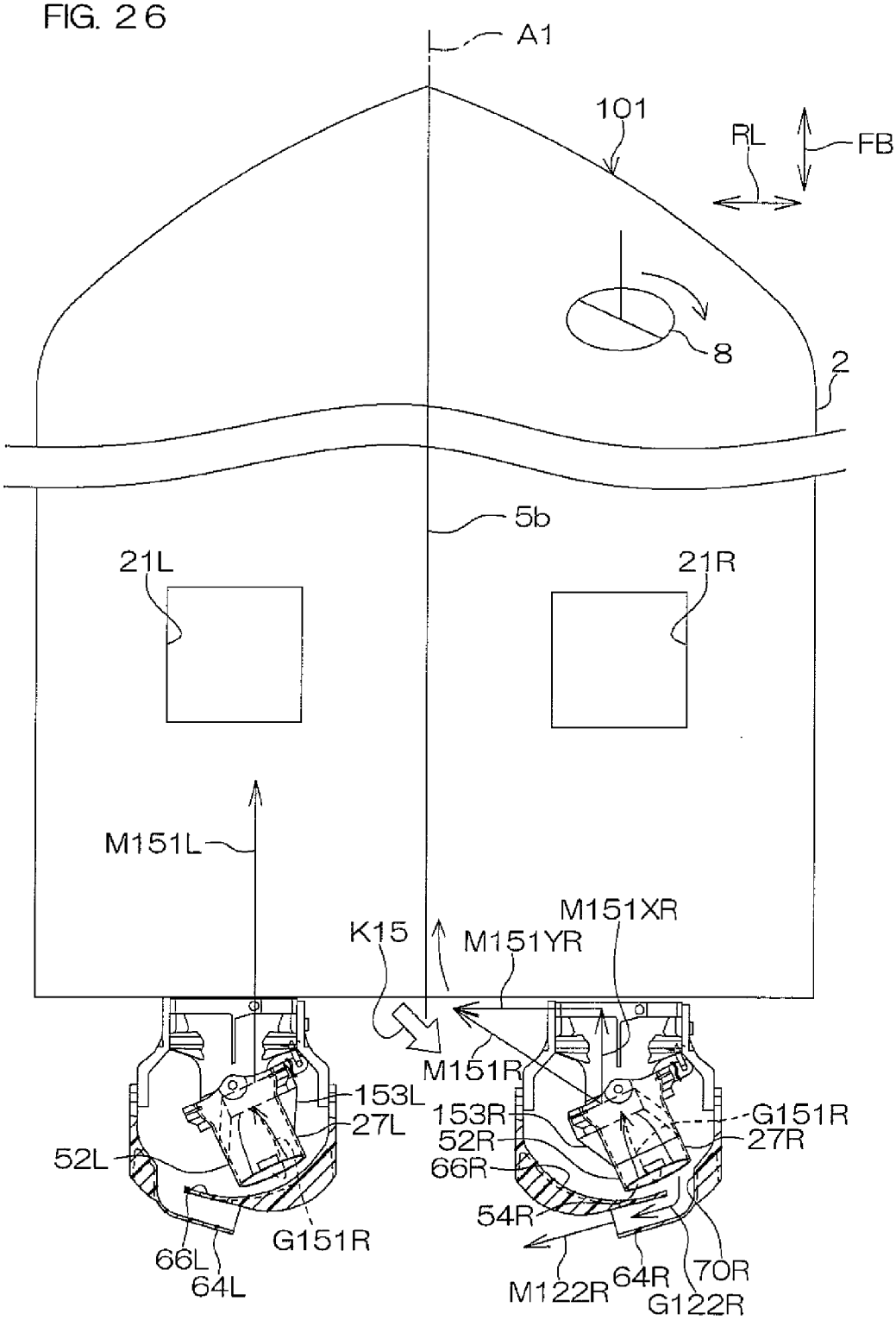
FIG. 26 is schematic plan view of a state where rightward reverse drive (reverse drive while turning left) of the water jet propulsion watercraft of the second preferred embodiment is being performed.

FIG. 26 is schematic plan view for describing an operation of moving in a right rear direction. When, from the straight reverse drive state, the steering wheel 8 is rotated to the maximum steering angle to the right, the pair of right and left deflectors 27R and 27L are rotated rightward. The rear end opening 54R of the forward jet port 52R of the right deflector 27R is thereby arranged to oppose the entrance 70R of the auxiliary nozzle 64R. A portion of the water flow from the right deflector 27R is thereby received by the entrance 70R of the auxiliary nozzle 64R, and a practically leftward water flow M122R is generated as indicated by an arrow G122R.

The water flow that is not received by the auxiliary nozzle 64R from the forward drive jet port 52R of the right deflector 27R is reflected by the reflecting surface 66R and is directed to the reverse drive jet port 153R as indicated by an arrow G151R. The water flow directed to the reverse drive jet port 153R is discharged from the reverse drive jet port 153R and arranges a water flow M151R that is directed to the left front. The water flow M151R that is jetted from the reverse drive jet port 153R proceeds forward in a region at the right side relative to the ridgeline 5*b* of the hull bottom of the hull 2.

Immediately after being jetted from the reverse drive jet port 153R, the water flow M151R includes a component M151YR that proceeds to the left toward the hull centerline A1 and a component M151XR that is directed to the front of the hull 2.

On the other hand, the left deflector 27L does not oppose the auxiliary nozzle 64L and a water flow is not jetted from the auxiliary nozzle 64L. The water flow from the forward drive jet port 52L of the left deflector 27L is reflected by the reflecting surface 66L and is directed to the reverse drive jet port 153L as indicated by an arrow G151R. The water flow directed to the reverse drive jet port 153L is jetted forward from the reverse drive jet port 153L and forms a water flow M151L that proceeds parallel or substantially parallel to the hull centerline A1.

A resultant force of the propulsive forces (reaction forces) generated by the water flows M151R, M122R, and M151L thus arranged is a force that is directed to the right rear of the hull 2. The hull 2 thus proceeds in a right rearward heading direction K15. In more detail, a propulsive force that moves the stern to the right rear is generated and the hull 2 is thus driven in reverse while turning leftward (counterclockwise). The hull 2 thus moves to the right rear.

The water flows M151R, M122R, and M151L arise as described above when the rightward rotation angles from the straight drive positions of the pair of right and left deflectors 27R and 27L are, for example, not less than several degrees. On the other hand, when the rightward rotation angles are zero to less than the several degrees, the forward drive jet port 52R does not oppose the entrance 70R of the auxiliary nozzle 64R. In this case, the water jet propulsion watercraft 1 is driven rightward in reverse by the water flows M151R and M151L jetted from the reverse drive jet ports 153R and 153L of the deflectors 27R and 27L.

Figure 27:
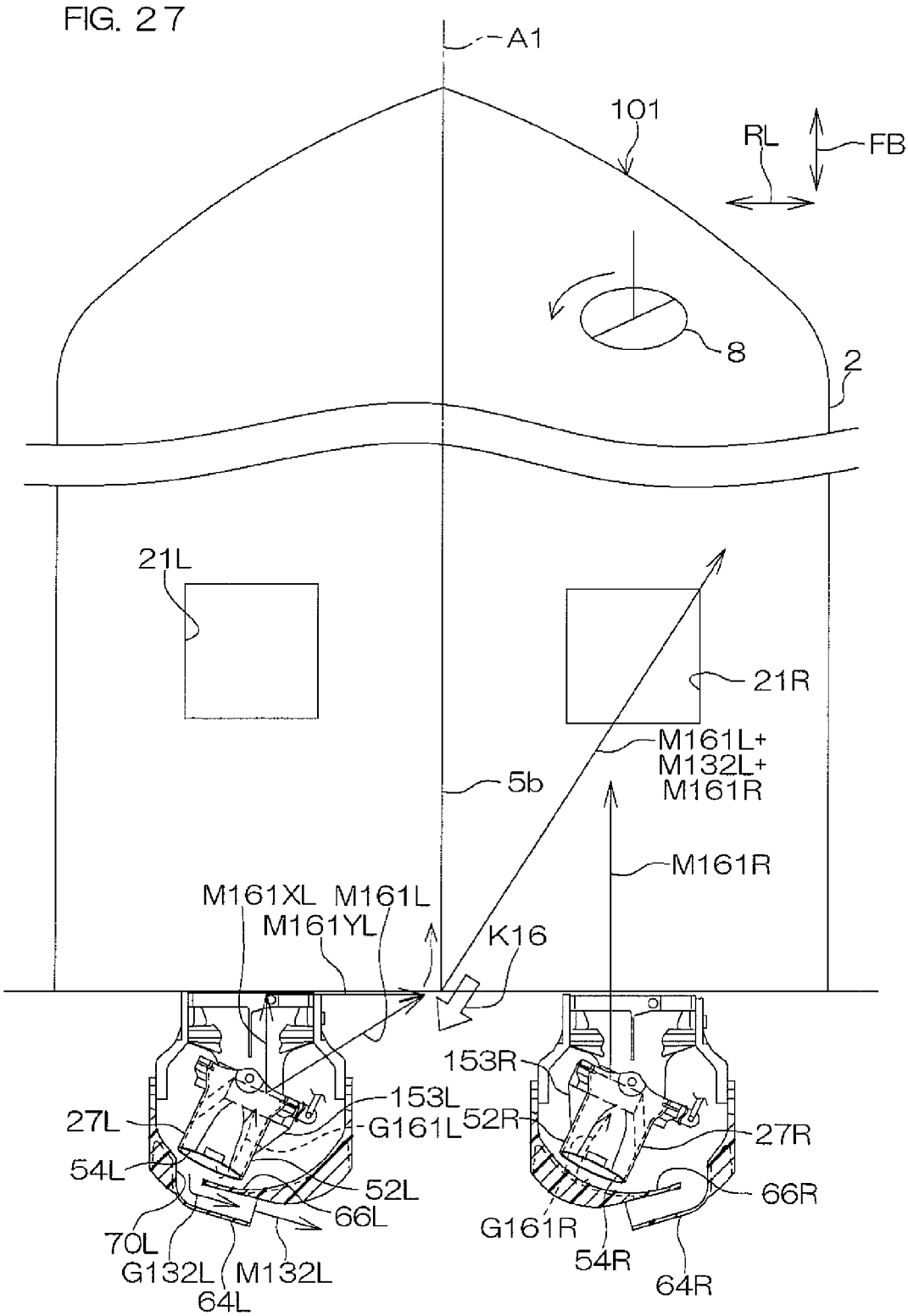
FIG. 27 is schematic plan view of a state where leftward reverse drive (reverse drive while turning right) of the water jet propulsion watercraft of the second preferred embodiment is being performed.
Figure 28:
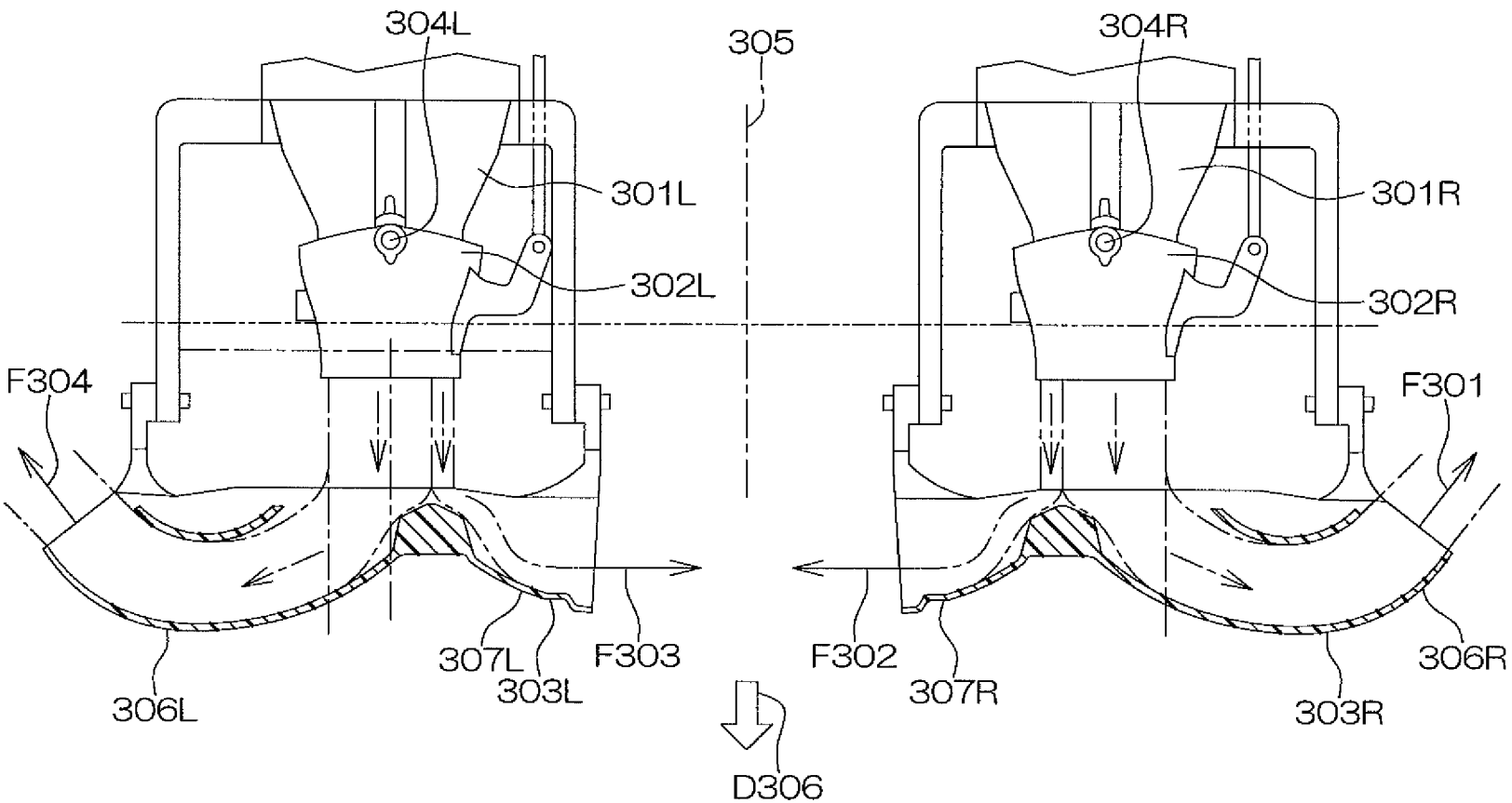
FIG. 28 PRIOR ART
FIG. 28 is a schematic plan view of principal portions of a conventional water jet propulsion watercraft and shows a state where straight reverse drive of the water jet propulsion watercraft is being performed.
Figure 29:
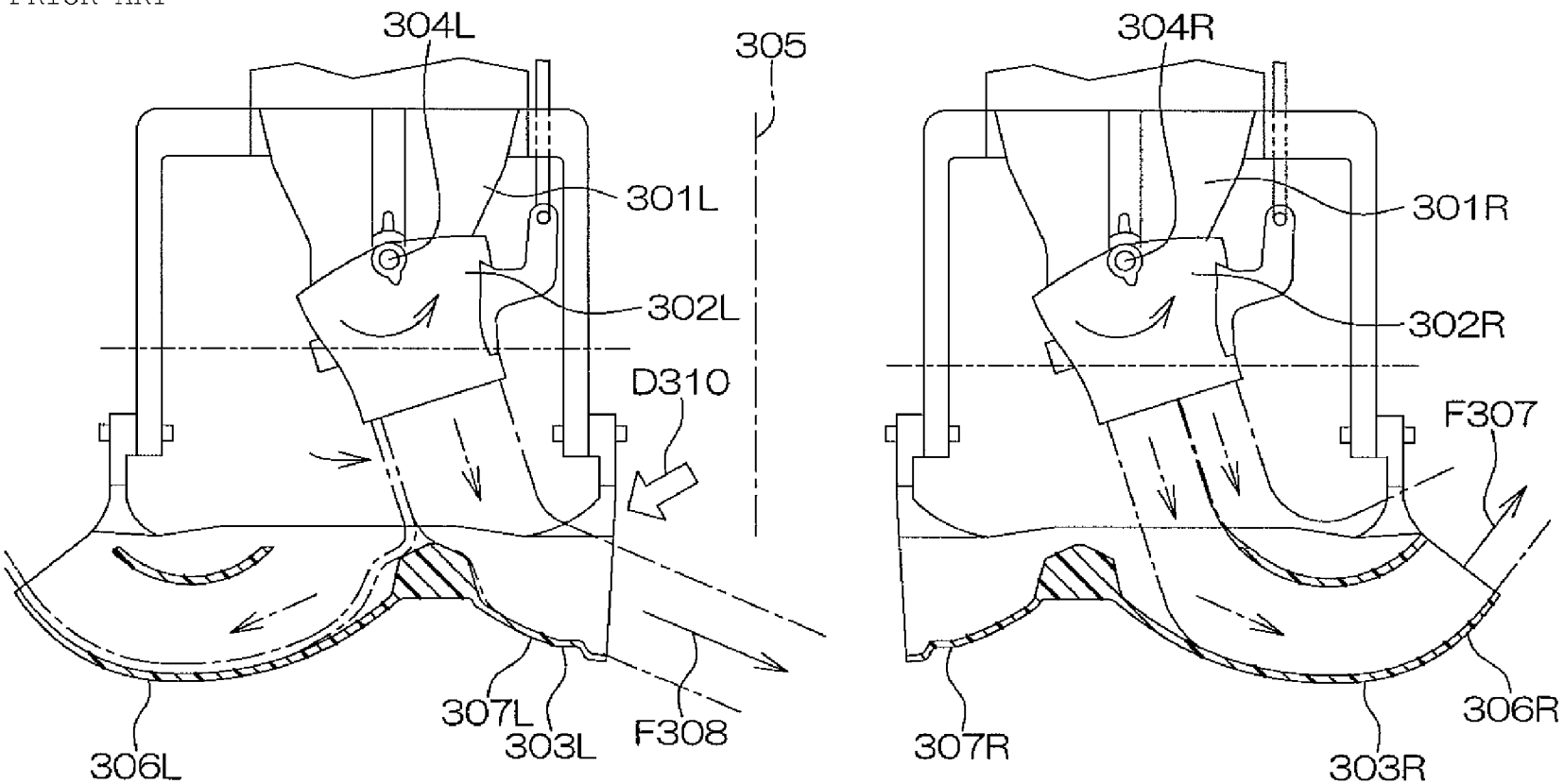
FIG. 29 PRIOR ART
FIG. 29 shows a state where reverse drive of the water jet propulsion watercraft of FIG. 28 in a left rear direction is being attempted.

FIG. 27 is schematic plan view for describing an operation of moving in a left rear direction. When, from the straight reverse drive state, the steering wheel 8 is rotated to the maximum steering angle to the left, the pair of right and left deflectors 27R and 27L are rotated leftward. The rear end opening 54L of the forward jet port 52L of the left deflector 27L is thereby arranged to oppose the entrance 70L of the auxiliary nozzle 64L. A portion of the water flow from the right deflector 27L is thereby received by the entrance 70L of the auxiliary nozzle 64L, and a practically rightward water flow M132L is generated as indicated by an arrow G132L.

The water flow that is not received by the auxiliary nozzle 64L from the forward drive jet port 52L of the left deflector 27L is reflected by the reflecting surface 66L and is directed to the reverse drive jet port 153L as indicated by an arrow G161L. The water flow directed to the reverse drive jet port 153L is discharged from the reverse drive jet port 153L and arranges a water flow M161L that is directed to the right front. The water flow M161L that is jetted from the reverse drive jet port 153R proceeds forward in a region at the left side relative to the ridgeline 5*b* of the hull bottom of the hull 2.

Immediately after being jetted from the reverse drive jet port 153L, the water flow M161L includes a component M161YL that proceeds to the right toward the hull centerline A1 and a component M161XL that is directed to the front of the hull 2.

On the other hand, the right deflector 27R does not oppose the auxiliary nozzle 64R and a water flow is not jetted from the auxiliary nozzle 64R. The water flow from the forward drive jet port 52R of the right deflector 27R is reflected by the reflecting surface 66R and is directed to the reverse drive jet port 153R as indicated by an arrow G161R. The water flow directed to the reverse drive jet port 153R is jetted forward from the reverse drive jet port 153R and arranges a water flow M161R that proceeds parallel or substantially parallel to the hull centerline A1.

A resultant force of the propulsive forces (reaction forces) generated by the water flows M161L, M132L, and M161R thus arranged is a force that is directed to the left rear of the hull 2. The hull 2 thus proceeds in a left rearward heading direction K16. More specifically, a propulsive force that moves the stern to the left rear is generated and the hull 2 is thus driven in reverse while turning rightward (clockwise). The hull 2 thus moves to the left rear.

The water flows M161L, M132L, and M161R arise as described above when the leftward rotation angles from the straight drive positions of the pair of right and left deflectors 27R and 27L are, for example, not less than several degrees. On the other hand, when the leftward rotation angles are zero to less than the several degrees, the forward drive jet port 52L does not oppose the entrance 70L of the auxiliary nozzle 64L. In this case, the water jet propulsion watercraft 101 is driven in reverse leftward by the water flows jetted from the reverse drive jet ports 153R and 153L of the deflectors 27R and 27L.

As described above, according to the second preferred embodiment of the present invention, the following advantageous effects can be obtained. That is, when straight drive to the rear is to be performed, the water flows 141R and M141L that are jetted forward from the respective reverse drive jet ports 53R and 53L can be shifted toward the hull centerline A1 side with respect to the corresponding intakes 21L and 21R. Cavitation can thereby be prevented.

When the pair of deflectors 27R and 27L are rotated in the right direction R from the straight drive positions, the water flow jetting direction of one reverse drive jet port 153L becomes a direction closer to being parallel to the hull centerline A1.

A rearward direction propulsive force that is parallel or substantially parallel to the hull centerline A1 can thereby be increased. That is, an adequate reverse drive direction propulsive force can be secured when performing reverse drive while turning. Further, the water flow jetting direction of the other reverse drive jet port 153R becomes a direction with which a propulsive force that moves the stern in the rotation direction of the respective deflectors 27R and 27L is generated. The turning of the hull 2 can thereby be facilitated. Moreover, the water flow jetting direction of the other reverse drive jet port 153R is larger in angle with respect to the hull centerline A1 than during straight drive. Cavitation in the jet propulsion device 3R can thereby be prevented further.

Likewise, when the pair of deflectors 27R and 27L are rotated in the left direction L from the straight drive positions, the water flow jetting direction of the reverse drive jet port 153R becomes a direction closer to being parallel to the hull centerline A1.

A rearward direction propulsive force that is parallel or substantially parallel to the hull centerline A1 can thereby be increased. That is, an adequate reverse drive direction propulsive force can be secured when performing reverse drive while turning. Further, the water flow jetting direction of the reverse drive jet port 153L becomes a direction with which a propulsive force that moves the stern in the rotation direction of the respective deflectors 27R and 27L is generated. The turning of the hull 2 can thereby be facilitated. Moreover, the water flow jetting direction of the reverse drive jet port 153L is larger in angle with respect to the hull centerline A1 than during straight drive. Cavitation in the jet propulsion device 3L can thereby be prevented further.

By the downward protrusion of the center of the hull bottom of the hull 2, the water flows from the respective reverse drive jet ports 53R and 53L can be prevented from flowing beyond the center of the hull 2 and toward the intakes 21L and 21R of the jet propulsion devices 3L and 3R at the opposite sides. Occurrence of cavitation in the respective jet propulsion devices 3R and 3L can thereby be prevented.

Besides the above first and second preferred embodiments, various design changes, such as the following, can be applied to the present invention within a scope of the matters described in the claims.

The pair of right and left auxiliary nozzles may jet water in non-symmetrical directions to the right and left of the hull centerline. The water flow jetting direction of each auxiliary nozzle suffices to intersect with the front/rear direction in plan view and the direction is not restricted.

The auxiliary nozzle may be arranged such that the water, introduced from the entrance, is jetted to a direction of separating from the hull centerline along the right/left direction of the hull (outward).

The auxiliary nozzle is not restricted to that with which the water, introduced into the entrance, is jetted along the outer surface of the main bucket body. The auxiliary nozzle may be arranged such that the water, introduced into the entrance, is jetted to an upper side, lower side, etc., of the main bucket body to thereby jet the water along a portion of the main bucket body other than the outer surface.

The water flow jetting directions of the pair of right and left reverse drive jet ports when the pair of right and left deflectors are at the straight drive positions do not have to be right/left symmetrical.

In the preferred embodiments of the present invention described above, although the intakes are preferably aligned straightly in the front/rear direction with respect to the jet propulsion devices in plan view, the present invention is not restricted thereto. The intakes and the jet propulsion devices do not have to be matched in positions in the right/left direction.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A water jet propulsion watercraft comprising:

a hull; and a pair of jet propulsion devices attached to the hull and arranged to the right and left of a hull centerline; wherein each of the pair of jet propulsion devices includes:

a jetting unit arranged to jet water toward a rear of the hull;

a deflector supported on the hull and arranged to rotate, with respect to the hull, to the right and left within a predetermined rotation range including a straight drive position, the deflector including a forward drive jet port and a reverse drive jet port, the deflector arranged to change a jetting direction of the water jetted from the jetting unit; and a bucket supported on the hull independently of the deflector so as to be displaced between a forward drive position retreated from the forward drive jet port and a reverse drive position of blocking the forward drive jet port;

the bucket includes:

a reflecting surface arranged to receive the water jetted from the forward drive jet port and to reflect the water toward an inner side of the deflector when the bucket is at the reverse drive position; and an auxiliary nozzle including an entrance opened to the reflecting surface and arranged to jet water introduced into the entrance along a hull right/left direction; wherein the entrance of the auxiliary nozzle is spaced away from the forward drive jet port in the hull right/left direction and does not oppose the forward drive jet port in a state where the bucket is arranged at the reverse drive position and the deflector is arranged at the straight drive position;

a water flow is not jetted from either of a pair of the auxiliary nozzles respectively provided in a pair of the buckets respectively provided in the pair of right and left jet propulsion devices when the pair of the buckets are at the reverse drive positions and a pair of the deflectors respectively provided in the pair of right and left propulsion devices are at the straight drive positions; and a water flow is jetted from one of the pair of auxiliary nozzles respectively provided in the pair of the buckets and a water flow is not jetted from the other of the pair of auxiliary nozzles when the pair of the buckets are at the reverse drive position and the pair of the deflectors are rotated to either the right or the left from the straight drive positions.

2. The water jet propulsion watercraft according to claim 1, wherein the pair of the auxiliary nozzles respectively corresponding to the pair of jet propulsion devices are arranged to jet water in directions that are right/left symmetrical.

3. The water jet propulsion watercraft according to claim 1, wherein the entrance of the auxiliary nozzle is arranged so as to be positioned further away from the hull centerline in the hull right/left direction than the forward drive jet port and so as to not oppose the forward drive jet port in the state where the bucket is arranged at the reverse drive position and the deflector is arranged at the straight drive position, and the auxiliary nozzle is arranged such that the water introduced into the entrance is jetted along the hull right/left direction and toward the hull centerline.

4. A water jet propulsion watercraft comprising:

a hull; and a pair of jet propulsion devices attached to the hull and arranged to the right and left of a hull centerline; wherein each of the pair of jet propulsion devices includes:

a jetting unit arranged to jet water toward a rear of the hull;

a deflector supported on the hull and arranged to rotate, with respect to the hull, to the right and left within a predetermined rotation range including a straight drive position, the deflector including a forward drive jet port and a reverse drive jet port, the deflector arranged to change a jetting direction of the water jetted from the jetting unit; and a bucket supported on the hull independently of the deflector so as to be displaced between a forward drive position retreated from the forward drive jet port and a reverse drive position of blocking the forward drive jet port;

the bucket includes:

a reflecting surface arranged to receive the water jetted from the forward drive jet port and to reflect the water toward an inner side of the deflector when the bucket is at the reverse drive position; and an auxiliary nozzle including an entrance opened to the reflecting surface and arranged to jet water introduced into the entrance along a hull right/left direction; wherein the entrance of the auxiliary nozzle is spaced away from the forward drive jet port in the hull right/left direction and does not oppose the forward drive jet port in a state where the bucket is arranged at the reverse drive position and the deflector is arranged at the straight drive position; and the auxiliary nozzle includes a tunnel portion that defines a flow path in communication with the entrance and running in the hull right/left direction along an outer surface of the bucket.

5. The water jet propulsion watercraft according to claim 1, wherein the entrance is configured to receive a portion of the water jetted from the deflector when the bucket is arranged at the reverse drive position and the forward drive jet port of the deflector opposes the entrance.

6. The water jet propulsion watercraft according to claim 1, further comprising:

a nozzle interlocking mechanism arranged to interlockingly rotate the pair of the deflectors to the right and left; and a bucket interlocking mechanism arranged to interlockingly displace the pair of the buckets between the forward drive positions and the reverse drive positions.

7. The water jet propulsion watercraft according to claim 1, wherein the reverse drive jet port of the deflector is arranged to jet a water flow toward a front of the hull when the bucket is arranged at the reverse drive position.

8. The water jet propulsion watercraft according to claim 7, wherein the reverse drive jet port is arranged such that a water flow jetting direction when the deflector is at the straight drive position is a direction that includes a component directed away from the hull centerline.

9. The water jet propulsion watercraft according to claim 7, wherein the hull includes a hull bottom with a shape that becomes higher from a center to the sides, and the reverse drive jet port is arranged such that the water flow jetting direction when the deflector is at the straight drive position is a direction that includes a component directed toward the hull centerline.

10. The water jet propulsion watercraft according to claim 7, wherein a pair of the reverse drive jet ports respectively provided in the pair of right and left jet propulsion devices are arranged such that the pair of the reverse drive jet ports when the deflectors are at the straight drive positions are non-parallel to each other and are right/left symmetrical.

11. The water jet propulsion watercraft according to claim 7, further comprising:

an intake opening at the hull bottom; and an intake duct arranged to guide water sucked in from the intake to the deflector; wherein the reverse drive jet port is arranged such that the water flow jetting direction when the deflector is at the straight drive position is a direction that is shifted away from the intake.

12. A water jet propulsion watercraft comprising:

a hull; and a pair of jet propulsion devices attached to the hull and arranged to the right and left of a hull centerline; wherein each of the pair of jet propulsion devices includes:

a jetting unit arranged to jet water toward a rear of the hull;

a deflector supported on the hull and arranged to rotate, with respect to the hull, to the right and left within a predetermined rotation range including a straight drive position, the deflector including a forward drive jet port opened toward the rear of the hull and a reverse drive jet port opened toward a front of the hull, the deflector arranged to change a jetting direction of the water jetted from the jetting unit; and a bucket supported on the hull so as to be displaced between a forward drive position retreated from the forward drive jet port and a reverse drive position of blocking the forward drive jet port; wherein one of a pair of the deflectors respectively provided in the pair of jet propulsion devices has the reverse drive jet port including a port portion extending in a right front direction of the hull when the pair of the deflectors are at the straight drive position, while the other of the pair of the deflectors has the reverse drive jet port including a port portion extending in a left front direction of the hull when the pair of the deflectors are at the straight drive position; and a pair of the port portions provided in the respective reverse drive jet ports of the pair of the deflectors extend non-parallel to each other.

13. The water jet propulsion watercraft according to claim 12, wherein the reverse drive jet port of the deflector is arranged to jet a water flow toward the front of the hull when the bucket is arranged at the reverse drive position.

14. A water jet propulsion watercraft comprising:

a hull; and a pair of jet propulsion devices attached to the hull and arranged to the right and left of a hull centerline; wherein each of the pair of jet propulsion devices includes:

a jetting unit arranged to jet water toward a rear of the hull;

a deflector supported on the hull and arranged to rotate, with respect to the hull, to the right and left within a predetermined rotation range including a straight drive position, the deflector including a forward drive jet port opened toward the rear of the hull and a reverse drive jet port opened toward a front of the hull, the deflector arranged to change a jetting direction of the water jetted from the jetting unit; and a bucket supported on the hull so as to be displaced between a forward drive position retreated from the forward drive jet port and a reverse drive position of blocking the forward drive jet port; wherein the reverse drive jet port is arranged such that a water flow jetting direction when the deflector is at the straight drive position is a direction that includes a component directed away from a vertical plane through the hull centerline.

15. A water jet propulsion watercraft comprising:

a hull; and a pair of jet propulsion devices attached to the hull and arranged to the right and left of a hull centerline; wherein each of the pair of jet propulsion devices includes:

a jetting unit arranged to jet water toward a rear of the hull;

a deflector supported on the hull and arranged to rotate, with respect to the hull, to the right and left within a predetermined rotation range including a straight drive position, the deflector including a forward drive jet port opened toward the rear of the hull and a reverse drive jet port opened toward a front of the hull, the deflector arranged to change a jetting direction of the water jetted from the jetting unit; and a bucket supported on the hull so as to be displaced between a forward drive position retreated from the forward drive jet port and a reverse drive position of blocking the forward drive jet port; wherein the hull includes a hull bottom with a shape that becomes higher from a center to the sides, and the reverse drive jet port is arranged such that the water flow jetting direction when the deflector is at the straight drive position is a direction that includes a component directed toward the hull centerline.

16. The water jet propulsion watercraft according to claim 12, wherein the pair of right and left reverse drive jet ports are arranged such that the water flow jetting directions when the deflectors are at the straight drive positions are right/left symmetrical.

17. The water jet propulsion watercraft according to claim 12, further comprising:

an intake opening at the hull bottom; and an intake duct arranged to guide the water sucked in from the intake to the deflector; wherein the reverse drive jet port is arranged such that the water flow jetting direction when the deflector is at the straight drive position is a direction that is shifted away from the intake.

18. The water jet propulsion watercraft according to claim 1, wherein a water flow is jetted from the reverse port of the deflector provided in the jet propulsion device corresponding to the other of the pair of the auxiliary nozzles when the pair of the buckets are at the reverse drive positions and the pair of the deflectors are rotated to either the right or the left from the straight drive positions.

19. The water jet propulsion watercraft according to claim 1, wherein the one of the pair of the auxiliary nozzles is arranged to jet water toward right of the hull and the other of the pair of the auxiliary nozzles is arranged to jet water toward left of the hull;

a water flow is jetted from the one of the pair of the auxiliary nozzles, and a water flow is not jetted from the other of the pair of the auxiliary nozzles when the pair of the buckets are at the reverse drive positions and the pair of the deflectors are rotated to the left drive positions; and a water flow is jetted from the other of the pair of the auxiliary nozzles, and a water flow is not jetted from the one of the pair of the auxiliary nozzles when the pair of the buckets are at the reverse drive positions and the pair of the deflectors are rotated to the right drive positions.

20. The water jet propulsion watercraft according to claim 1, wherein the forward drive jet port is opened toward the rear of the hull, and the reverse drive port is opened toward a front of the hull.

* * * * *